US012295459B2

(12) United States Patent
Nathaniel et al.

(10) Patent No.: US 12,295,459 B2
(45) Date of Patent: May 13, 2025

(54) APPARATUS FOR SECURING A FOOTWEAR TONGUE

(71) Applicants: Alec Nathaniel, Philadelphia, PA (US); Lottie Mae Jennings, Voorhees, NJ (US)

(72) Inventors: Alec Nathaniel, Philadelphia, PA (US); Lottie Mae Jennings, Voorhees, NJ (US)

( * ) Notice: Subject to any disclaimer, the term of this patent is extended or adjusted under 35 U.S.C. 154(b) by 330 days.

(21) Appl. No.: 17/900,920

(22) Filed: Sep. 1, 2022

(65) Prior Publication Data

US 2023/0067999 A1 Mar. 2, 2023

Related U.S. Application Data

(60) Provisional application No. 63/239,633, filed on Sep. 1, 2021.

(51) Int. Cl.
*A43B 23/26* (2006.01)

(52) U.S. Cl.
CPC ..... *A43B 23/26* (2013.01)

(58) Field of Classification Search
CPC ..... A43B 23/26; A43C 1/00; A43C 11/20
See application file for complete search history.

(56) References Cited

U.S. PATENT DOCUMENTS 1,809,998 A * 6/1931 Wernmark ..... A43B 23/26 36/50.1
1,933,467 A * 10/1933 Yartyan ..... A43C 11/12 36/50.1
4,126,951 A * 11/1978 Antonious ..... A43C 11/1493 24/306
4,254,566 A * 3/1981 Haskell ..... G09F 3/04 40/636
4,597,198 A * 7/1986 Schweitzer ..... A43B 23/24 2/245
4,630,383 A * 12/1986 Gamm ..... A43C 11/24 36/134
D311,446 S * 10/1990 Merritt ..... D2/975
5,459,947 A * 10/1995 Lasher ..... A43C 1/00 24/306
6,449,881 B1 * 9/2002 Assaf ..... A43B 23/26 150/144
7,152,286 B2 * 12/2006 Rooney ..... A43B 3/00 24/712.6
7,165,342 B2 * 1/2007 Sheen ..... A41D 17/00 36/114
7,484,320 B2 * 2/2009 Butt ..... A43C 11/24 36/132
9,867,431 B2 * 1/2018 Harley ..... A43B 3/0031
(Continued)

*Primary Examiner* — Jillian K Pierorazio
(74) *Attorney, Agent, or Firm* — Ashok Tankha

(57) ABSTRACT

An apparatus for securing a tongue of footwear in a fixed position. The apparatus includes a first panel and a second panel. The first panel includes a slot for slidably encircling the tongue folded in an upward direction. The slot squeezes and bundles the tongue to secure the tongue in the fixed position. The first panel moves along a longitudinal axis of the tongue. The second panel extends from a proximal end of the first panel. The apparatus serves as a substitute tongue for the footwear, supports the original tongue of the footwear in the fixed position, and allows accessories and other devices to be accommodated in and around the footwear.

12 Claims, 52 Drawing Sheets

(56) References Cited

U.S. PATENT DOCUMENTS

| | | | | |
|---|---|---|---|---|
| 2005/0183288 | A1* | 8/2005 | Hull | A43B 23/24<br>36/50.1 |
| 2014/0082962 | A1* | 3/2014 | Rodriguez | A43C 7/00<br>36/54 |
| 2023/0084256 | A1* | 3/2023 | Brilliant | A43C 11/00<br>36/114 |

* cited by examiner

APPARATUS FOR SECURING A FOOTWEAR TONGUE

CROSS-REFERENCE TO RELATED APPLICATIONS

This application claims priority to and the benefit of the provisional patent application titled "Shoe replacement tongue accessory attachment channeling system", application No. 63/239,633, filed in the United States Patent and Trademark Office on Sep. 1, 2021. The specification of the above referenced patent application is incorporated herein by reference in its entirety.

BACKGROUND

The apparatus disclosed herein generally relates to footwear, and more specifically pertains to athletic shoes, walking shoes, or other footwear comprising a tongue on their upper vamps, with the apparatus being used to secure the tongue in a fixed position.

The majority of innovations in footwear generally pertains to various types of sole constructions, or patterned soles, that are aimed at enhancing efficiency of usage of the footwear during participation in a sport, exercise, or other activity. Furthermore, footwear such as shoes have been modified in the past to include various changes to the tongue, for example, adding a pocket within the tongue, or adding pockets along a quarter portion of the shoe, in order to add to the utility of the footwear. However, footwear available in the market do not provide a support structure for the tongue of the footwear to enable the tongue to stay upright or stay inclined at a desired angle with respect to the footwear, and more particularly, with respect to an eyestay of the footwear. Footwear manufacturers also manufacture footwear in fanciful colors and designs with trademarks or logos of the manufacturers displayed in the footwear. However, none of the footwear available in the market allow a user, for example, a wearer, of the footwear to customize the footwear for displaying a multiplicity of indicia or designs and/or for attaching one or more accessories to the footwear, without damaging the footwear.

Hence, there is a long-felt yet unresolved need for an apparatus that provides support to a tongue of footwear to enable the tongue to stay in an upright position, or stay in an inclined position at a desired angle with respect to the footwear, and more particularly, with respect to an eyestay of the footwear. There is also a long-felt yet unresolved need for an apparatus that allows a user of the footwear to customize the footwear for displaying a multiplicity of indicia or designs and/or for attaching one or more accessories to the footwear, without damaging the footwear.

SUMMARY OF THE INVENTION

This summary is provided to introduce a selection of concepts in a simplified form that are further disclosed in the detailed description of the invention. This summary is not intended to determine the scope of the claimed subject matter.

The apparatus disclosed herein addresses the above-recited need for providing support to a tongue of footwear to enable the tongue to stay in an upright position, or stay in an inclined position at a desired angle with respect to the footwear, and more particularly, with respect to an eyestay of the footwear. The apparatus disclosed herein also addresses the above-recited need for allowing a user, for example, a wearer, of the footwear to customize the footwear for displaying a multiplicity of indicia or designs and/or for attaching one or more accessories to the footwear, without damaging the footwear. Different embodiments of the apparatus disclosed herein secure the tongue of the footwear in different ways as disclosed below.

In a first embodiment, the apparatus for securing the tongue of the footwear in a fixed position comprises a first panel and a second panel. The first panel comprises a slot adapted to slidably encircle the tongue folded in an upward direction. The slot is adapted to squeeze and bundle the tongue to secure the tongue in the fixed position. The first panel is adapted to move along a longitudinal axis of the tongue. The second panel extends from a proximal end of the first panel. In an embodiment, the second panel comprises multiple holes disposed proximal to a proximal end of the second panel. Each of the holes in the second panel is secured by a grommet. The first panel of the apparatus extends along the longitudinal axis of the tongue. Furthermore, width of the first panel is greater than width of the second panel. The first panel is adapted to encapsulate the tongue when the first panel slidably encircles a base of the tongue. In an embodiment, the slot in the first panel is disposed proximal to the proximal end of the first panel. The slot can be manufactured in various shapes and sizes. For example, the slot is one of a circular-shapes slot, a rectangular-shaped slot, a square-shaped slot, a triangular-shaped slot, a polygonal-shaped slot, and a star-shaped slot. In an embodiment, the slot comprises an elastic band embedded along its perimeter to tightly grip the tongue of the footwear.

In an embodiment, length of the second panel is greater than length of the first panel. In another embodiment, the length of the second panel is equal to the length of the first panel. In another embodiment, the length of the second panel is less than the length of the first panel. In another embodiment, the length of the first panel is about 1 inch to about 7 inches. In an embodiment, the second panel is adapted to be disposed below a laced eyestay of the footwear. In another embodiment, the second panel is adapted to be accommodated between a lace and the laced eyestay of the footwear. In another embodiment, the second panel is adapted to be disposed on top of the lace and the laced eyestay of the footwear.

In an embodiment, the apparatus is adapted to tilt the tongue towards a collar of the footwear when the second panel is pushed towards a base of the tongue. In another embodiment, the apparatus is adapted to tilt the tongue towards the collar of the footwear when the first panel is pushed towards the tongue. In another embodiment, the apparatus is adapted to tilt the tongue towards a toe tip of the footwear when the second panel is pulled towards the collar of the footwear.

In an embodiment, the first panel and the second panel of the apparatus comprise one or more receptacles adapted to receive and accommodate one or more accessories on the footwear. In another embodiment, the first panel and the second panel of the apparatus comprise one or more fasteners adapted to fasten one or more accessories to the footwear. The apparatus disclosed herein is made, for example, of a fabric material, a leather material, a plastic material, a composite material, a metal, an alloy, or a combination thereof.

In a second embodiment, the apparatus for securing the tongue of the footwear in a fixed position is configured in a wedge shape. In this embodiment, thickness of the first panel is greater than thickness of the second panel. The thickness of the apparatus tapers along a longitudinal direction from the first panel towards the second panel. In this embodiment, the apparatus is made, for example, of a plastic material, a composite material, a metal, an alloy, or a combination thereof. In an embodiment, sides of the apparatus gradually curve outwards along the longitudinal direction from the first panel to the second panel. Furthermore, width of the first panel tapers along a direction opposite to the longitudinal direction to form an arrowhead shape. In an embodiment, the slot configured in the first panel of the apparatus has a shape that generally resembles a house-shaped pentagon.

In a third embodiment, the apparatus for securing the tongue of the footwear in a fixed position comprises a first panel and a second panel. The first panel comprises a first side edge, a second side edge, a distal end, a proximal end, and an elastic band secured to the first side edge and the second side edge proximal to the distal end of the first panel. The elastic band is adapted to encircle the tongue folded in an upward direction. The first panel is adapted to move along a longitudinal axis of the tongue. The elastic band is adapted to squeeze and bundle the tongue to secure the tongue in the fixed position. The second panel comprises a proximal end attached to the proximal end of the first panel. The second panel further comprises a distal end, a first side edge, and a second side edge. The second panel further comprises an elastic band secured to the first side edge and the second side edge of the second panel, proximal to the distal end of the second panel. The elastic band of the second panel is adapted to encircle the tongue folded in the upward direction. Furthermore, the distal end of the second panel is adapted to move along the longitudinal axis of the tongue when the elastic band of the second panel encircles the tongue. The elastic band of the second panel is adapted to squeeze and bundle the tongue to secure the tongue in the fixed position. In another embodiment, the second panel is adapted to overlap the first panel, the lace, and the laced eyestay of the footwear.

In a fourth embodiment, the apparatus for securing the tongue of the footwear in a fixed position comprises a first panel and a second panel. The first panel comprises a distal end, a first side edge, a second side edge, a proximal end, and an elastic band secured to the first side edge and the second side edge proximal to the distal end of the first panel. The elastic band is adapted to encircle the tongue folded in an upward direction. The first panel is adapted to move along the longitudinal axis of the tongue. The elastic band is adapted to squeeze and bundle the tongue to secure the tongue in the fixed position. The second panel comprises a proximal end attached to the proximal end of the first panel. The second panel further comprises a proximal end, a first side edge, and a second side edge. The second panel further comprises a strap secured to its distal end. The strap is adapted to be secured around either an ankle or a shin of a user, for example, a wearer, of the footwear. The first panel of the apparatus is adapted to be disposed below the laced eyestay of the footwear.

In a fifth embodiment, the apparatus for securing the tongue of the footwear in a fixed position comprises a first panel, a second panel, and a connecting member. The second panel is aligned substantially parallel to the first panel. The connecting member connects the first panel to the second panel. The first panel and the second panel connected by the connecting member define a space therebetween for securing the tongue folded in an upward direction. The apparatus is adapted to secure the tongue in the space between the first panel and the second panel. Furthermore, the apparatus is adapted to secure the tongue in the fixed position when the apparatus is attached to a base of the tongue. In an embodiment, the first panel is spaced apart from the second panel and the connecting member connects a side edge of the first panel to a side edge of the second panel. In this embodiment, the connecting member is a U-shaped connecting member extending between and along the side edges of the first panel and the second panel. In another embodiment, the connecting member connecting the first panel to the second panel comprises a hinge and a spring.

The structures of the apparatus for securing the tongue of the footwear in a fixed position will be apparent with reference to the disclosure and drawings disclosed herein. In the disclosure and the drawings, particular embodiments of the apparatus have been disclosed in detail as being indicative of some of the ways in which the concept of the apparatus may be employed, but the apparatus is not limited in scope. Rather, the apparatus includes all changes, modifications, and equivalents within the spirit and terms of the claims.

Structures that are disclosed and/or illustrated with respect to one embodiment may be used in the same way or in a similar way in one or more other embodiments and/or in combination with or instead of the structures of the other embodiments.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific structures, components, and methods disclosed herein. The disclosure of a structure, or a component, or a method step referenced by a numeral in a drawing is applicable to the disclosure of that structure, or component, or method step shown by that same numeral in any subsequent drawing herein.

DETAILED DESCRIPTION OF THE INVENTION

Figure 1A:
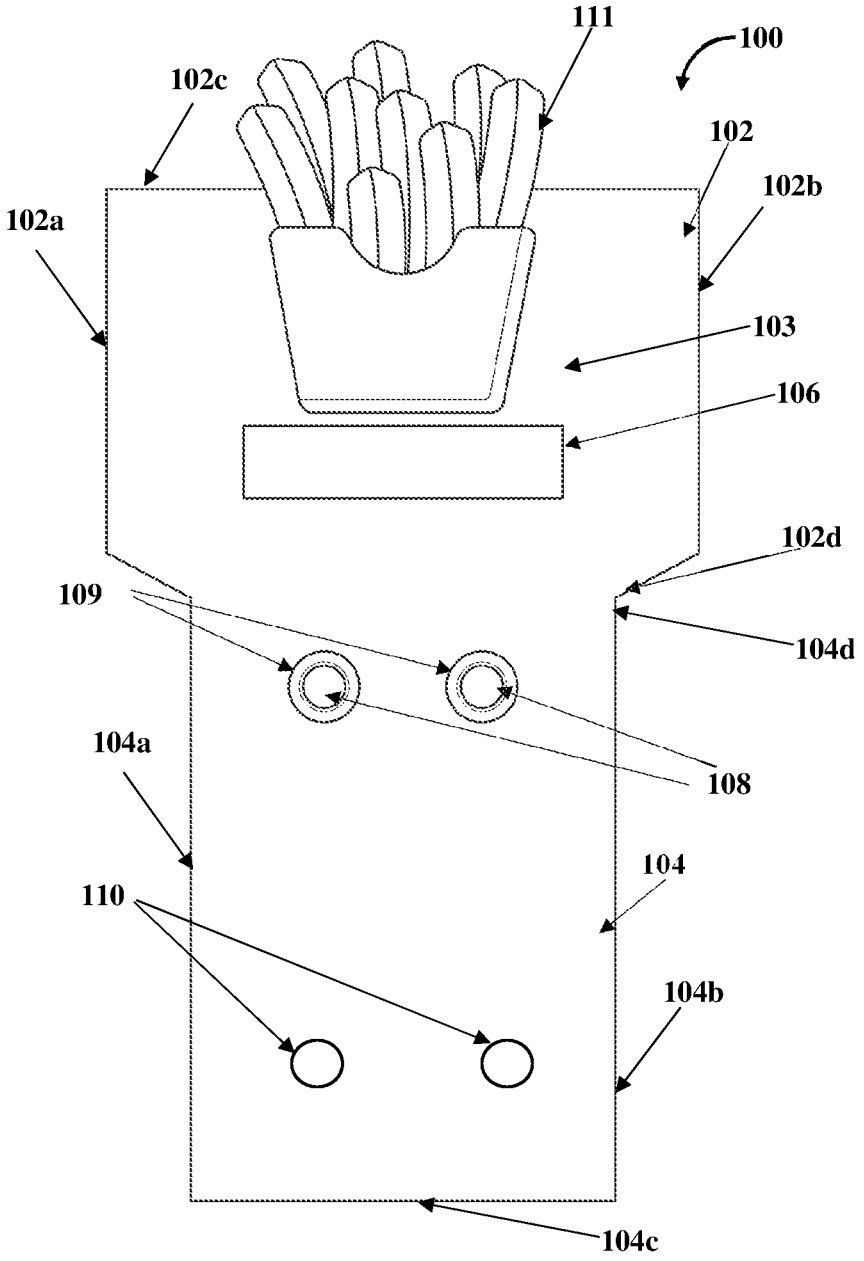
FIG. 1A exemplarily illustrates a front elevation view of a first embodiment of an apparatus for securing a tongue of footwear in a fixed position.
Figure 1B:
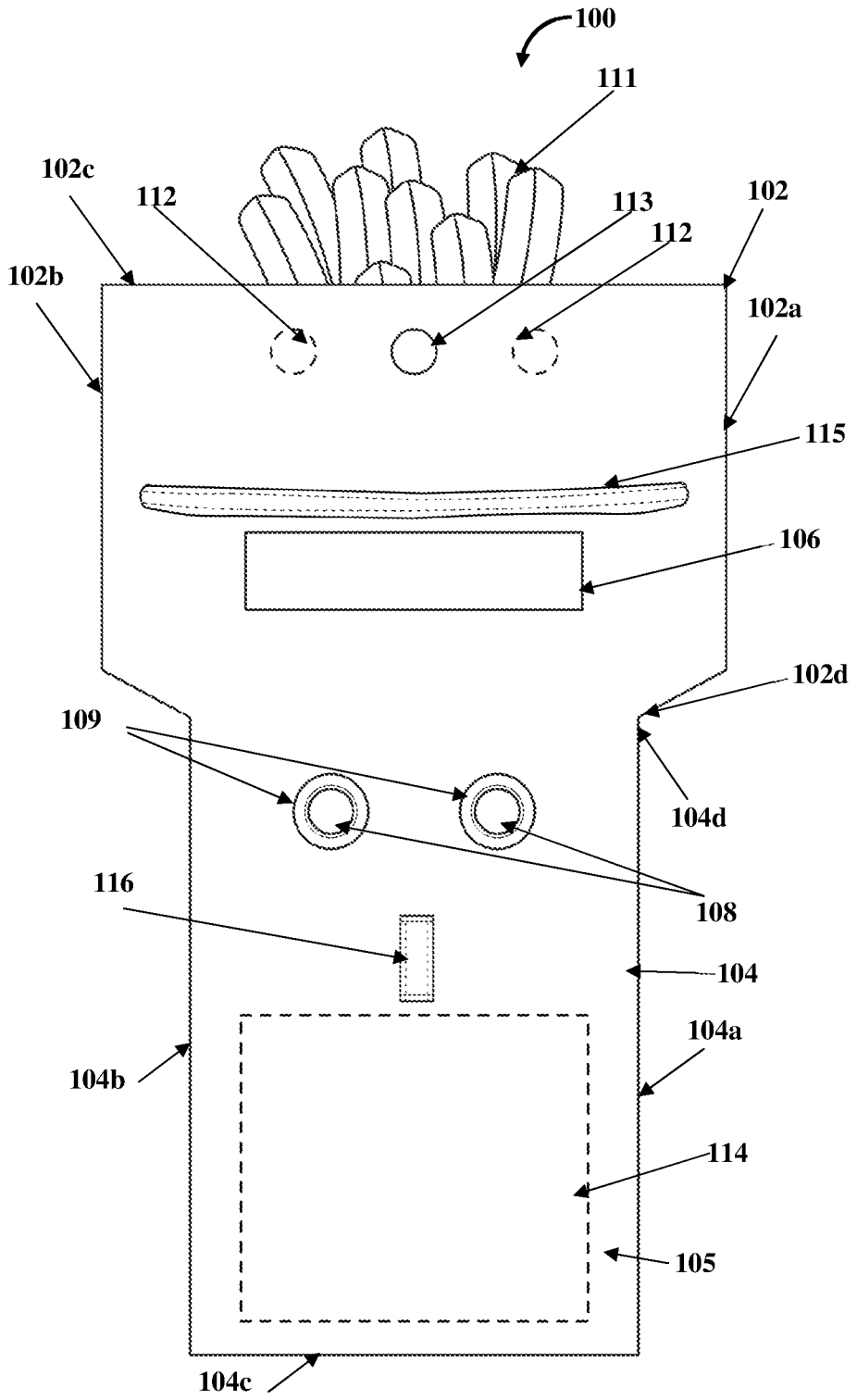
FIG. 1B exemplarily illustrates a rear elevation view of the first embodiment of the apparatus.
Figure 1C:
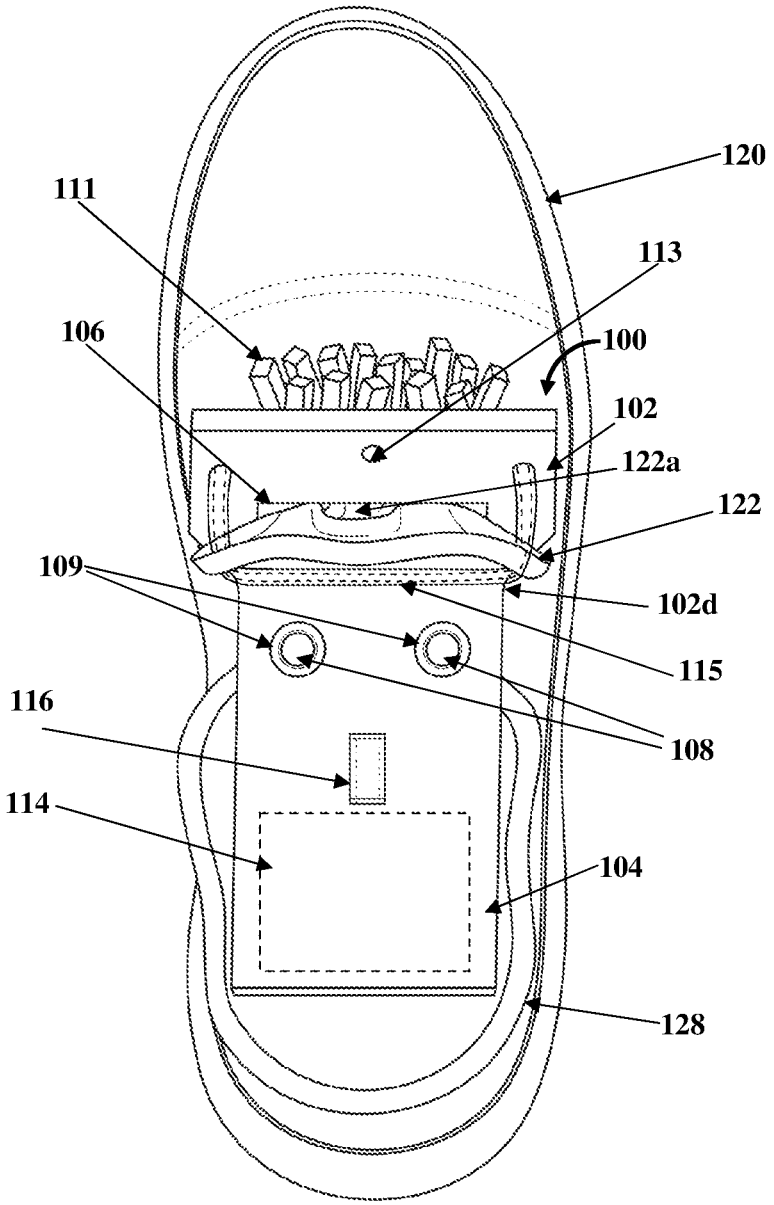
FIG. 1C exemplarily illustrates a top view of footwear, showing a slot of the first embodiment of the apparatus slidably encircling a tongue of the footwear.

FIG. 1A exemplarily illustrates a front elevation view of a first embodiment of an apparatus 100 for securing a tongue 122 of footwear 120 in a fixed position as shown in FIG. 1C. The tongue 122 of footwear 120, for example, a shoe, is a strip of material located under lace 126 of the footwear 120. The tongue 122 is disposed on a top center part of the footwear 120 and is attached to a vamp 132 in front of the footwear 120 and the quarter 134 in the back of the footwear 120 exemplarily illustrated in FIG. 1F. The footwear 120 refers to shoes, for example, sports shoes, sneakers, bowling shoes, skates, etc., worn on a foot of a user, for example, a wearer of the footwear 120. In an embodiment, the apparatus 100 disclosed herein is configured to position and support the tongue 122 in an upward direction above the lace 126 of the footwear 120 as exemplarily illustrated in FIG. 1F. FIG. 1B exemplarily illustrates a rear elevation view of the first embodiment of the apparatus 100. In the first embodiment, the apparatus 100 for securing the tongue 122 of the footwear 120 in a fixed position comprises a first panel 102 and a second panel 104. The second panel 104 extends from a proximal end 102*d* of the first panel 102.

As shown in FIG. 1A and FIG. 1B, the first panel 102 comprises a first side edge 102*a*, a second side edge 102*b*, and a distal end 102*c*, and the second panel 104 comprises a first side edge 104*a*, a second side edge 104*b*, a distal end 104*c*, and a proximal end 104*d*. The width of the first panel 102 is greater than the width of the second panel 104 as shown in FIG. 1A and FIG. 1B. The first panel 102 further comprises a slot 106 adapted to slidably encircle the tongue 122 folded in an upward direction. In an embodiment, the apparatus 100 disclosed herein allows one or more accessories, for example, 111 and 114, to be attached to the first panel 102 and the second panel 104, respectively. As exemplarily illustrated in FIGS. 1A-1H, one accessory 111, for example, a model of French fries, is attached to an upper surface 103 of the apparatus 100 at the distal end 102*c* of the first panel 102 shown in FIGS. 1A-1B, and another accessory 114 displaying indicia is attached to a lower surface 105 at the distal end 104*c* of the second panel 104 shown in FIGS. 1A-1B. In an embodiment, the first panel 102 and the second panel 104 comprise one or more receptacles 113 and 110 respectively, as exemplarily illustrated in FIGS. 1A-1B, configured to accommodate one or more accessories. The receptacles 113 and 110 are, for example, recesses or holes, configured in the first panel 102 and the second panel 104 respectively, as exemplarily illustrated in FIGS. 1A-1B, that are configured to accommodate plain protrusions, threaded protrusions, hooks, etc., of an accessory. For example, the receptacles 110 positioned proximal to the distal end 104*c* of the second panel 104 as exemplarily illustrated in FIG. 1A, are configured to receive plain protrusions, threaded protrusions, etc., of an accessory 114 exemplarily illustrated in FIG. 1B, for allowing attachment of the accessory 114 to the second panel 104. The accessories 111 and 114 comprise one or more indicia or designs on their top surface. In an embodiment, the first panel 102 and the second panel 104 further comprise one or more fasteners configured to fasten one or more accessories. For example, the first panel 102 comprises fasteners 112 as exemplarily illustrated in FIG. 1B, for fastening the accessory 111 to the first panel 102. Examples of fasteners comprise magnets that are embedded within the apparatus 100 or attached to the upper surface 103 of the apparatus 100. In an embodiment, fasteners such as strings, zip ties, etc., are used for securing the accessories, for example, 111, 114, etc., to the apparatus 100.

FIG. 1C exemplarily illustrates a top view of footwear 120, showing the slot 106 of the first embodiment of the apparatus 100 slidably encircling the tongue 122 of the footwear 120. The slot 106 is adapted to squeeze and bundle the tongue 122 to secure the tongue 122 in a fixed position. The first panel 102 is adapted to move along a longitudinal axis F-F' of the tongue 122 as shown in FIG. 1F. The first panel 102 of the apparatus 100 extends along the longitudinal axis F-F' of the tongue 122. The first panel 102 is adapted to either partially or substantially encapsulate the tongue 122 when the first panel 102 slidably encircles a base 122*a* of the tongue 122 as shown in FIG. 1F. In an embodiment, the second panel 104 comprises multiple holes, for example, two holes 108, disposed proximal to the proximal end 104*d* of the second panel 104. Each of the holes 108 in the second panel 104 is reinforced by a grommet 109 as shown in FIG. 1A, FIG. 1B, and FIG. 1C. In an embodiment, the holes 108 are used to secure the apparatus 100 to the footwear and more specifically to the laced eyestay 124 of the footwear 120. During the process of lacing the eyestay 124 of the footwear 120 the wearer may place the holes 108 adjacent to a desired pair of eyelets 124*a* and lace the holes 108 and the pair of eyelets 124*a*.

As shown in FIG. 1A and FIG. 1B, the slot 106 in the first panel 102 is disposed proximal to the proximal end 102*d* of the first panel 102. The slot 106 can be manufactured in various shapes and sizes. For example, the slot 106 has a rectangular shape as shown in FIG. 1A and FIG. 1B. In another example, the slot 106 has one of a circular shape, a square shape, a triangular shape, a polygonal shape, a star shape, etc. In an embodiment, the slot 106 comprises an elastic band (not shown) embedded along its perimeter to tightly grip the tongue 122 of the footwear 120.

Figures 1D, 1E:
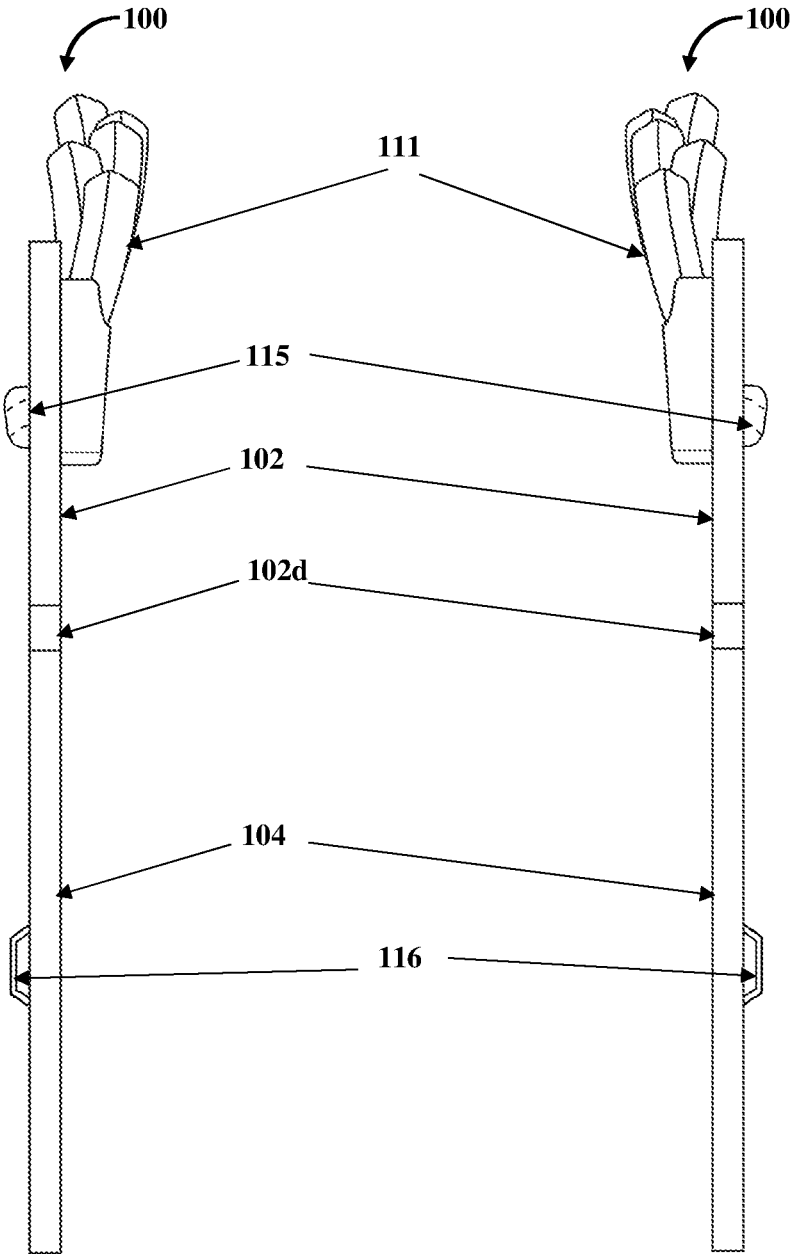
FIG. 1D exemplarily illustrates a left-side elevation view of the first embodiment of the apparatus.
FIG. 1E exemplarily illustrates a right-side elevation view of the first embodiment of the apparatus.
Figure 1F:
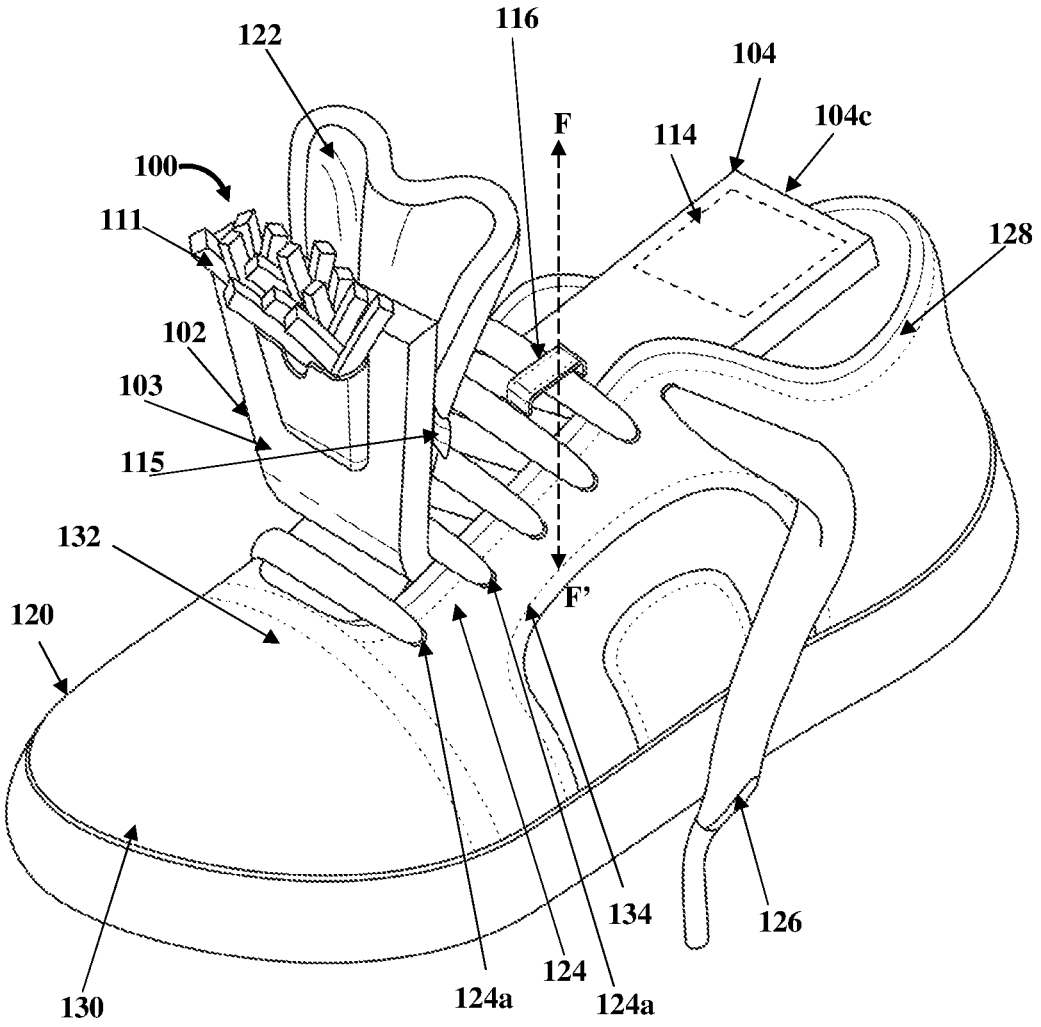
FIG. 1F exemplarily illustrates a front, right-side perspective view of footwear, showing a second panel of the first embodiment of the apparatus disposed below a laced eyestay and a lace of the footwear.

FIG. 1D and FIG. 1E exemplarily illustrate a left-side elevation view and a right-side elevation view of the first embodiment of the apparatus 100, respectively. In an embodiment, the length of the second panel 104 is greater than the length of the first panel 102 as shown in FIG. 1A, FIG. 1B, FIG. 1C, FIG. 1D, and FIG. 1E. In another embodiment, the length of the second panel 104 is less than the length of the first panel 102. In an embodiment, the length of the first panel 102 is, for example, about 1 inch to about 7 inches, and the length of the second panel 104 is, for example, about 2 inches to about 8 inches. In another embodiment (not shown), the length of the second panel 104 is equal to the length of the first panel 102. In an embodiment, the width of the second panel 104 is less than the width of the first panel 102 as shown in FIG. 1A and FIG. 1B. In an embodiment, the first panel 102 is, for example, about 2 inches to about 5 inches wide, and the second panel 104 is, for example, about 1 inch to about 4 inches wide.

Figure 1G:
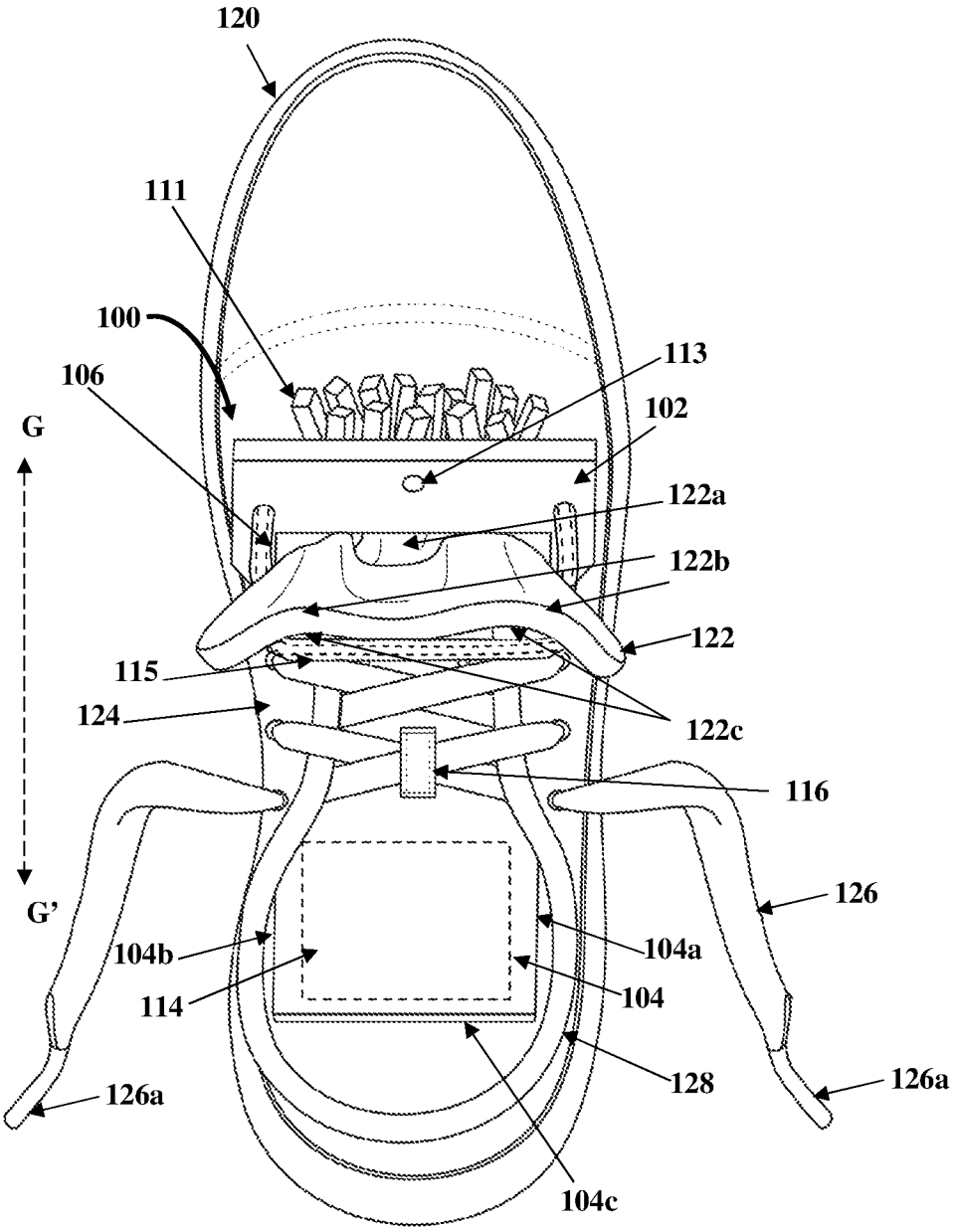
FIG. 1G exemplarily illustrates a top view of the first embodiment of the apparatus, showing the second panel of the apparatus disposed below the laced eyestay and the lace of the footwear.

In an embodiment, the apparatus 100 comprises an elastic band 115 located just above the slot 106 as shown in FIGS. 1B to 1H. Length of the elastic band 115 is substantially more than a width of the slot but less than a width of the first panel 102. The elastic band 115 is used to secure the first panel 102 to the tongue 122 as shown in FIGS. 1C and 1F-1H. The elastic band 115 precludes the first panel 102 from bending forward and falling on the vamp 132 in front of the footwear 120. In another embodiment, the apparatus 100 comprises a loop 116 located on the lower surface 105 proximal to the distal end 104*c* of the second panel 104 as shown in FIGS. 1B-1I. The loop 116 is used to secure the second panel 104 of apparatus 100 to the footwear 120 using the lace 126. As shown in FIGS. 1D and 1E, the loop 116 opens towards the first and second side edges 104*a* and 104*b*. As shown in FIG. 1G, an end 126*b* of the lace 126 inserted into the loop 116 from the first side edge 104*a* exits the loop 116 at the second side edge 104*b*. Likewise, another end 126*a* of the lace 126 inserted into the loop 116 from the second side edge 104*b* exits the loop 116 at the first side edge 104*a*.

FIG. 1F exemplarily illustrates a front, right-side perspective view of footwear 120, showing the second panel 104 of the first embodiment of the apparatus 100 disposed below a laced eyestay 124 and a lace 126 of the footwear 120. As exemplarily illustrated in FIG. 1F, the footwear 120 comprises the laced eyestay 124, a toe tip 130, a vamp 132, a quarter 134, and a collar 128 among other parts of the footwear 120. The laced eyestay 124 refers to a section of material that holds eyelets 124*a* of the footwear 120. The eyelets 124*a* are holes through which the lace 126 passes for fastening the footwear 120 to a user's foot. To position the apparatus 100 into the footwear 120 as shown in FIG. 1F, the crimped or partially rolled tongue 122 of a footwear having the lace 126 removed is inserted into the slot 106 from the upper surface 103 of the apparatus 100. The first panel 102 now slidably encircles the tongue 122. The first panel is then slid towards the base 122*a* of the tongue 122 until the upper surface 103 touches the base of the tongue 122*a*, as shown in FIG. 1C. The second panel 104 is now pushed underneath the eyestay 124. The eyestay 124 of the footwear is now laced by inserting an end 126*a* of the lace 126 in the eyelet 124*a* at the bottom of the eyestay 124 and the other end 126*b* of the lace 126 in the adjacent eyelet 124*a* at the bottom. The ends 126*a* and 126*b* are then crisscrossed to lace the pair of eyelets 124*a* adjacent to the eyelet 124*a* at the bottom. The wearer should ensure that the lace 126 and the eyestay 124 are always on top of the second panel 104 during the lacing process. The wearer may place the holes 108 of the apparatus 100 adjacent to a desired pair of eyelets 124*a* and lace the holes 108 and the pair of eyelets 124*a* to secure the apparatus 100 to the footwear and more specifically to the laced eyestay 124 of the footwear 120. Once the wearer laces till the eyelets 124*a* adjacent to the loop 116, the wearer may optionally lace the loop 116 to secure the second panel 104 of apparatus 100 to the footwear 120 using the lace 126.

FIG. 1G exemplarily illustrates a top view of the first embodiment of the apparatus 100, showing the second panel 104 of the apparatus 100 disposed below the laced eyestay 124 and the lace 126 of the footwear 120. In an embodiment, the second panel 104 is adapted to be disposed below the laced eyestay 124 of the footwear 120 as shown in FIG. 1F and FIG. 1G. In another embodiment, the second panel 104 is adapted to be accommodated between the lace 126 and the laced eyestay 124 of the footwear 120. In another embodiment, the second panel 104 is adapted to be disposed on top of the lace 126 and the laced eyestay 124 of the footwear 120. As exemplarily illustrated in FIGS. 1F and 1G, a portion of the second panel 104 disposed proximal to the distal end 104*c* of the second panel 104, extends beyond the laced eyestay 124, which allows a user to attach accessories 114 displaying indicia to the second panel 104 proximal to the distal end 104*c*.

As exemplarily illustrated in FIG. 1F, the apparatus 100 is adapted to tilt the tongue 122 towards the collar 128 of the footwear 120 when the second panel 104 is pushed towards the base 122*a* of the tongue 122. The apparatus 100 is also adapted to tilt the tongue 122 towards the collar 128 of the footwear 120 when the first panel 102 is pushed towards the tongue 122. In an embodiment, the apparatus 100 is adapted to tilt the tongue 122 towards the toe tip 130 of the footwear 120 when the second panel 104 is pulled towards the collar 128 of footwear 120. The apparatus 100 is made, for example, of a fabric material, a leather material, a plastic material, a composite material, a metal, an alloy, or a combination thereof. In the first embodiment of the apparatus 100 shown in FIGS. 1A-1G, the apparatus 100 is made of a fabric material, an elastic material, a leather material, or a combination thereof.

FIG. 1C, FIG. 1F, and FIG. 1G show the tongue 122 in a bundled position where the slot 106 encircles the tongue 122 from all sides and holds the sides of the tongue 122 together. Bundling the tongue 122 causes the tongue 122 to crimp and form ridges 122*b* and troughs 122*c* along the longitudinal axis F-F', as shown in FIG. 1G. The crimped tongue 122 has a higher resistance to bending along a lateral axis G-G' as compared to a tongue 122 that is not crimped and is held up on its own. The slot 106 of the apparatus 100 maintains the tongue 122 in the bundled position by encircling the tongue 122 either at the base 122*a* of the tongue 122 or at any position above the base 122*a* of the tongue 122.

Figure 1H:
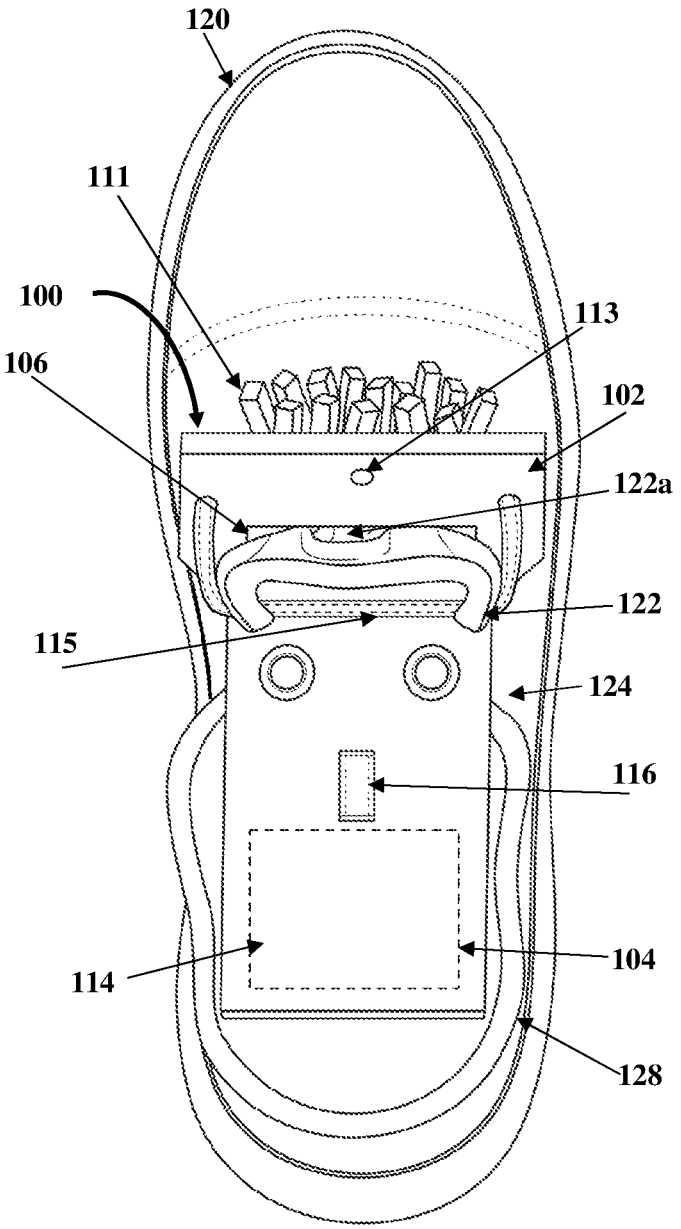
FIG. 1H exemplarily illustrates a top view of footwear, showing the slot of the first embodiment of the apparatus slidably encircling the tongue of the footwear and the tongue in a partially rolled position.

FIG. 1H exemplarily illustrates a top view of footwear 120, showing the slot 106 of the first embodiment of the apparatus 100 slidably encircling the tongue 122 of the footwear 120 and the tongue 122 in a partially rolled position. Partially rolling the tongue 122 as shown in FIG. 1H, also increases bending resistance of the tongue 122 along a lateral axis G-G' exemplarily illustrated in FIG. 1G, as compared to a tongue 122 that is not partially rolled and is held up on its own. The slot 106 of the apparatus 100 maintains the tongue 122 in the partially rolled position by encircling the tongue 122 either at the base 122*a* of the tongue 122 or any at position above the base 122*a* of the tongue 122.

Figure 1I:
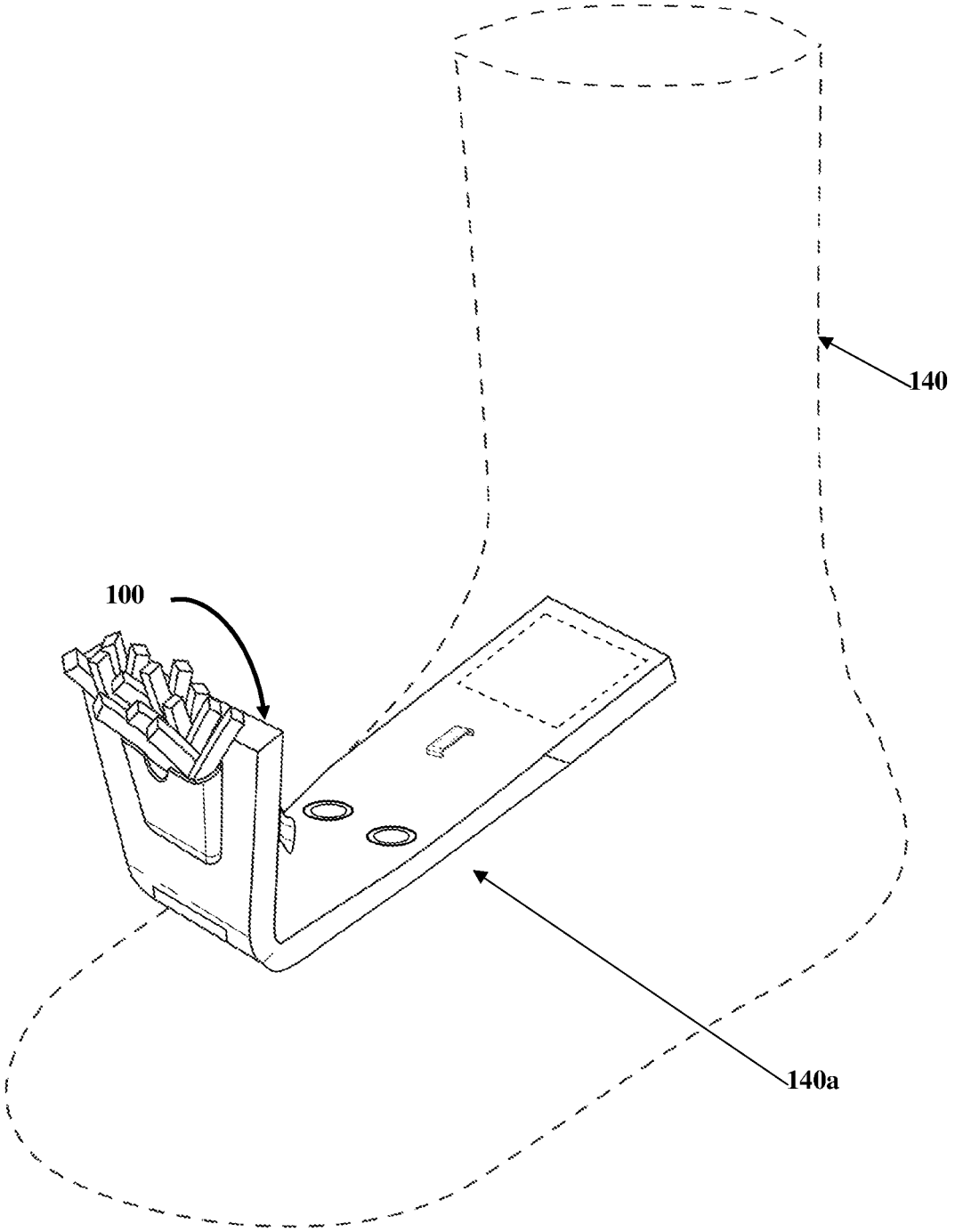
FIG. 1I exemplarily illustrates an embodiment wherein the first embodiment of the apparatus is affixed on a bridge portion of a sock.

FIG. 1I exemplarily illustrates an embodiment wherein the first embodiment of the apparatus 100 is affixed on a bridge portion 140*a* of a sock 140. The bridge portion 140*a* of the sock 140 is adapted to rest on a bridge of a foot of a wearer. The apparatus 100 is adapted to create a padding on the bridge portion 140*a* of the sock 140 so that the wearer can wear the sock 140 and insert the foot into a footwear 102, for example, a shoe and insert the tongue 122 through the slot 106 to use the apparatus 100.

Figure 2A:
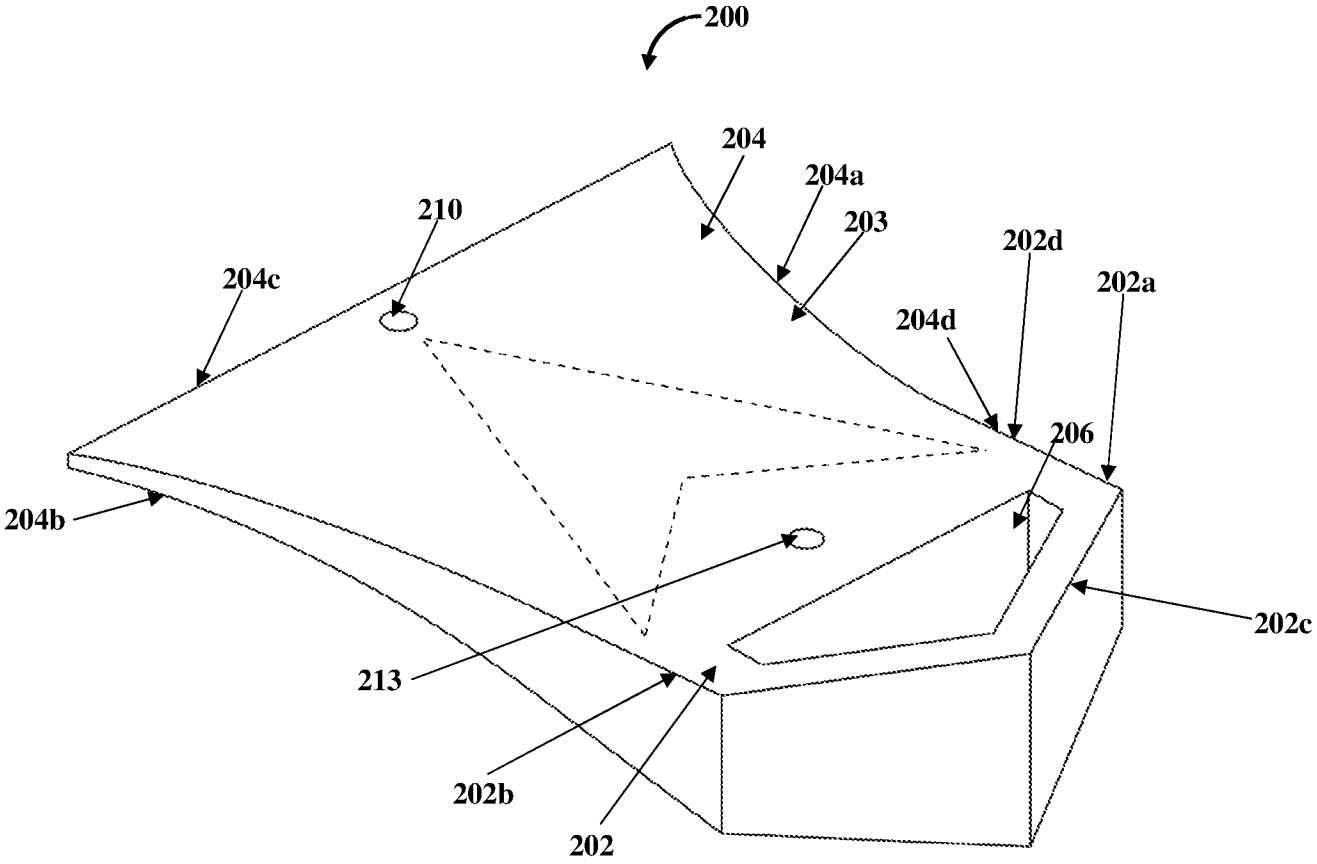
FIG. 2A exemplarily illustrates a front, left-side perspective view of a second embodiment of the apparatus for securing a tongue of footwear in a fixed position.
Figure 2B:
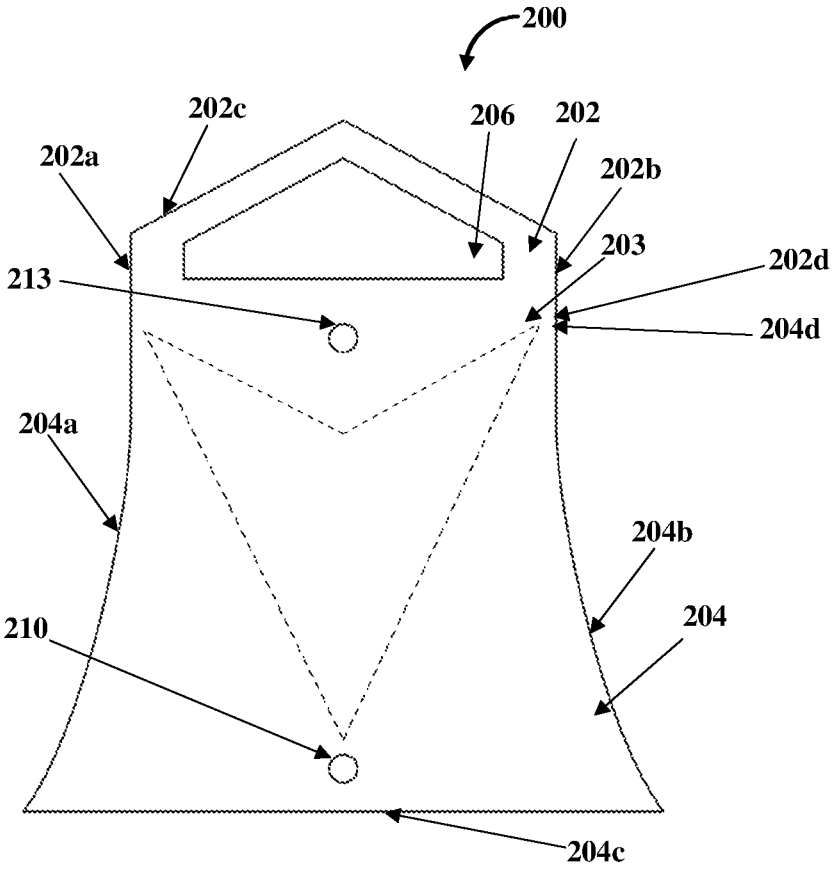
FIG. 2B exemplarily illustrates a top view of the second embodiment of the apparatus.
Figure 2C:
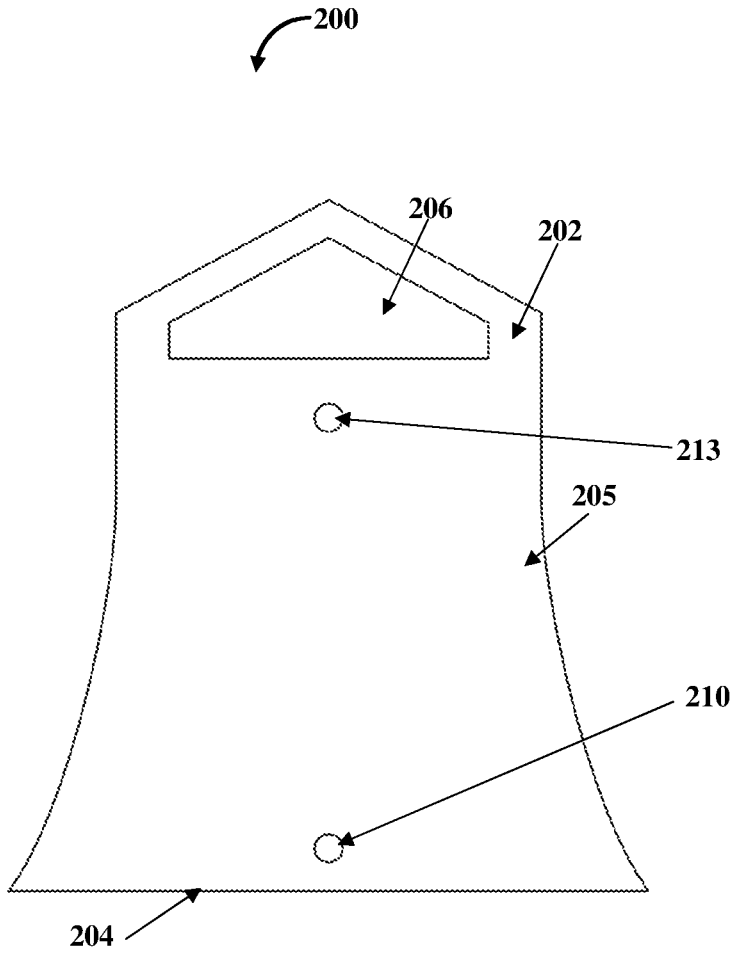
FIG. 2C exemplarily illustrates a bottom view of the second embodiment of the apparatus.
Figures 2D, 2E:
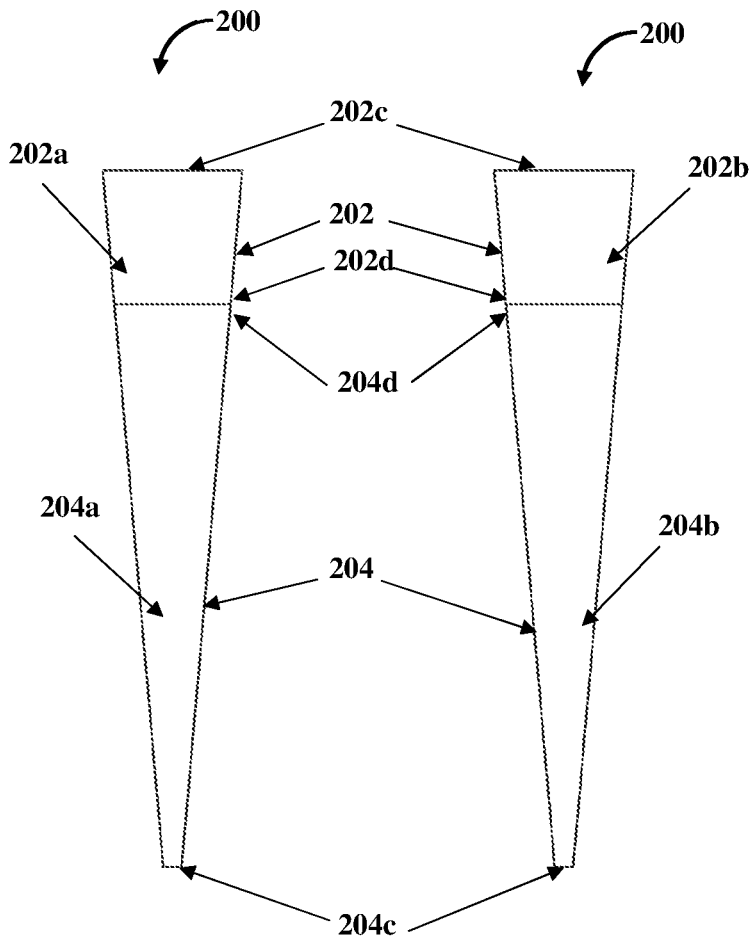
FIG. 2D exemplarily illustrates a left-side elevation view of the second embodiment of the apparatus.
FIG. 2E exemplarily illustrates a right-side elevation view of the second embodiment of the apparatus.
Figure 2F:
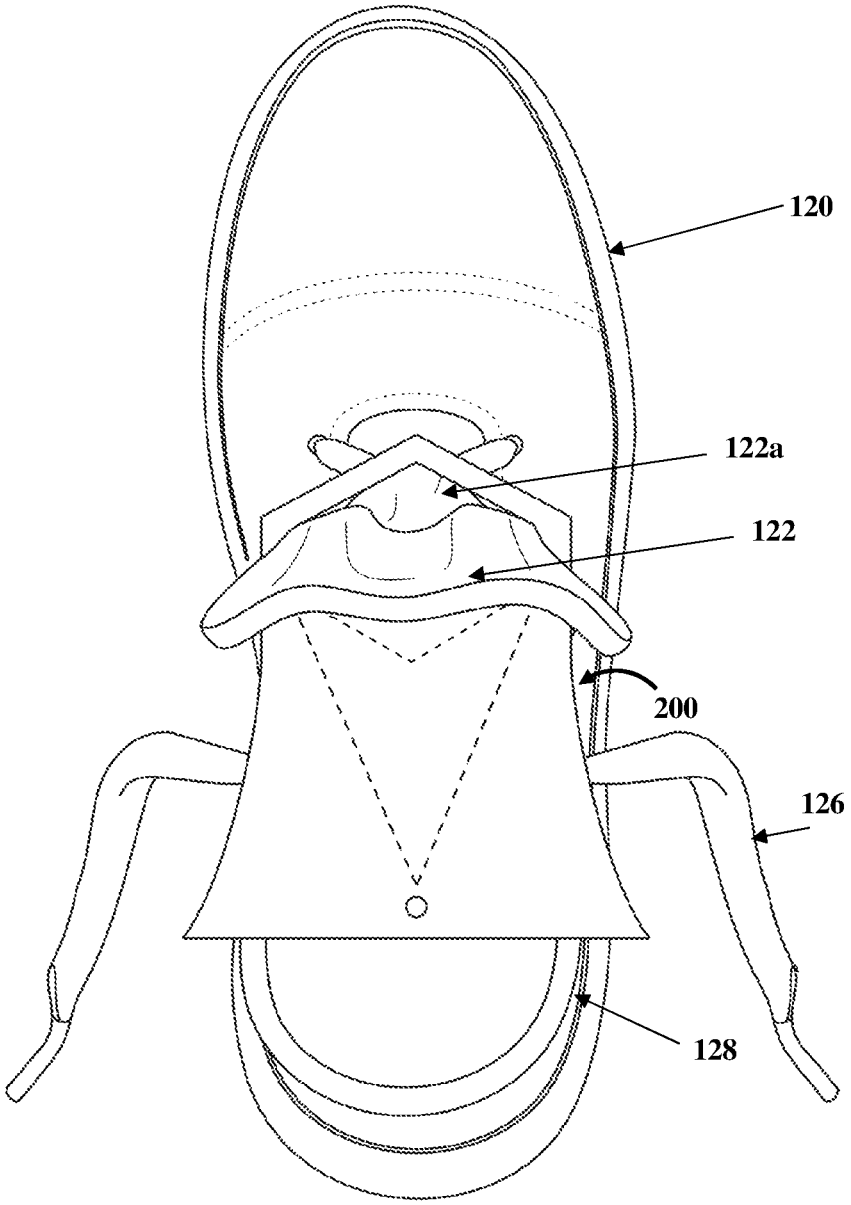
FIG. 2F exemplarily illustrates a top view of footwear, showing a slot of the second embodiment of the apparatus slidably encircling a tongue of the footwear, and a second panel of the apparatus disposed on top of a laced eyestay and a lace of the footwear.
Figure 2G:
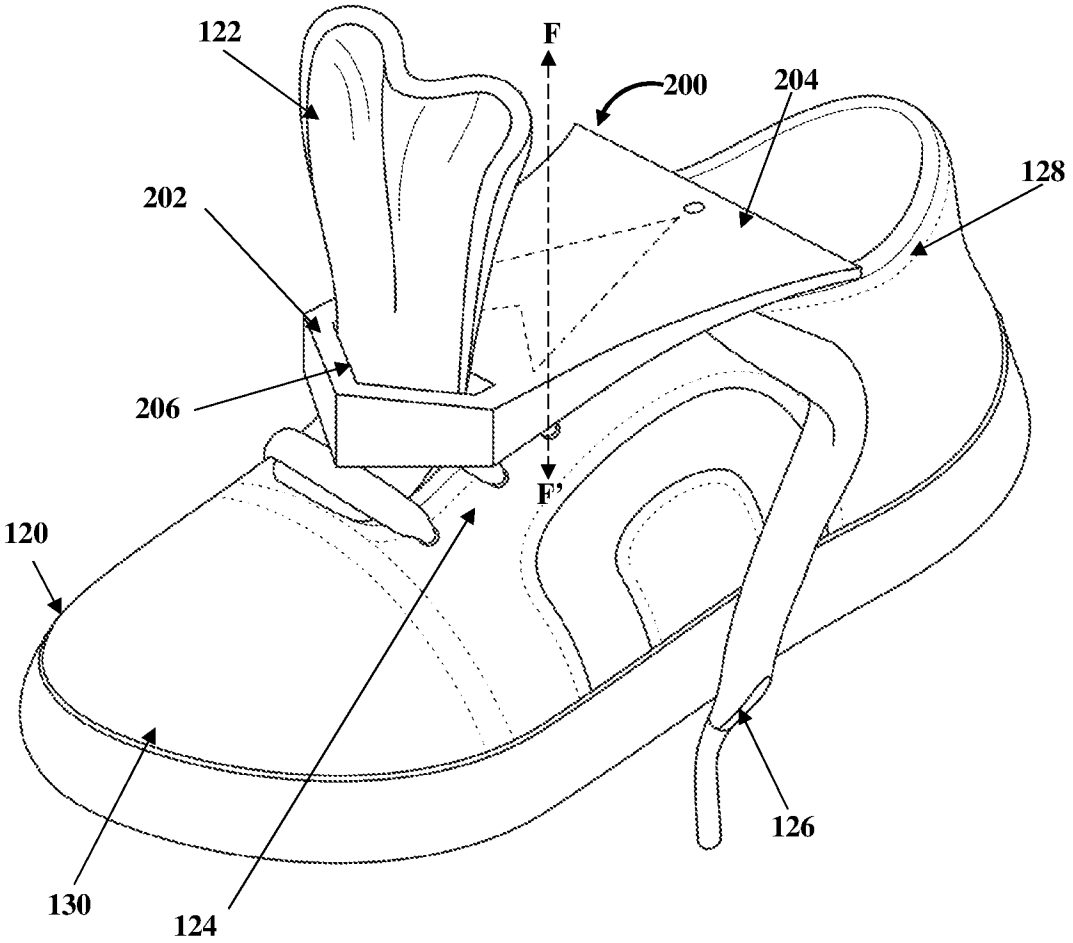
FIG. 2G exemplarily illustrates a front, right-side perspective view of footwear, showing the slot of the second embodiment of the apparatus slidably encircling the tongue of the footwear, and the second panel of the apparatus disposed on top of the laced eyestay of the footwear.
Figure 2H:
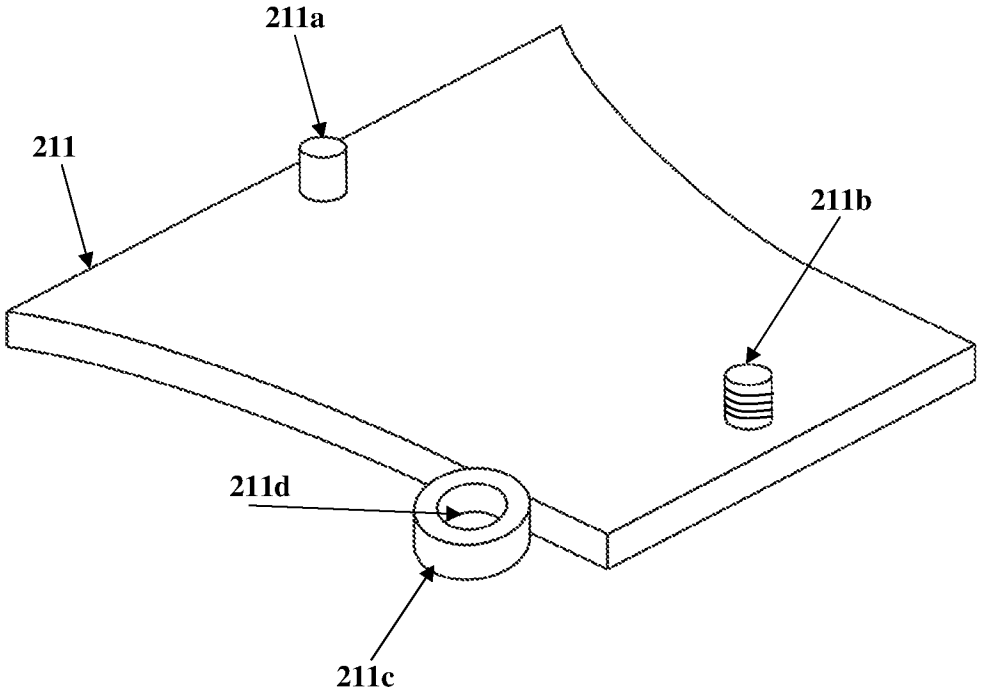
FIG. 2H exemplarily illustrates an embodiment of an accessory adapted to be disposed on top of the second embodiment of the apparatus for securing the tongue of the footwear in a fixed position.

FIG. 2A exemplarily illustrates a front, left-side perspective view of a second embodiment of the apparatus 200 for securing a tongue 122 of footwear 120 in a fixed position as shown in FIG. 2F and FIG. 2G. In the second embodiment, the apparatus 200 is configured in a wedge shape as shown in FIG. 2A, FIG. 2D, FIG. 2E, FIG. 2G, and FIG. 2I. In the second embodiment, the apparatus 200 comprises a first panel 202 and a second panel 204. The second panel 204 extends from a proximal end 202*d* of the first panel 202. FIG. 2B exemplarily illustrates a top view of the second embodiment of the apparatus 200. As exemplarily illustrated in FIG. 2A and FIG. 2B, the first panel 202 comprises a first side edge 202*a*, a second side edge 202*b*, a distal end 202*c*, and the proximal end 202*d*, and the second panel 204 comprises a first side edge 204*a*, a second side edge 204*b*, a distal end 204*c*, and a proximal end 204*d*. The first panel 202 further comprises a slot 206 adapted to slidably encircle the tongue 122. As shown in FIG. 2A and FIG. 2B, the first panel 202 and the second panel 204 comprise one or more receptacles 213 and 210. The receptacles 213 and 210 are, for example, recesses or holes in the first panel 202 and the second panel 204, respectively, that are configured to accommodate plain protrusions 211*a*, threaded protrusions 211*b*, etc., of an accessory 211 as shown in FIG. 2H. FIG. 2C exemplarily illustrates a bottom view of the second embodiment of the apparatus 200. As shown in FIGS. 2A, 2B and 2C, the apparatus 200 comprises an upper surface 203 and a lower surface 205. The accessory 211 may be attached to receptacles 213 and 210 on either the upper surface 103 or the lower surface 205. Likewise, a design or indicia may be applied on either the upper surface 103 or the lower surface 205. Since the accessory 211 may be attached to receptacles 213 and 210 on either the upper surface 103 or the lower surface 205, the apparatus 200 is reversibly usable. FIG. 2D and FIG. 2E exemplarily illustrate a left-side elevation view and a right-side elevation view of the second embodiment of the apparatus 200, respectively.

FIG. 2F exemplarily illustrates a top view of footwear 120, showing the slot 206 of the second embodiment of the apparatus 200 slidably encircling the tongue 122 of the footwear 120, and the second panel 204 of the apparatus 200 disposed on top of a laced eyestay 124 and a lace 126 of the footwear 120. The slot 206 is adapted to squeeze and bundle the tongue 122 to secure the tongue 122 in a fixed position. FIG. 2G exemplarily illustrates a front, right-side perspective view of the footwear 120, showing the slot 206 of the second embodiment of the apparatus 200 slidably encircling the tongue 122 of the footwear 120, and the second panel 204 of the apparatus 200 disposed on top of the laced eyestay 124 of the footwear 120. The apparatus 200 is adapted to move along a longitudinal axis F-F' of the tongue 122 as shown in FIG. 2G. In the second embodiment of the apparatus 200, the thickness of the first panel 202 is greater than the thickness of the second panel 204 as shown in FIG. 2A and FIGS. 2D-2E. The thickness of the apparatus 200 tapers along a longitudinal direction from the first panel 202 towards the second panel 204. In this embodiment, the apparatus 200 is made of a plastic material, a composite material, a metal, an alloy, or a combination thereof. In an embodiment, the sides 204*a* and 204*b* of the apparatus 200 gradually curve outwards along the longitudinal direction from the first panel 202 to the second panel 204. The width of the first panel 202 tapers along a direction opposite to the longitudinal direction to form an arrowhead shape as shown in FIG. 2A and FIG. 2B. In an embodiment, the slot 206 has a shape that generally resembles a house-shaped pentagon.

To dispose the apparatus 200 on top of the lace eyestay 124 of the footwear 120, the wearer first inserts the crimped or partially rolled tongue 122 into the slot 206 from underneath the apparatus 200 i.e., from the lower surface 205 of the apparatus 200, as shown in FIG. 2F. The slot 206 now slidably encircles the tongue 122. The apparatus 200 is then slid towards the base 122*a* of the tongue 122 until the lower surface 205 is disposed on top of the laced eyestay 124 of the footwear 120, as shown in FIG. 2G. The apparatus 200 of the second embodiment provides a solid platform for mounting accessories, for example, a battery pack, LED strip, etc., that require a stable support platform.

Figure 2I:
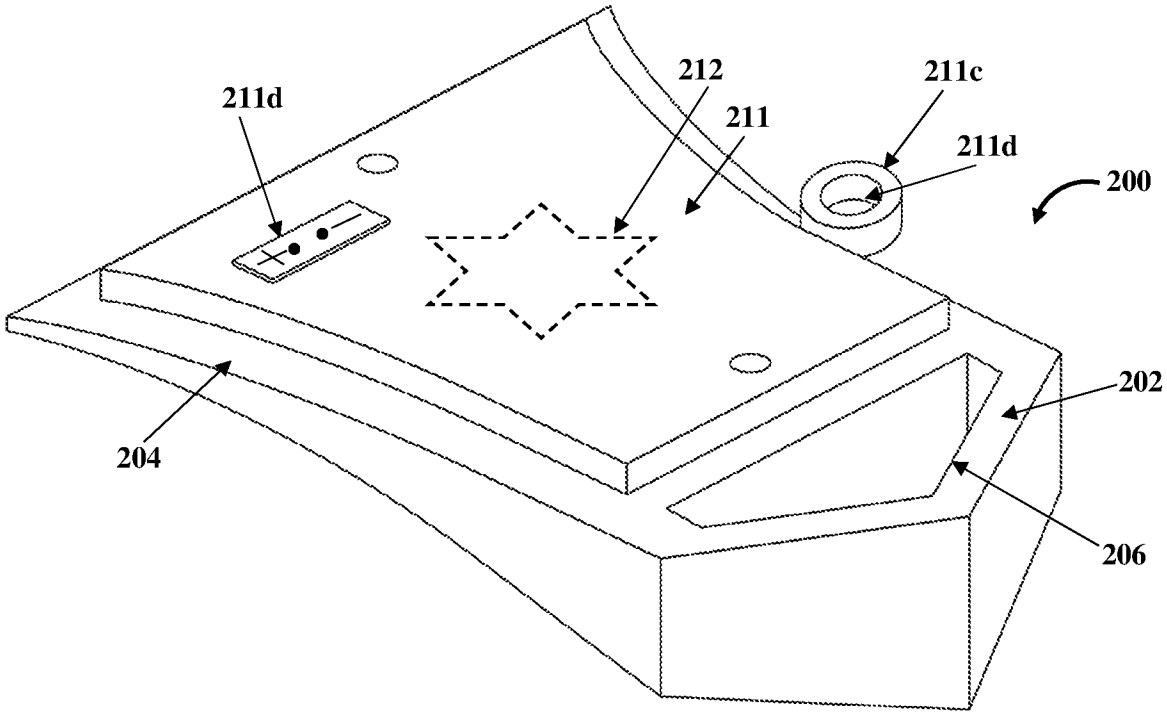
FIG. 2I exemplarily illustrates a front, left-side perspective view of the second embodiment of the apparatus and the accessory shown in FIG. 2H disposed on top of the apparatus.

FIG. 2H exemplarily illustrates an embodiment of an accessory 211 adapted to be disposed on top of the second embodiment of the apparatus 200 for securing the tongue 122 of the footwear 120 in a fixed position. As shown in FIG. 2H, the accessory 211 comprises plain protrusions 211*a* and threaded protrusions 211*b* extending below the accessory 211. The protrusions 211*a* and 211*b* of the accessory 211 are configured to be fit and secured into the receptacles 213 and 210 configured in the first panel 202 and the second panel 204 of the apparatus 200, respectively, as shown in FIG. 2A and FIG. 2B, for attaching the accessory 211 to the apparatus 200. In an embodiment, the accessory 211 comprises one or more indicia or designs 212 on its top surface, as shown in FIG. 2I. FIG. 2I exemplarily illustrates a front, left-side perspective view of the second embodiment of the apparatus 200 and the accessory 211 shown in FIG. 2H disposed on top of the apparatus 200. In an embodiment, the accessory 211 comprises a battery pack (not shown) and a light source 211*d*. The accessory 211 comprising the battery pack (not shown) comprises battery terminals 211*d* that may be connected to other accessories, for example, LED lights, motors, etc., that are mounted on the accessory 211. The accessory 211 comprises a flange 211*c* comprising a hole 211*d* as shown in FIGS. 2H and 2I. The lace 126 of the footwear 120 may be inserted through the hole 211*d* and to fasten the accessory 211 to the footwear 120 and the apparatus 200.

Figure 3A:
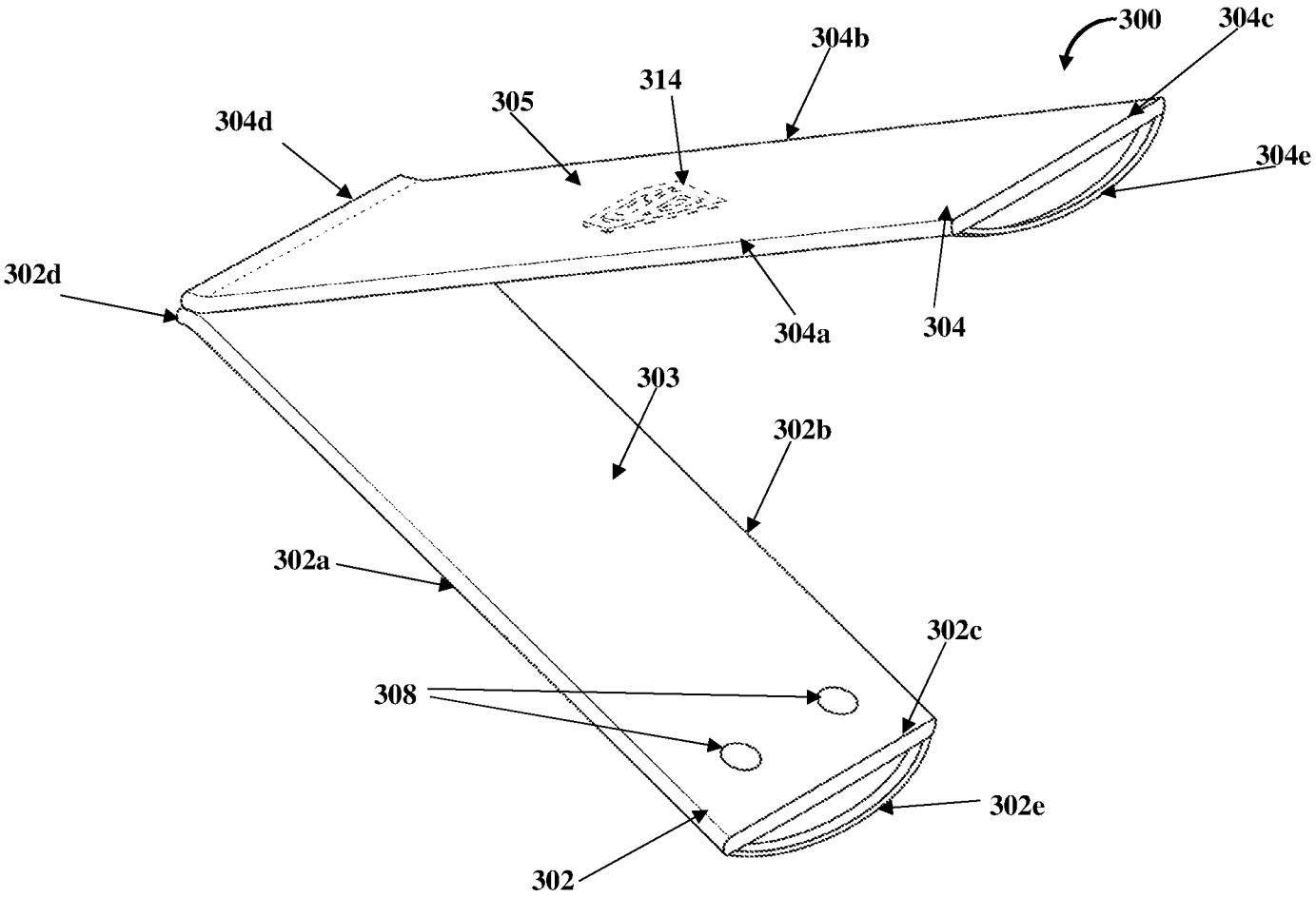
FIG. 3A exemplarily illustrates a front, left-side perspective view of a third embodiment of the apparatus for securing a tongue of footwear in a fixed position.
Figure 3B:
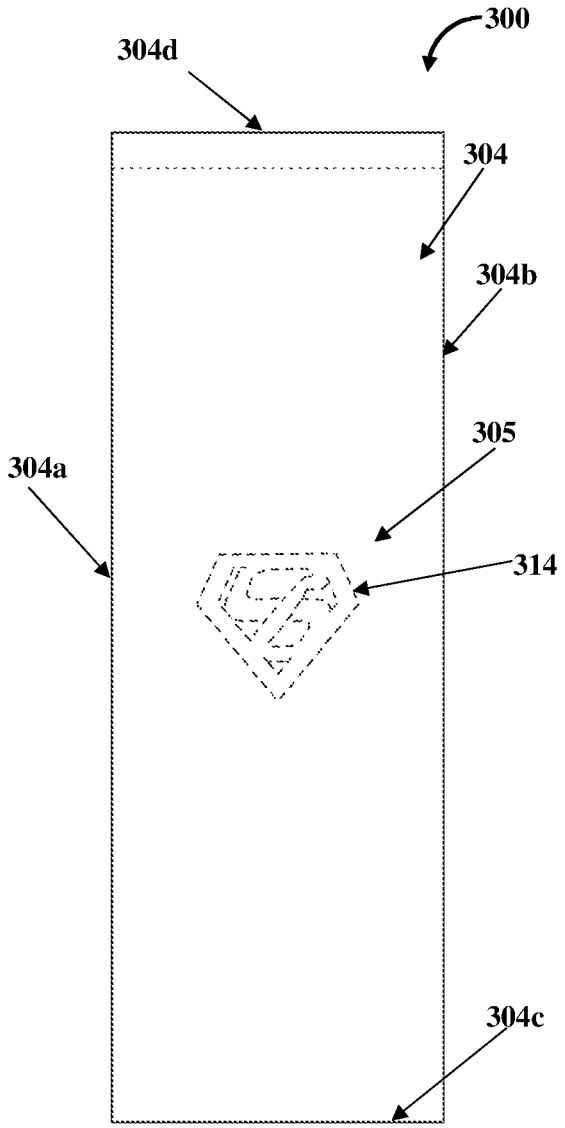
FIG. 3B exemplarily illustrates a top view of the third embodiment of the apparatus.
Figure 3C:
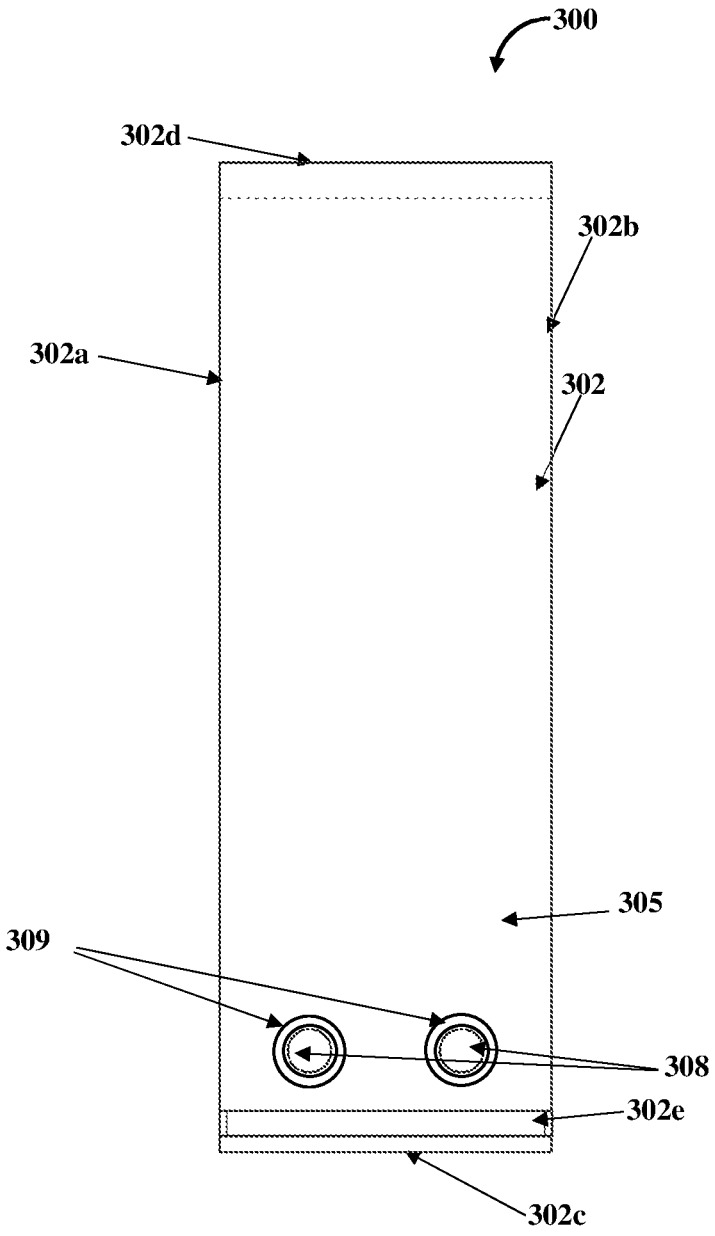
FIG. 3C exemplarily illustrates a bottom view of the third embodiment of the apparatus.
Figure 3D:
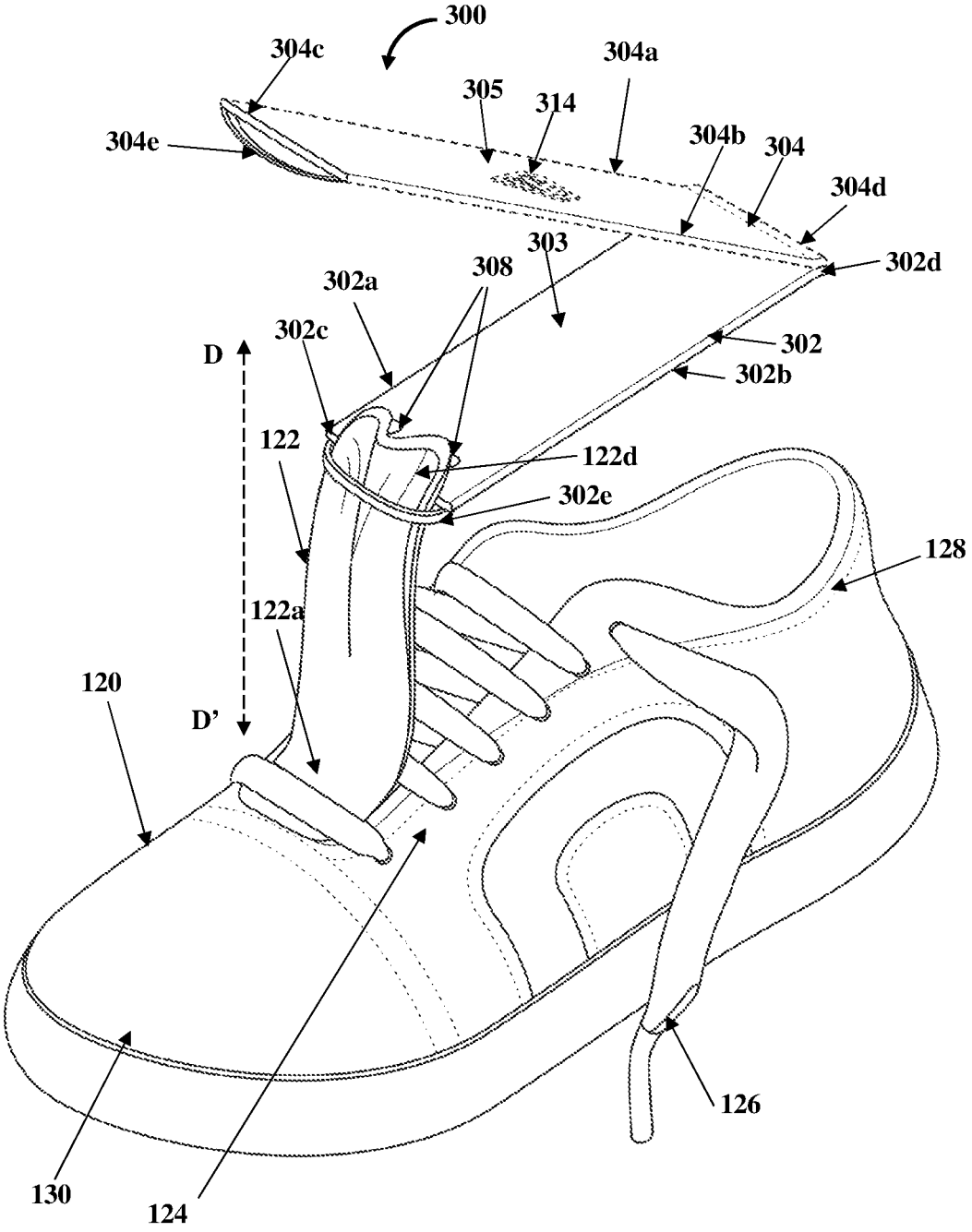
FIG. 3D exemplarily illustrates a front, right-side perspective view of footwear, showing an elastic band of the third embodiment of the apparatus, secured to a distal end of the first panel of the apparatus and encircling one end of a tongue of the footwear.
Figure 3E:
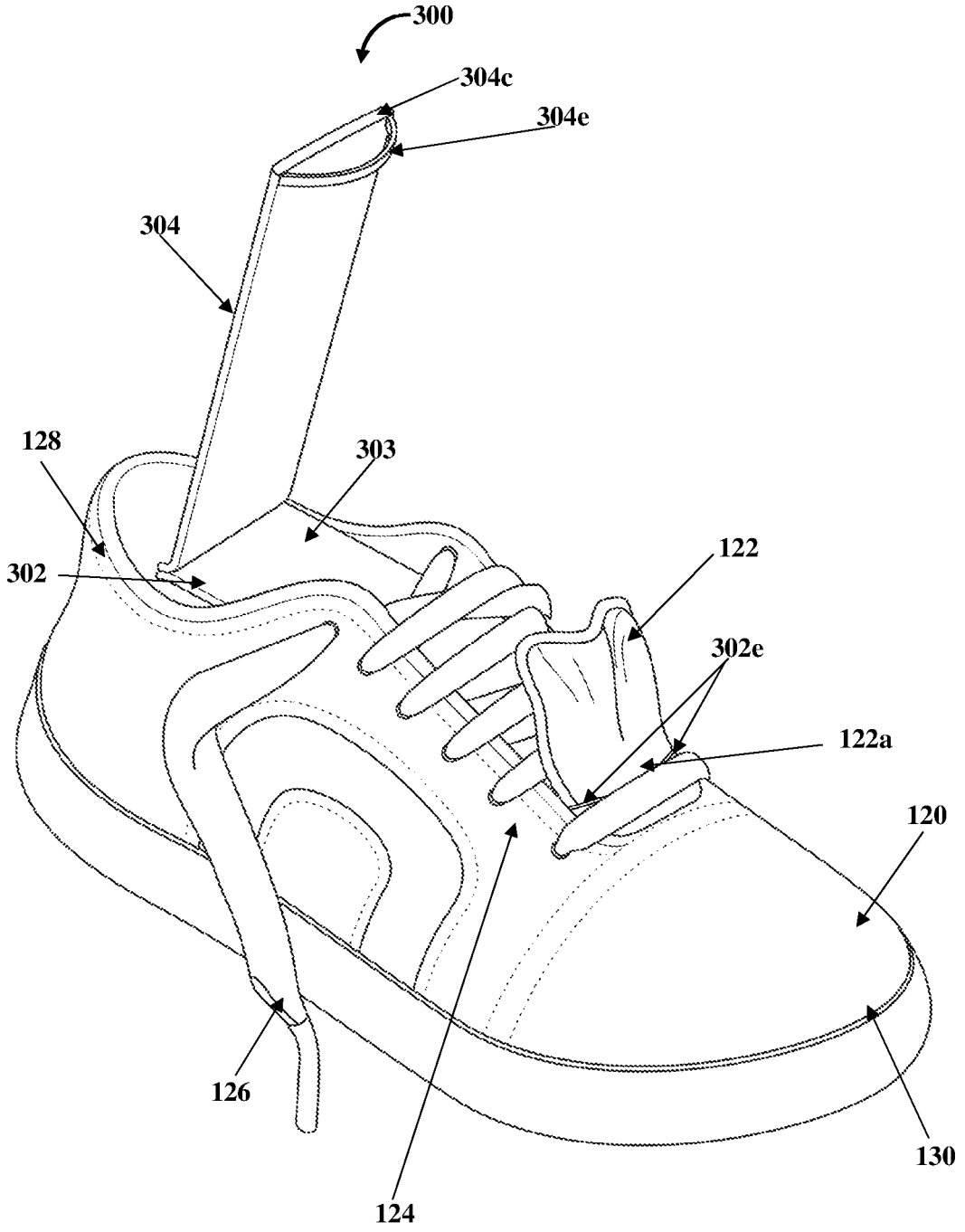
FIG. 3E exemplarily illustrates a front, left-side perspective view of footwear, showing the elastic band at the distal end of the first panel of the third embodiment of the apparatus, encircling a base of the tongue of the footwear, and the first panel disposed below a laced eyestay and a lace of the footwear.
Figure 3F:
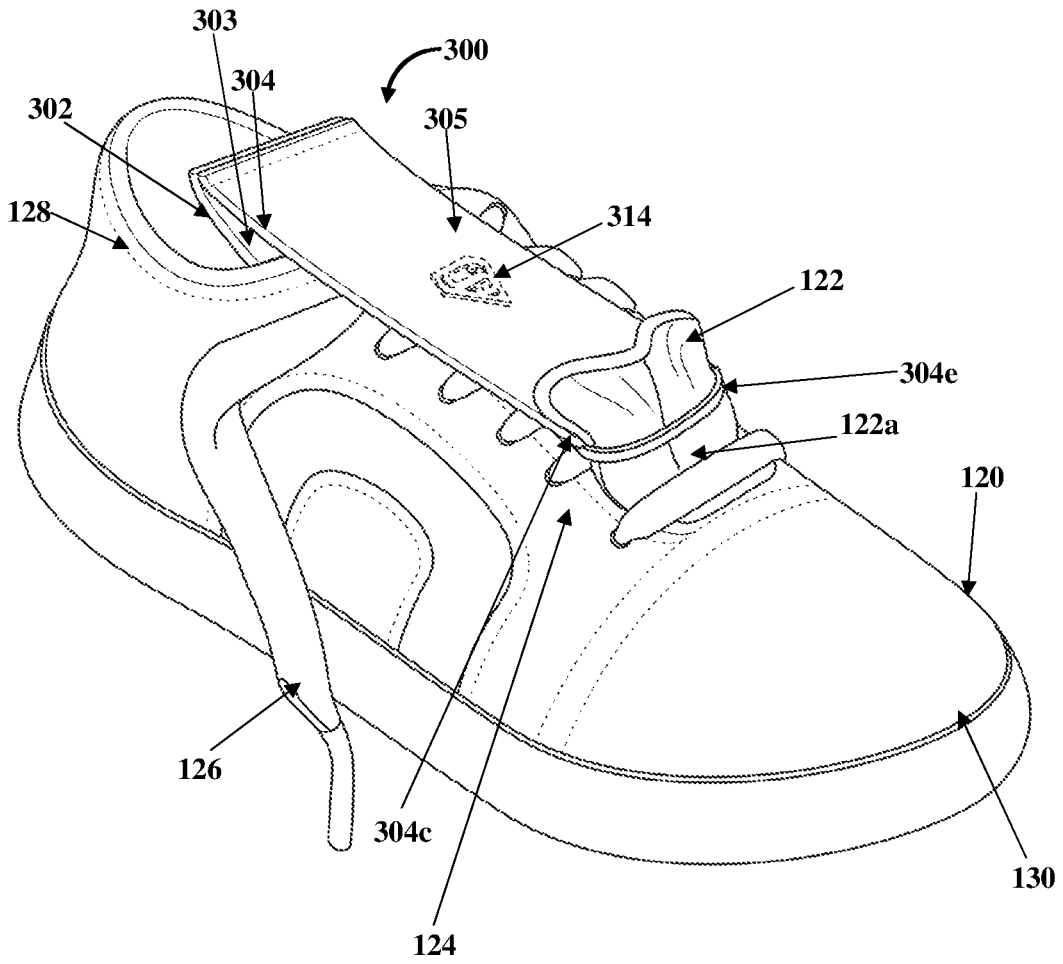
FIG. 3F exemplarily illustrates a front, left-side perspective view of the footwear, showing a second panel of the third embodiment of the apparatus overlapping the first panel, the lace, and the laced eyestay of the footwear, and an elastic band, secured to a distal end of the second panel, encircling the tongue of the footwear.

FIG. 3A exemplarily illustrates a front, left-side perspective view of a third embodiment of the apparatus 300 for securing a tongue 122 of footwear 120 in a fixed position shown in FIGS. 3D-3F. FIG. 3B exemplarily illustrates a top view of the third embodiment of the apparatus 300. In the third embodiment, the apparatus 300 comprises a first panel 302 and a second panel 304. The first panel 302 comprises a first side edge 302*a*, a second side edge 302*b*, a distal end 302*c*, a proximal end 302*d*, and an elastic band 302*e* secured to the first side edge 302*a* and the second side edge 302*b* proximal to the distal end 302*c* of the first panel 302. The second panel 304 comprises a proximal end 304*d* attached to the proximal end 302*d* of the first panel 302. The second panel 304 is, for example, stitched to the first panel 302. FIG. 3C exemplarily illustrates a bottom view of the third embodiment of the apparatus 300. In an embodiment, the apparatus 300 comprises holes 308 in the first panel 302 that are each secured by a grommet 309 as shown in FIG. 3C. In an embodiment, the holes 308 are configured to secure an accessory (not shown). The second panel 304 further comprises a first side edge 304*a*, a second side edge 304*b*, and a distal end 304*c*. The second panel 304 further comprises an elastic band 304*e* secured to the first side edge 304*a* and the second side edge 304*b*, proximal to the distal end 304*c* of the second panel 304.

FIG. 3D exemplarily illustrates a front, right-side perspective view of footwear 120, showing the elastic band 302*e* of the third embodiment of the apparatus 300, secured to a distal end 302*c* of the first panel 302 of the apparatus 300 and encircling one end 122*d* of the tongue 122 of the footwear 120. The elastic band 302*e* of the first panel 302 is adapted to encircle the tongue 122 folded in an upward direction. The first panel 302 is adapted to move along the longitudinal axis D-D' of the tongue 122 shown in FIG. 3D. The elastic band 302*e* of the first panel 302 is adapted to squeeze and bundle the tongue 122 to secure the tongue 122 in the fixed position. FIG. 3E exemplarily illustrates a front, left-side perspective view of footwear 120, showing the elastic band 302*e* at the distal end 302*c* of the first panel 302 of the third embodiment of the apparatus 300, encircling a base 122*a* of the tongue 122 of the footwear 120, and the first panel 302 disposed below a laced eyestay 124 and a lace 126 of the footwear 120. The elastic band 304*e* of the second panel 304 is adapted to encircle the tongue 122. FIG. 3F exemplarily illustrates a front, left-side perspective view of the footwear 120, showing the second panel 304 of the third embodiment of the apparatus 300 overlapping the first panel 302, the lace 126, and the laced eyestay 124 of the footwear 120, and the elastic band 304*e*, secured to the distal end 304*c* of the second panel 304, encircling the tongue 122 of the footwear 120. Although it is not visible in FIG. 3F, the elastic band 302*e*, at the distal end 302*c* of the first panel 302, encircles the base 122*a* of the tongue 122 as shown in FIG. 3E.

The distal end 304*c* of the second panel 304 is adapted to move along the longitudinal axis D-D' of the tongue 122 shown in FIG. 3D, when the elastic band 304*e* of the second panel 304 encircles the tongue 122. The elastic band 304*e* of the second panel 304 is adapted to squeeze and bundle the tongue 122 to secure the tongue 122 in the fixed position. In another embodiment, the second panel 304 is adapted to overlap the first panel 302, the lace 126, and the laced eyestay 124 of the footwear 120 when the second panel 304 is folded over the first panel 302. In the third embodiment exemplarily illustrated in FIG. 3A and FIG. 3B, an accessory 314 is attached to a lower surface 305 of the second panel 304, such that the accessory 314 is displayed when the second panel 304 overlaps the first panel 302 causing the lower surface 305 to be shown on top of the footwear 120 as shown in FIG. 3F. In an embodiment, the accessory 314 is glued to the lower surface 305 of the second panel 304. A shown in FIGS. 3A, 3D and 3E, the apparatus 300 also comprises an upper surface 303.

The third embodiment of the apparatus 300 is useful for accommodating multiple designs and/or indicia on the upper and lower surfaces 303 and 304 of the first and second panels 302 and 304. The user may display the design and/or indicia on either the upper surface 303 of the first panel 302, the lower surface 305 of the first panel 302, the upper surface 303 of the second panel 304, or the lower surface 305 of the second panel 304.

Figure 3G:
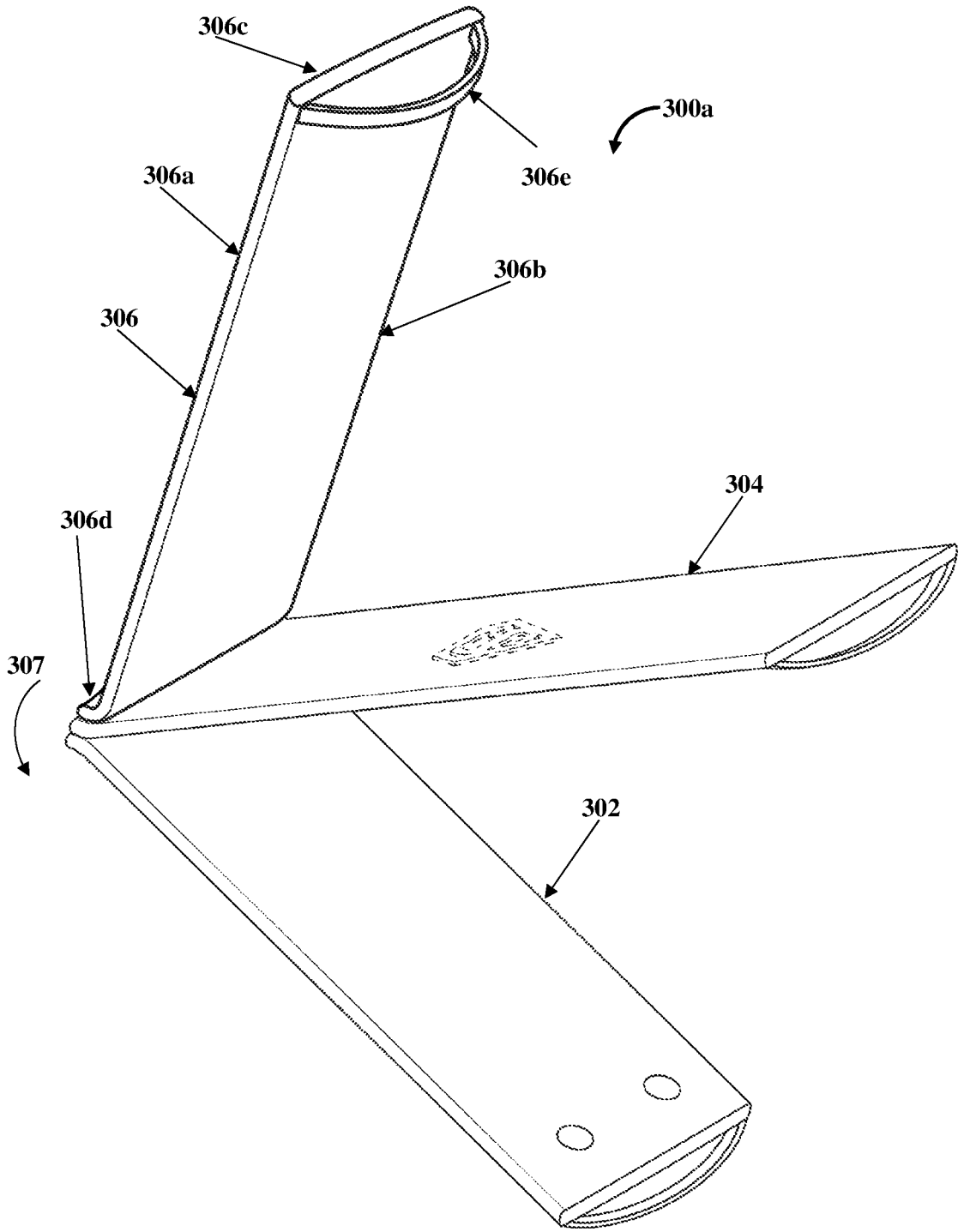
FIG. 3G exemplarily illustrates a front, left-side perspective view of an embodiment of the third embodiment of the apparatus comprising a third panel.

FIG. 3G exemplarily illustrates a front, left-side perspective view of an embodiment of the third embodiment of the apparatus 300 comprising a third panel 306. The apparatus 300*a* shown in FIG. 3G comprises three panels 302, 304, and 306. Similar to the first and second panels, 302 and 304, the third panel 306 of the apparatus 300*a* comprises a first side edge 306*a*, a second side edge 306*b*, a distal end 306*c*, a proximal end 306*d*, and an elastic band 306*e* secured to the first side edge 306*a* and the second side edge 306*b* proximal to the distal end 306*c* of the third panel 306. The proximal end 306*d* of the third panel 306 is, for example, stitched to the distal end 304*c* of the second panel 304, as shown in FIG. 3G. The second and third panels 304 and 306 comprise multiple designs and/or indicia and the wearer may choose to display the second panel 304 by flipping the third panel 306 underneath the first panel 302 in a direction indicated by arrow 307. If the wearer intends to display the third panel 306, then the wearer may flip the third panel 306 over the second panel 304 in a direction opposite to the direction indicated by arrow 307. The user may secure the third panel 306 to the tongue 122 using the elastic band 306*e*.

Figure 4A:
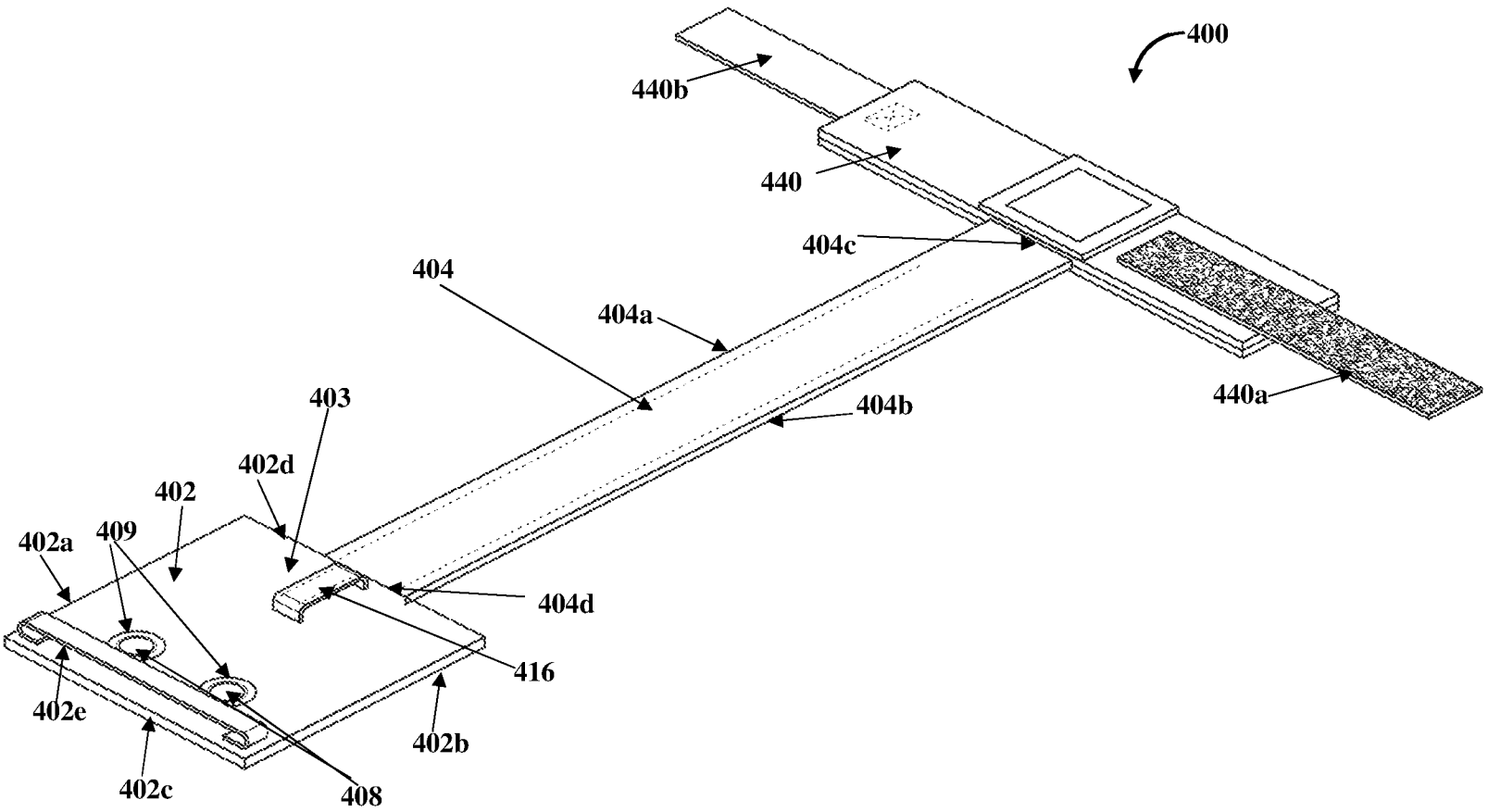
FIG. 4A exemplarily illustrates a front, right-side perspective view of a fourth embodiment of the apparatus for securing a tongue of footwear in a fixed position.
Figure 4B:
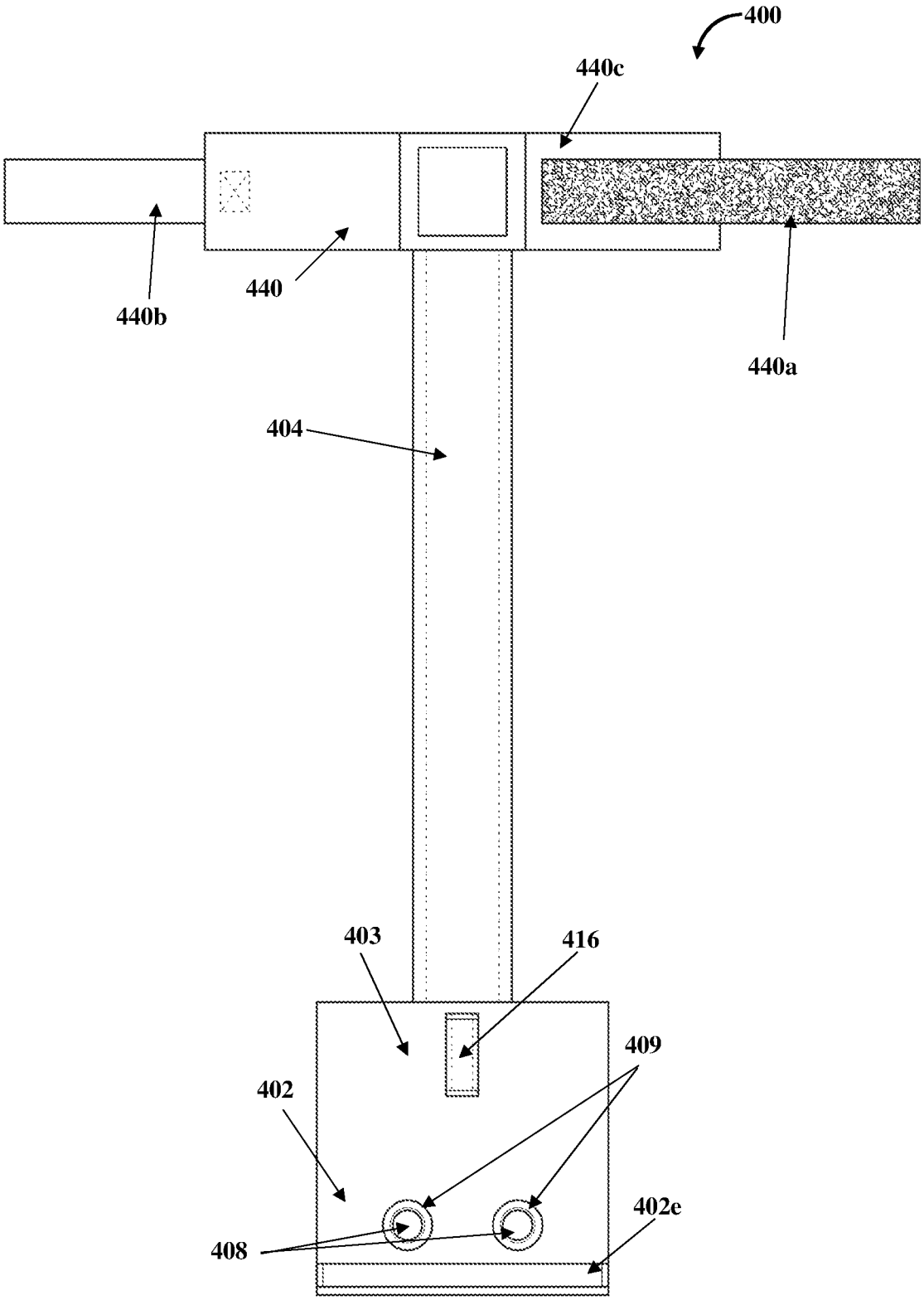
FIG. 4B exemplarily illustrates a top view of the fourth embodiment of the apparatus.
Figure 4C:
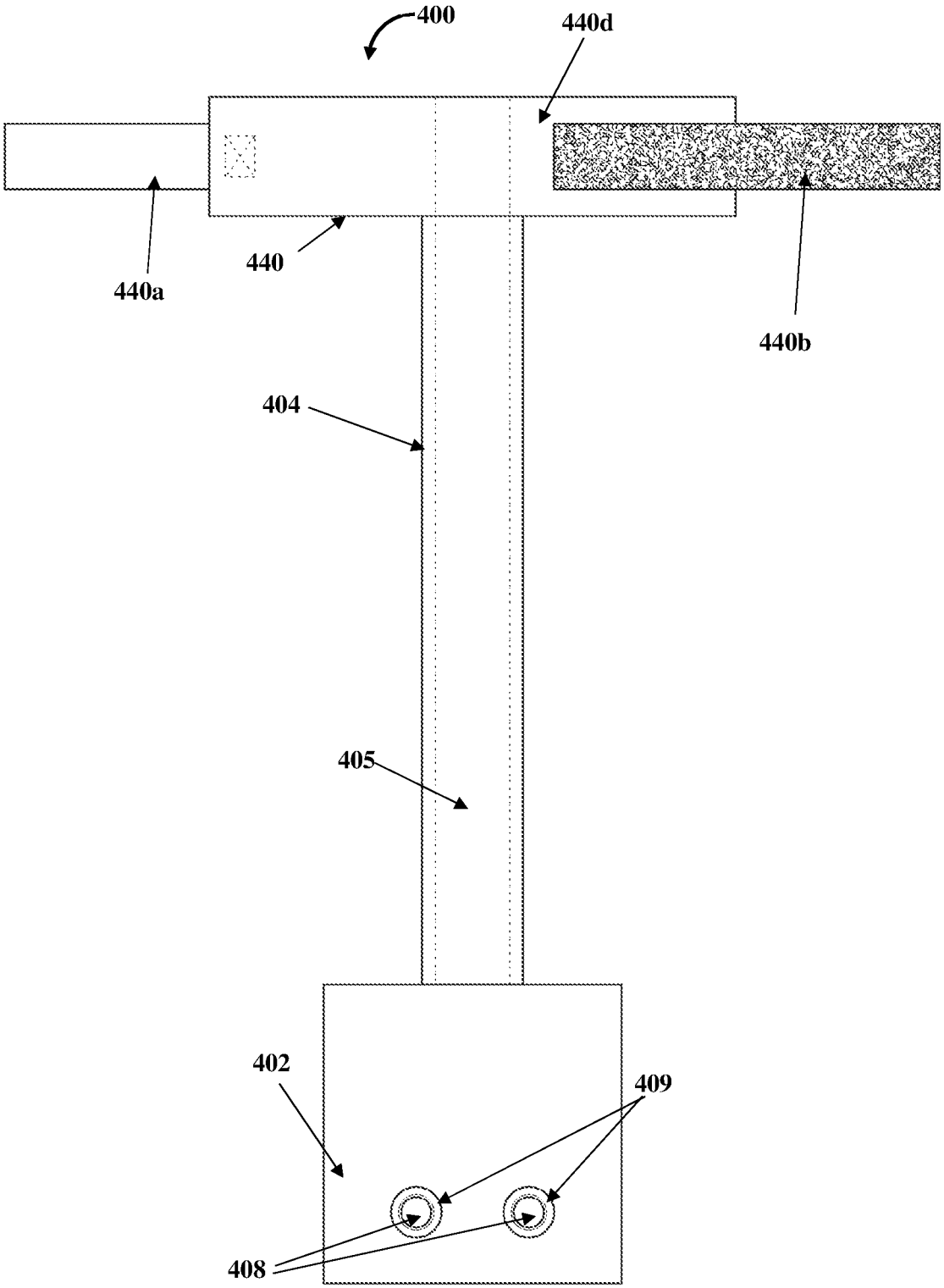
FIG. 4C exemplarily illustrates a bottom view of the fourth embodiment of the apparatus.
Figure 4D:
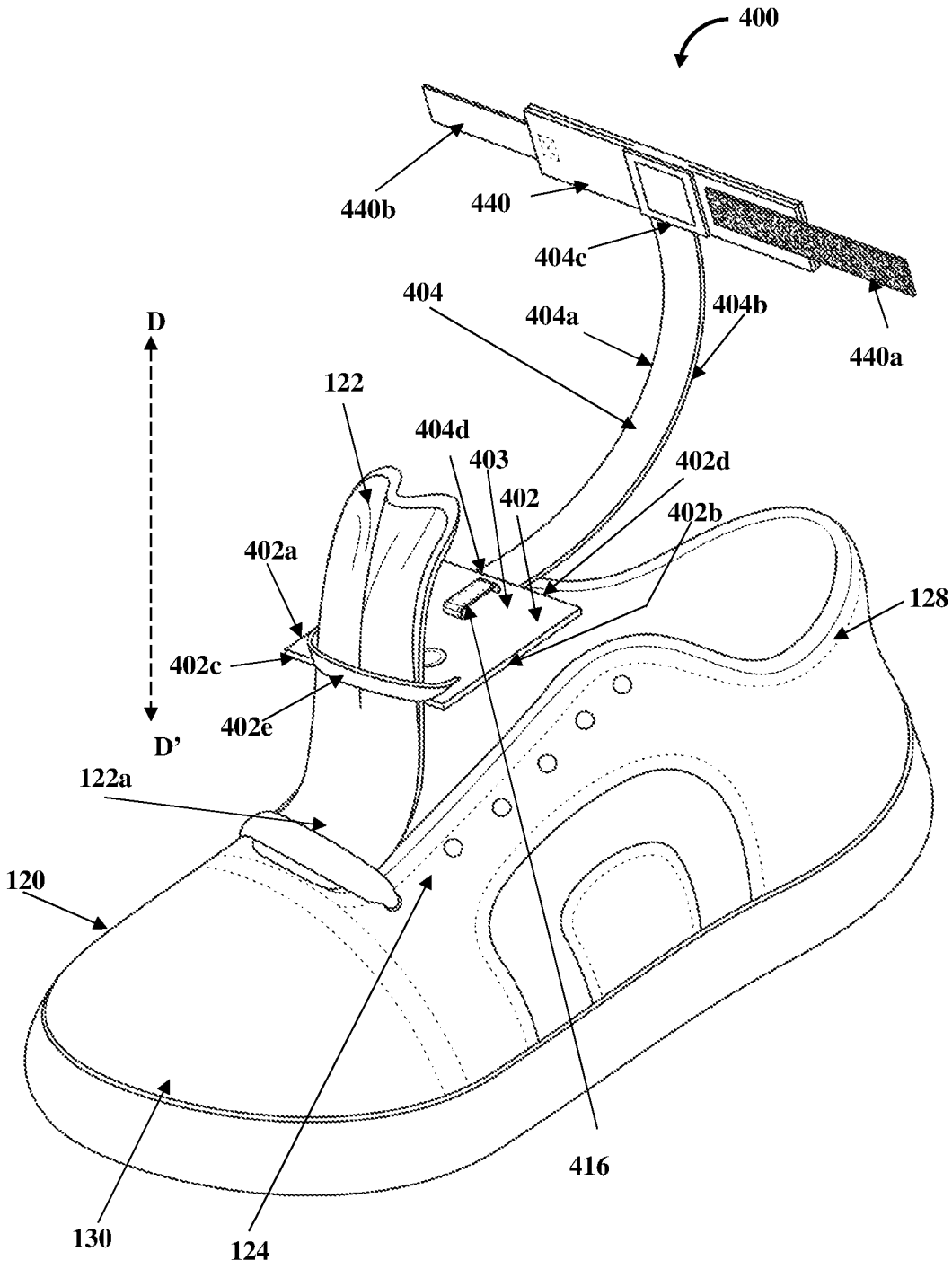
FIG. 4D exemplarily illustrates a front, right-side perspective view of footwear, showing an elastic band of the fourth embodiment of the apparatus, secured to a distal end of the first panel and encircling one end of a tongue of the footwear.
Figure 4E:
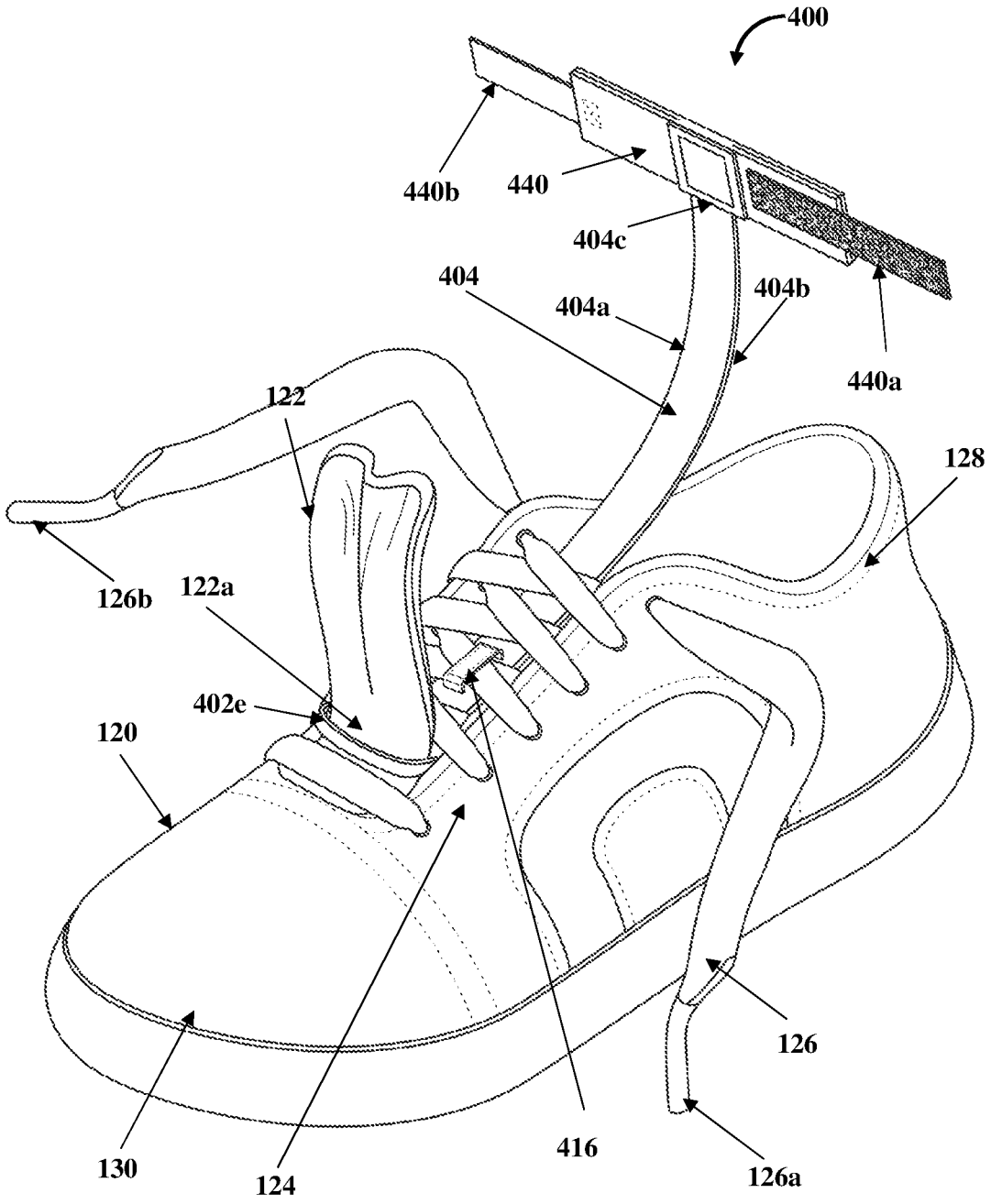
FIG. 4E exemplarily illustrates a front, right-side perspective view of the footwear, showing the elastic band of the fourth embodiment of the apparatus, secured to the distal end of the first panel, encircling a base of the tongue, and the first panel and a partial length of a second panel disposed below a laced eyestay and a lace of the footwear.
Figure 4F:
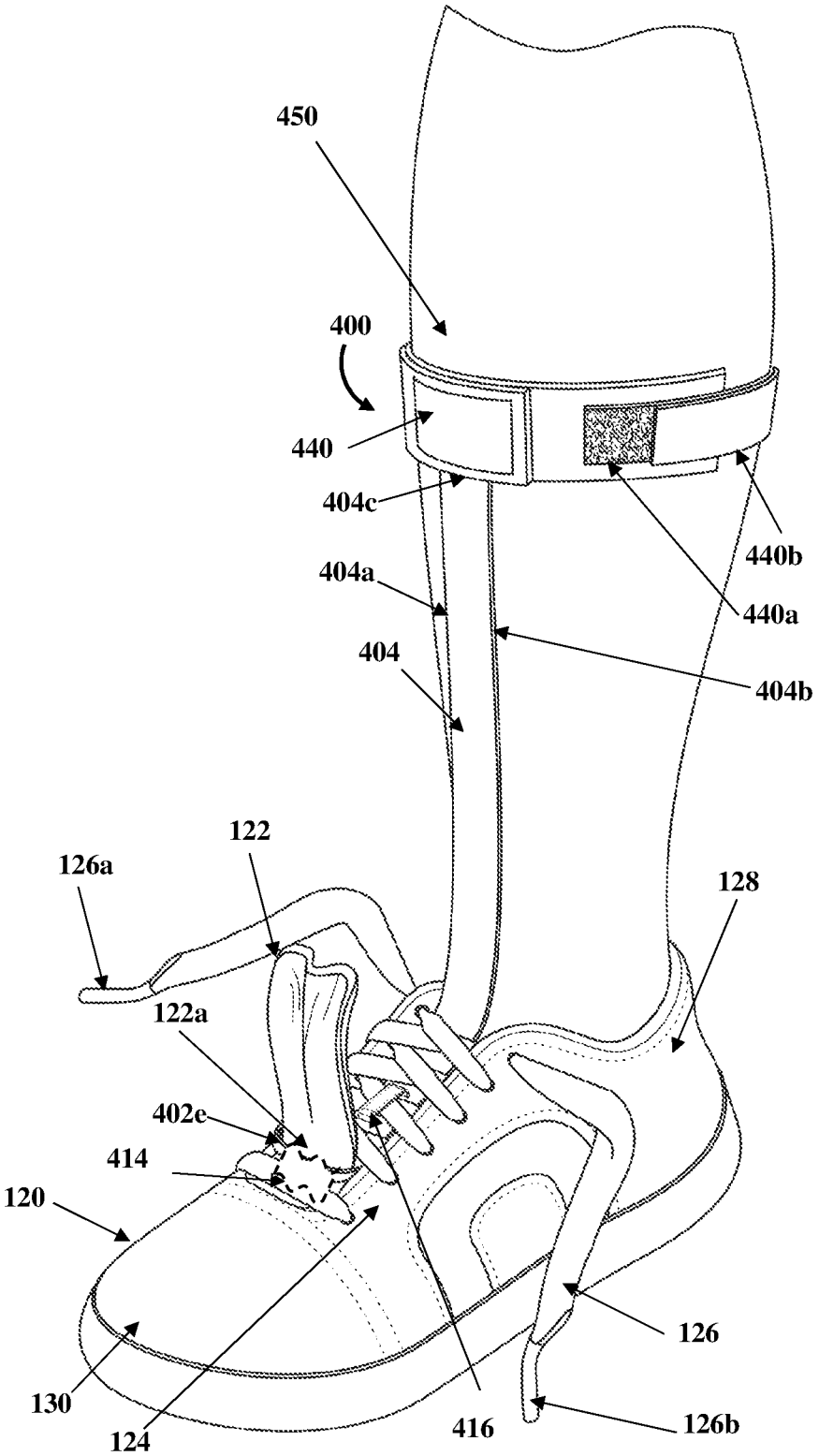
FIG. 4F exemplarily illustrates a front, right-side perspective view of the footwear, showing a strap, at a distal end of the second panel of the fourth embodiment of the apparatus, secured around a shin of a user of the footwear.

FIG. 4A exemplarily illustrates a front, right-side perspective view of a fourth embodiment of the apparatus 400 for securing a tongue 122 of footwear 120 in a fixed position shown in FIGS. 4D-4F. In the fourth embodiment, the apparatus 400 comprises a first panel 402 and a second panel 404. The first panel 402 comprises a distal end 402*c*, a first side edge 402*a*, a second side edge 402*b*, a proximal end 402*d*, and an elastic band 402*e* secured to the first side edge 402*a* and the second side edge 402*b* proximal to the distal end 402*c* of the first panel 402. The elastic band 402*e* is adapted to encircle the tongue 122 folded in an upward direction. The first panel 402 is adapted to move along the longitudinal axis D-D' of the tongue 122 shown in FIG. 4D. The elastic band 402*e* is adapted to squeeze and bundle the tongue 122 to secure the tongue 122 in the fixed position. The second panel 404 comprises a proximal end 404*d* attached to the proximal end 402*d* of the first panel 402. The second panel 404 further comprises a distal end 404*c*, a first side edge 404*a*, and a second side edge 404*b*. The first panel 402 of the apparatus 400 is adapted to be disposed below the laced eyestay 124 of the footwear 120 as shown in FIG. 4E.

In an embodiment, the first panel 402 comprises multiple holes, for example, two holes 408, disposed proximal to the distal end 402*c* of the first panel 402. Each of the holes 408 is reinforced by a grommet 409 as shown in FIG. 4A, FIG. 4B, and FIG. 4C. In an embodiment, the holes 408 are used to secure the apparatus 400 to the footwear 120 and more specifically to the laced eyestay 124 of the footwear 120. During the process of lacing the eyestay 124 of the footwear 120 the wearer may place the holes 408 adjacent to a desired pair of eyelets 124*a* that are located towards the bottom end of the eyestay 124 and lace the holes 408 and the pair of eyelets 124*a* to secure the first panel 402 of the apparatus 400 to the laced eyestay 124 of the footwear 120. In an embodiment, the apparatus 400 also comprises a loop 416 located on an upper surface 403 of the first panel 402, proximal to the proximal end 402*d*, as shown in FIGS. 4A and 4B. The loop 416 is used to secure the first panel 402 of apparatus 400 to the footwear 120 using the lace 126. As shown in FIGS. 4A and 4B, the loop 416 opens towards the first and second side edges 402*a* and 402*b*. As shown in FIGS. 4E and 4F, an end 126*b* of the lace 126 inserted into the loop 416 from the first side edge 402*a* exits the loop 416 at the second side edge 402*b*. Likewise, another end 126*a* of the lace 126 inserted into the loop 416 from the second side edge 402*b* exits the loop 416 at the first side edge 402*a*.

As illustrated in FIG. 4A, the first panel is 402 is wider then the second panel 404. In an embodiment, width of the first panel 402 is more than twice the width of the second panel 404. In another embodiment, width of the first panel 402 is about thrice the width of the second panel 406. As shown in FIG. 4A, length of the first panel 402 is less than the length of the second panel 406. In an embodiment, the length of the second panel 404 is about thrice the length of the first panel 402. In an embodiment, the first panel 402 has a square shape. The first and second panels 402 and 404 have a thickness of about 1 mm to about 10 mm.

FIG. 4B exemplarily illustrates a top view of the fourth embodiment of the apparatus 400. FIG. 4C exemplarily illustrates a bottom view of the fourth embodiment of the apparatus 400. As exemplarily illustrated in FIGS. 4A-4F, the second panel 404 further comprises a strap 440 secured to the distal end 404*c* of the second panel 404. The strap 440 is adapted to be secured around either an ankle or a shin 450 of a user, for example, a wearer, of the footwear 120 as shown in FIG. 4F. A lower surface 405 of the second panel 404 shown in FIG. 4C lies flush against the user's shin 450 as exemplarily illustrated in FIG. 4F. As shown in FIG. 4B and FIG. 4C, the strap 440 is perpendicular to a length of the second panel 404. The strap 440 has a length of, for example, about 5 inches to about 20 inches. In an embodiment, the strap 440 comprises a hook component 440*a* on one end of the strap 440, and a loop component 440*b* on an opposite end of the strap 440. The hook component 440*a* is attached to an upper surface 440*c* of the strap 440 as shown in FIG. 4B, and the loop component 440*b* is attached to a lower surface 440*d* of the strap 440 as shown in FIG. 4C. The strap 440 may also accommodate other types of fasteners apart from the hook and loop components 440*a* and 440*b*. Examples of other types of fasteners that may be used to fasten ends of the strap 440 with each other comprise a side squeeze buckle, a snap-fit clip, etc.

FIG. 4D exemplarily illustrates a front, right-side perspective view of footwear 120, showing the elastic band 402*e* of the fourth embodiment of the apparatus 400, secured to the distal end 402*c* the first panel 402 and encircling one end 122*d* of a tongue 122 of the footwear 120. FIG. 4E exemplarily illustrates a front, right-side perspective view of the footwear 120, showing the elastic band 402*e* of the fourth embodiment of the apparatus 400, secured to the distal end 402*c* the first panel 402, encircling a base 122*a* of the tongue 122, and the first panel 402 and a partial length of the second panel 404 disposed below a laced eyestay 124 and a lace 126 of the footwear 120. FIG. 4F exemplarily illustrates a front, right-side perspective view of the footwear 120, showing the strap 440, at the distal end 404*c* of the second panel 404 of the fourth embodiment of the apparatus 400, secured around a shin 450 of a user, for example, a wearer, of the footwear 120.

In the fourth embodiment of the apparatus 400, the second panel 404 is of a greater length compared to other embodiments of the apparatus 400. Therefore, the fourth embodiment of the apparatus 400 provides a greater area for accommodating accessories, and displaying designs and/or insignia over the second panel 404. Furthermore, the strap 440, at the distal end 404*c* of the second panel 404 also has a width that is approximately equal to the width of the second panel 404. The strap 440 also enable a wearer to attach accessories to the second panel 404, and display designs and/or insignia over the second panel 404.

In an embodiment, the elastic band 402*e*, at the distal end 402*c* of the first panel 402 comprises an accessory 414, for example, a design attached to an outer perimeter of the elastic band 402*e*, as illustrated in FIG. 4F. The accessory 414 may be attached to a mid-section of the elastic band 402*e* for enabling the wearer to display the accessory 414 when the elastic band 402*e* of the first panel 402 encircles the tongue 122.

Figure 5A:
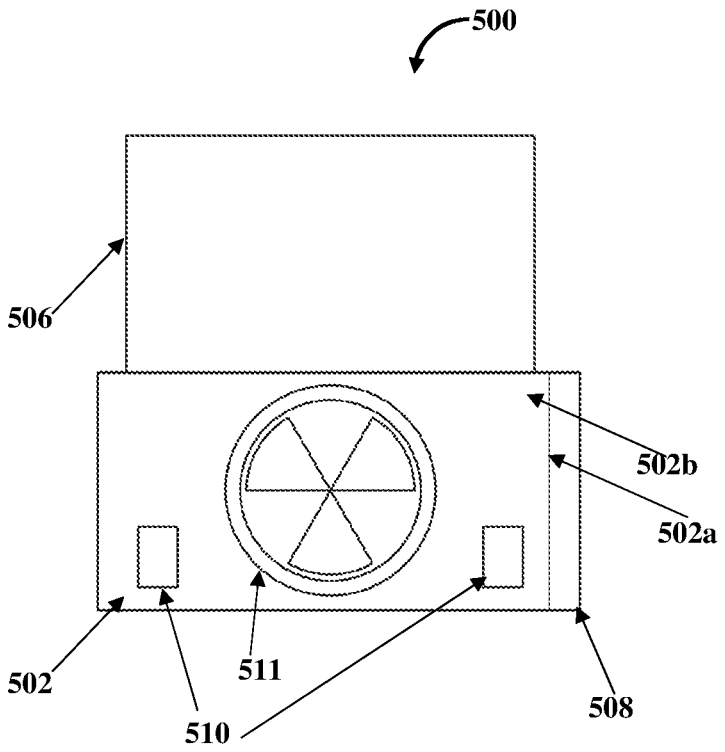
FIG. 5A exemplarily illustrates a front view of a fifth embodiment of the apparatus for securing a tongue of a footwear in a fixed position.
Figure 5B:
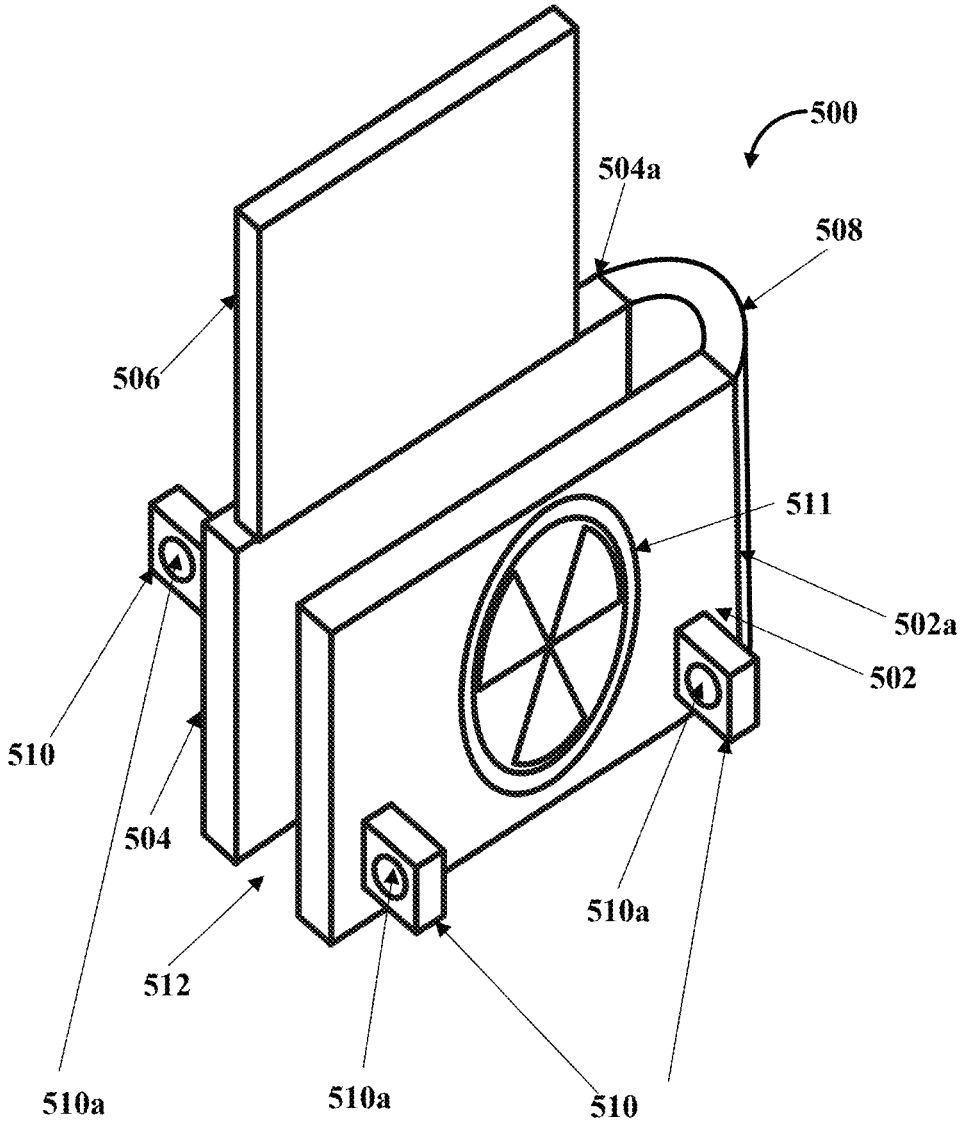
FIG. 5B exemplarily illustrates a front, left-side perspective view of the fifth embodiment of the apparatus.
Figure 5C:
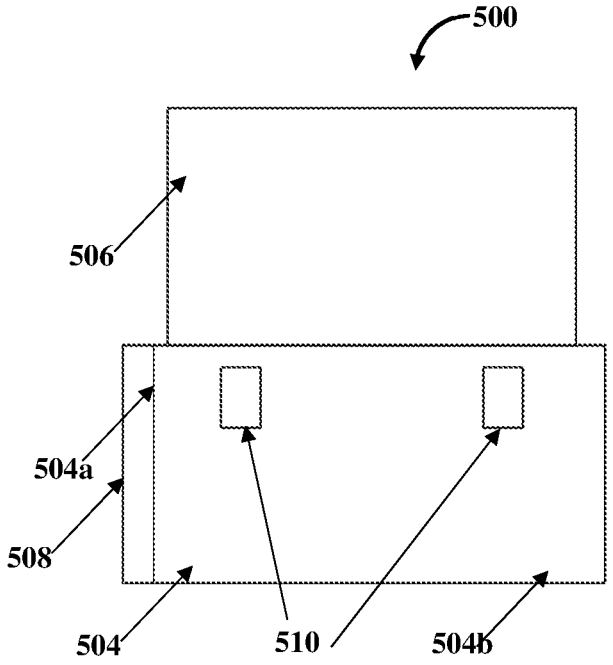
FIG. 5C exemplarily illustrates a rear elevation view of the fifth embodiment of the apparatus.
Figure 5D:
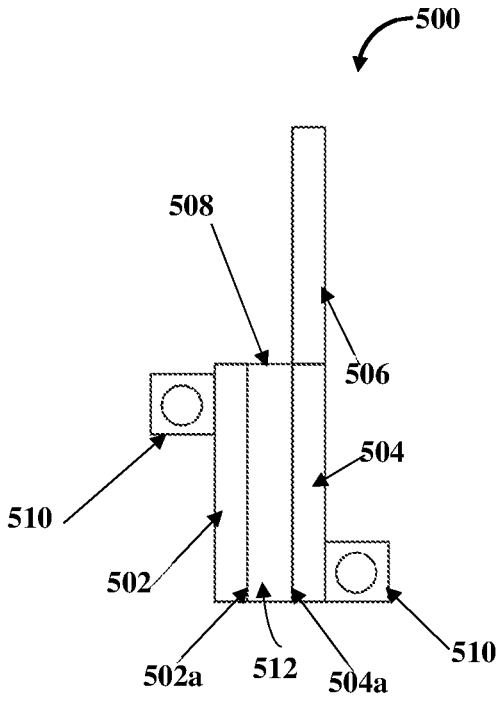
FIG. 5D exemplarily illustrates a left-side elevation view of the fifth embodiment of the apparatus.
Figure 5E:
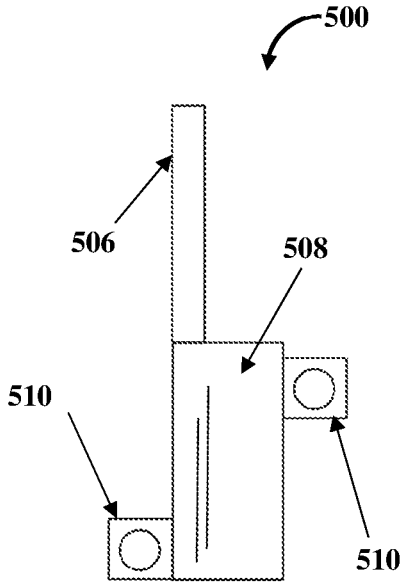
FIG. 5E exemplarily illustrates a right-side elevation view of the fifth embodiment of the apparatus.
Figure 5F:
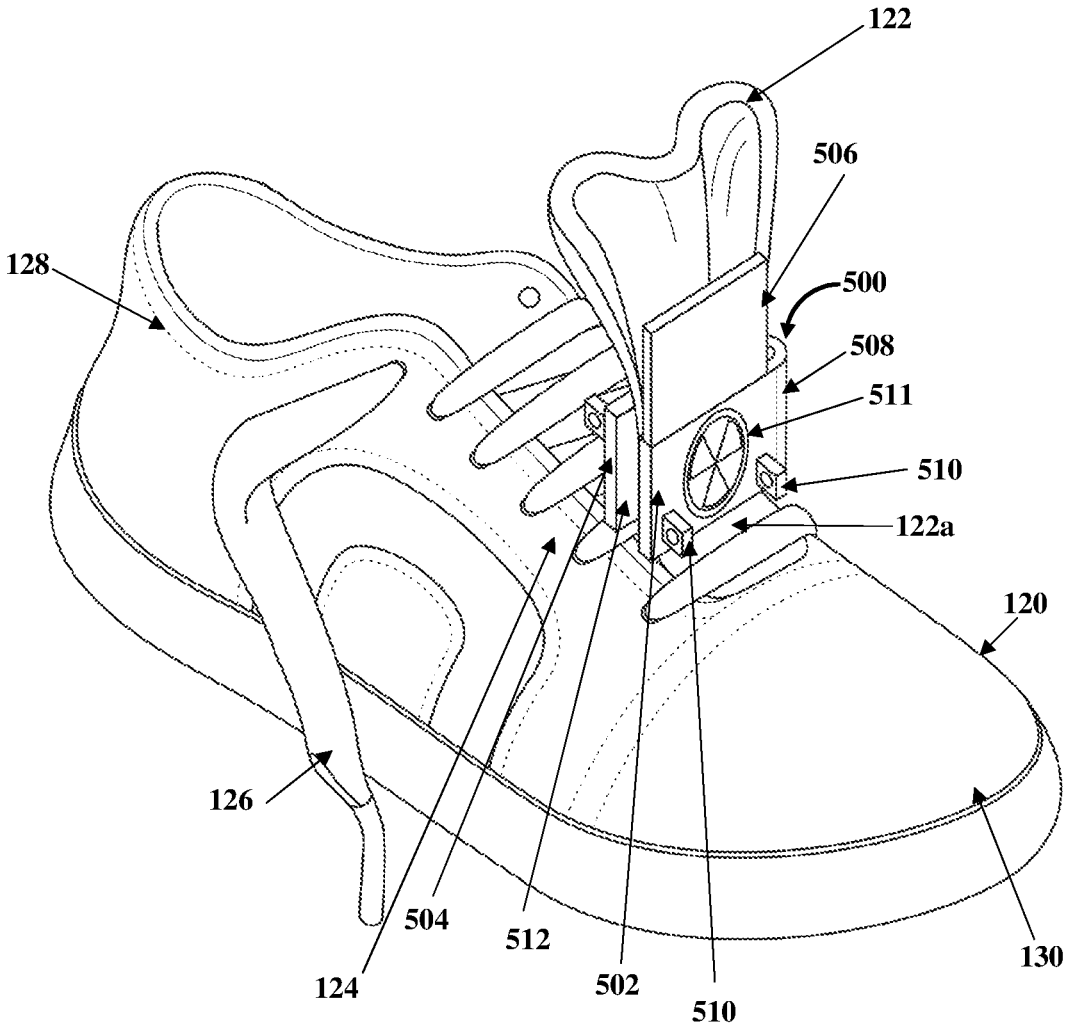
FIG. 5F exemplarily illustrates a front, left-side perspective view of footwear, showing the fifth embodiment of the apparatus attached to a base of a tongue of the footwear to secure the tongue in a fixed position.

FIG. 5A exemplarily illustrates a front view of a fifth embodiment of the apparatus 500 for securing a tongue 122 of a footwear 120 in a fixed position shown in FIG. 5F. FIG. 5B exemplarily illustrates a front, left-side perspective view of the fifth embodiment of the apparatus 500. FIG. 5C exemplarily illustrates a rear elevation view of the fifth embodiment of the apparatus 500. In the fifth embodiment, the apparatus 500 comprises a first panel 502 and a second panel 504. The second panel 504 is aligned substantially parallel to the first panel 502. FIG. 5D exemplarily illustrates a left-side elevation view of the fifth embodiment of the apparatus 500. The apparatus 500 further comprises a connecting member 508 connecting the first panel 502 to the second panel 504. In an embodiment, the first panel 502 is spaced apart from the second panel 504. The first panel 502 and the second panel 504 define a space 512 therebetween for securing the tongue 122 folded in an upward direction. The apparatus 500 is adapted to secure the tongue 122 in the space 512 between the first panel 502 and the second panel 504. FIG. 5E exemplarily illustrates a right-side elevation view of the fifth embodiment of the apparatus 500. FIG. 5F exemplarily illustrates a front, left-side perspective view of footwear 120, showing the fifth embodiment of the apparatus 500 attached to a base 122*a* of the tongue 122 of the footwear 120 to secure the tongue 122 in a fixed position. The apparatus 500 is adapted to secure the tongue 122 of the footwear 120 in the fixed position when the apparatus 500 is attached to the base 122*a* of the tongue 122. The connecting member 508 connects a side edge 502*a* of the first panel 502 to a side edge 504*a* of the second panel 504. In an embodiment, the connecting member 508 is a U-shaped connecting member 508 extending between and along the side edges 502*a* and 504*a* of the first panel 502 and the second panel 504, respectively. As shown in FIGS. 5A-5F, the second panel 504 comprises a vertical extension board 506 adapted to prevent the tongue 122 from bending towards the toe tip 130 of the footwear 120. In an embodiment, the vertical extension board 506 is used to attach accessories. In an embodiment, one or more accessories, designs and/or insignia are attached to and displayed on the apparatus 500. For example, an accessory 511 is attached to and displayed on the first panel 502 of the apparatus 500 as shown in FIGS. 5A-5B and FIG. 5F. In an embodiment, the tongue 122 is partially rolled or bundled to form a crimp before sliding the tongue 122 into the space 512 between the first panel 502 and the second panel 504.

As shown in FIGS. 5A and 5C, the apparatus 500 comprises brackets 510 attached perpendicular to an outer surface 502*b* and 504*b* of both the first panel 502 and the second panel 504. The brackets 510 comprise holes 510*a* configured to receive plain protrusions, threaded protrusions, etc., of an accessory, for allowing attachment of the accessory to the first and second panels 502 and 504. In another embodiment, the holes 510*a* are used to secure the apparatus 500 to the laced eyestay 124 using the lace 126 of the footwear 120.

Figure 5G:
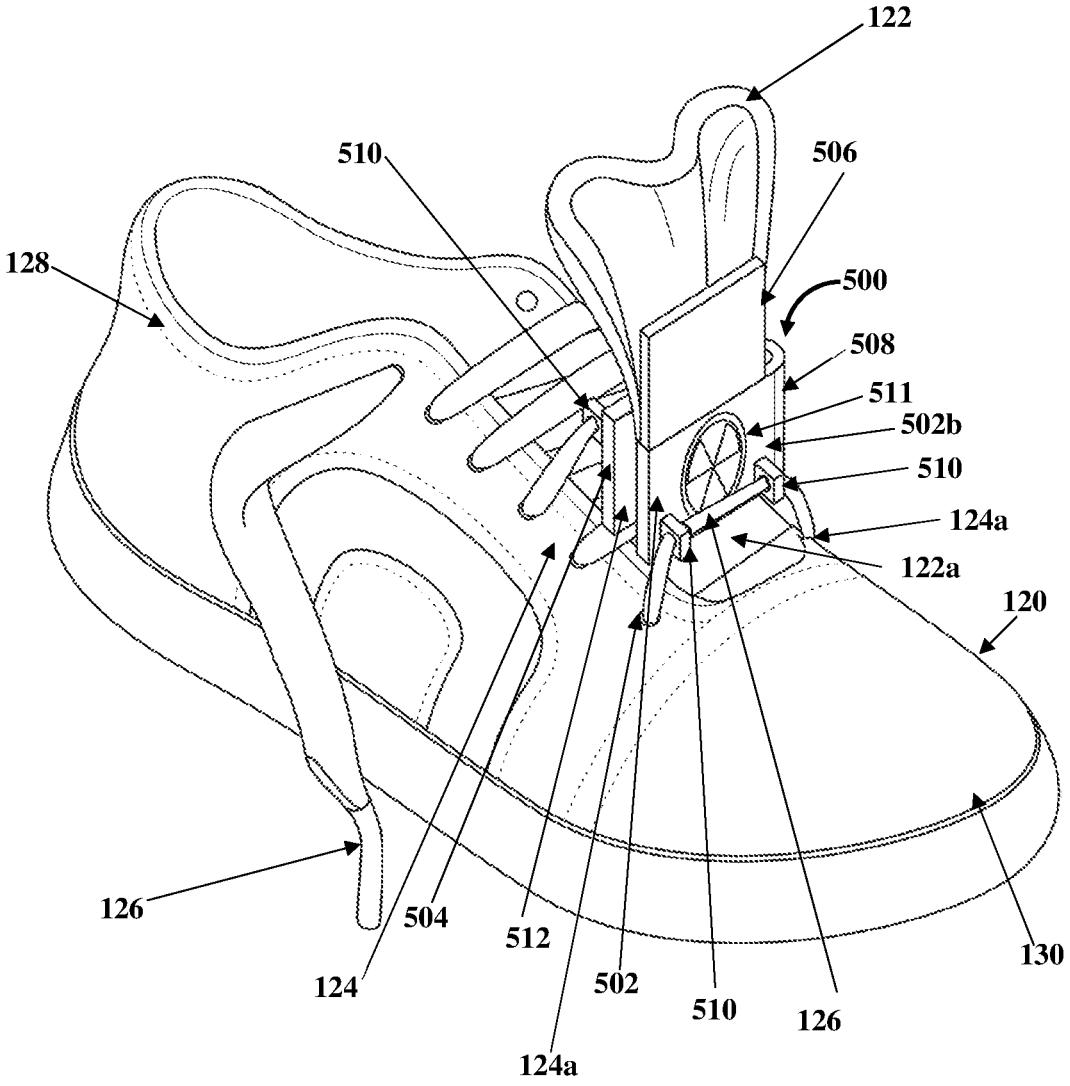
FIG. 5G exemplarily illustrates a front, left-side perspective view of footwear, showing the fifth embodiment of the apparatus secured to the footwear using the lace.

FIG. 5G exemplarily illustrates a front, left-side perspective view of footwear 120, showing the fifth embodiment of the apparatus 500 secured to the footwear 120 using the lace 126. As illustrated in FIG. 5G, the lace 126 is inserted through the holes 510*a* in the brackets 510 at the time of lacing the eyestay 124 of the footwear 120. The apparatus 500 is placed on top of a pair of eyelets 124*a* that are adjacent to each other. One end of the lace 126 is then passed through an adjacent pair of holes 510*a* on the outer surface 502*b* of the first panel 502. After the lace 126 has laced the subsequent pair of eyelets 124*a* below the apparatus 500, the lace 126 is then used to lace the pair of holes 510*a* on the outer surface 504*b* of the second panel 504 and the pair of eyelets 124*a* proximal to the pair of holes 510*a* on the outer surface 504*b* of the second panel 504.

Figure 5H:
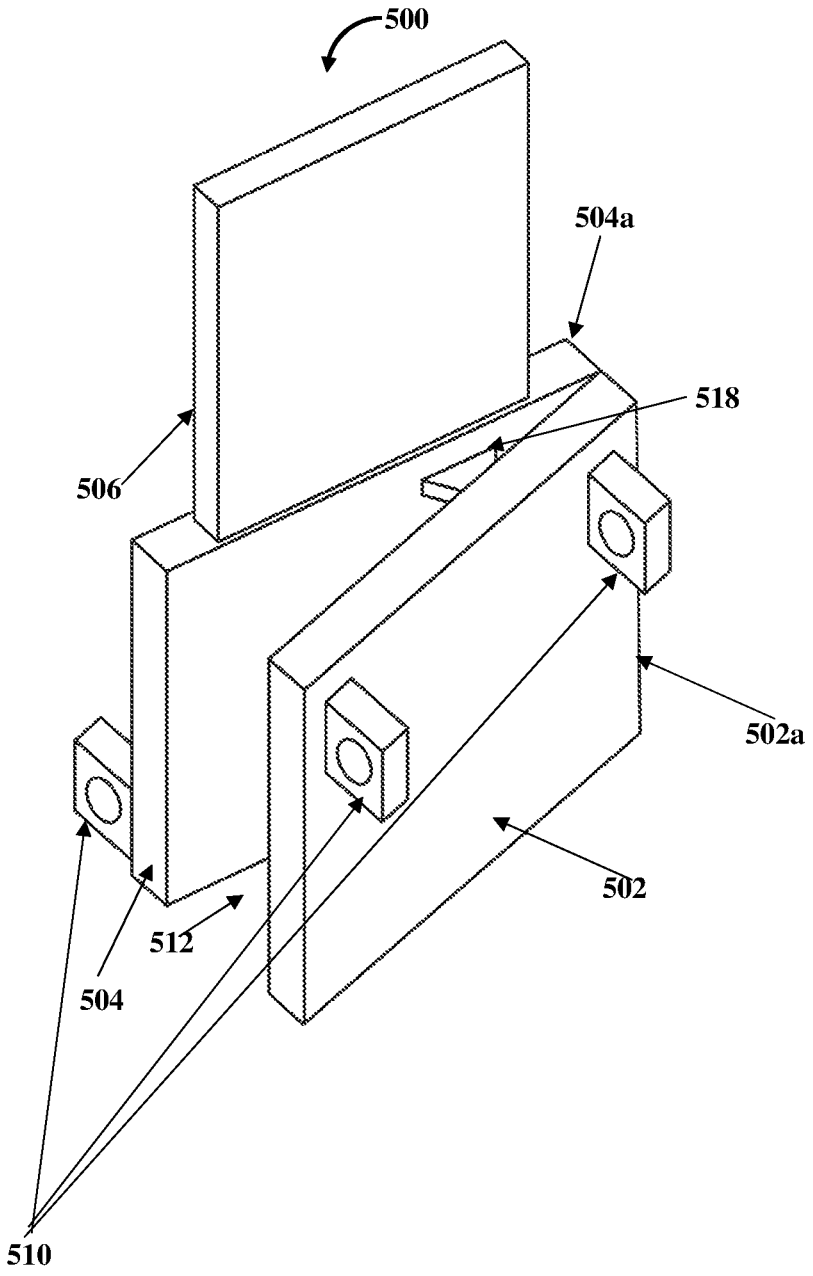
FIG. 5H exemplarily illustrates a perspective view of an alternative implementation of the fifth embodiment of the apparatus for securing a tongue of a footwear in a fixed position.
Figure 5I:
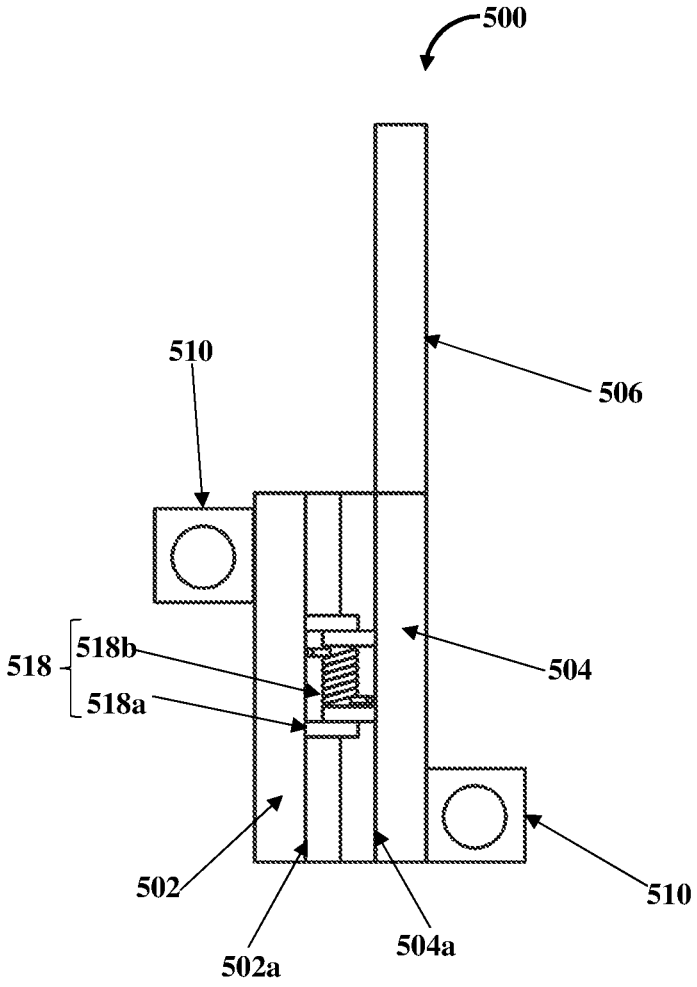
FIG. 5I exemplarily illustrates a side elevation view of the alternative implementation of the fifth embodiment of the apparatus shown in FIG. 5H.
Figure 5J:
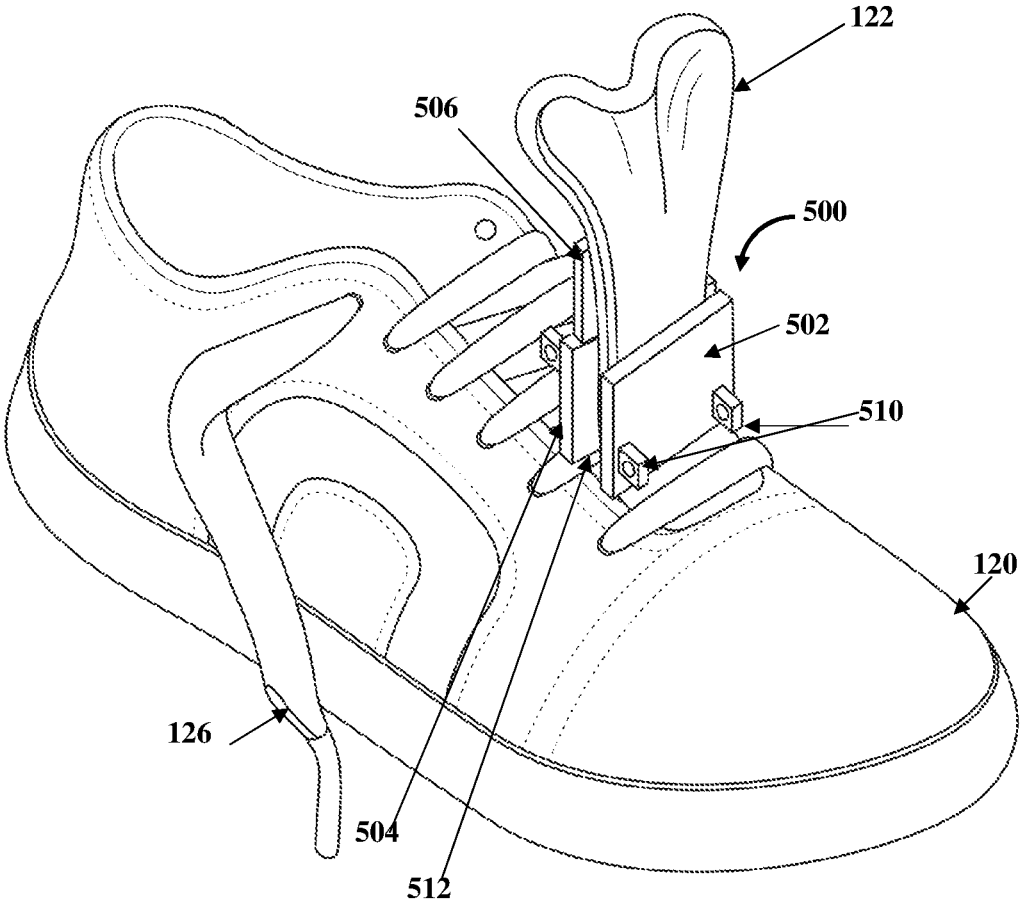
FIG. 5J exemplarily illustrates a front, left-side perspective view of footwear, showing the alternative implementation of the fifth embodiment of the apparatus attached to a base of a tongue of the footwear to secure the tongue in a fixed position.

FIGS. 5H-5I exemplarily illustrate a perspective view and a side elevation view of an alternative implementation of the fifth embodiment of the apparatus 500, respectively, for securing a tongue 122 of footwear 120 in a fixed position shown in FIG. 5I. In the alternative implementation, the apparatus 500 comprises an alternate connecting member 518. The connecting member 518 comprises a hinge 518*a* that connects the first panel 502 and the second panel 504, and a spring 518*b*. The apparatus 500 shown in FIGS. 5H-5I is similar in functionality to a bulldog clip or a letter clip. The first panel 502 and the second panel 504 correspond to two flat steel strips that combine to form handles and jaws of the clip with the spring 518*b* in the middle of the first panel 502 and the second panel 504. FIG. 5J exemplarily illustrates a front, left-side perspective view of footwear, showing the alternative implementation of the fifth embodiment of the apparatus 500 attached to the base 122*a* of the tongue 122 of the footwear 120 to secure the tongue 120 in a fixed position. A user, for example, a wearer of the footwear 120, presses the side edge 502*a* of the first panel 502 and the second side edge 504*a* of the second panel 504 together, causing the first panel 502 and the second panel 504 to space apart from each other against the force of the spring 518*b*. The user then inserts the tongue 122 in the space 512 between the first panel 502 and the second panel 504 and releases the first panel 502 and the second panel 504. The spring 518*b* forces the first panel 502 and the second panel 504 together, to grip the tongue 122 firmly.

In all embodiments of the apparatus 100-500 disclosed herein, the length and width of the apparatus 100-500 is variable based on the type and size of the footwear 120. For example, children's footwear 120 requires less of the body length than an adult's footwear 120 as the tongue 122 is smaller. The width and length of the first panel (102, 202, 302, 402, and 502) and the second panel (104, 204, 304, 404, and 504) are also variable depending upon the size and type of the footwear 120. For example, one foot may be narrow in which case the footwear 120 will have a tongue 122 that has a smaller width to accommodate the narrower foot. In this instance, the widths of the first panel (102, 202, 302, 402, and 502) and the second panel (104, 204, 304, 404, and 504) are narrower to correspond to the narrower tongue 122. In another example, such as for flat feet, the tongue 122 will be required to have a larger width to accommodate the larger foot. In that instance then, the widths of the first panel (102, 202, 302, 402, and 502) and the second panel (104, 204, 304, 404, and 504) are likewise larger to accommodate the larger tongue 122.

The embodiments of the apparatus 100-500 disclosed herein are adaptable to any type of tongue 122 for any type of footwear 120. Such footwear 120 comprises athletic shoes, tennis shoes, basketball shoes, football shoes, hockey shoes, training shoes, cross-country shoes, skating shoes, sailing shoes, tap shoes, ski boots, snow boarding boots, hiking boots, climbing shoes, children's shoes, and baby shoes.

The embodiments of the apparatus 100 and 300-500 are made of a flexible type material that can expand and contract to receive a tongue 122 of footwear 120. The embodiments of the apparatus 100 and 300-500 have sufficient tensile strength to withstand the elements and repeated use with footwear 120. In an embodiment, the embodiments of the apparatus 100 and 300-500 are made of a stretchable material, for example, spandex. In another embodiment, the embodiments of the apparatus 200 is made of an elastic material, for example, polyurethane, medium density foam, hard density foam, vulcanized rubber, etc.

The embodiments of the apparatus 100-400 disclosed herein also prevent water, dirt and debris from entering the footwear 120 through the laced eyelet 124 of the footwear 120. Since the first panels 102, 202, 302, and 402 and the second panels 104, 204, 304, and 404 of the embodiments of the apparatus 100-400 disclosed herein cover a portion of the foot and/or sock underneath the laced eyelet 124, the apparatus 100-400 prevents water, dirt and debris from entering the footwear 120 through the laced eyelet 124 of the footwear 120.

Figure 6A:
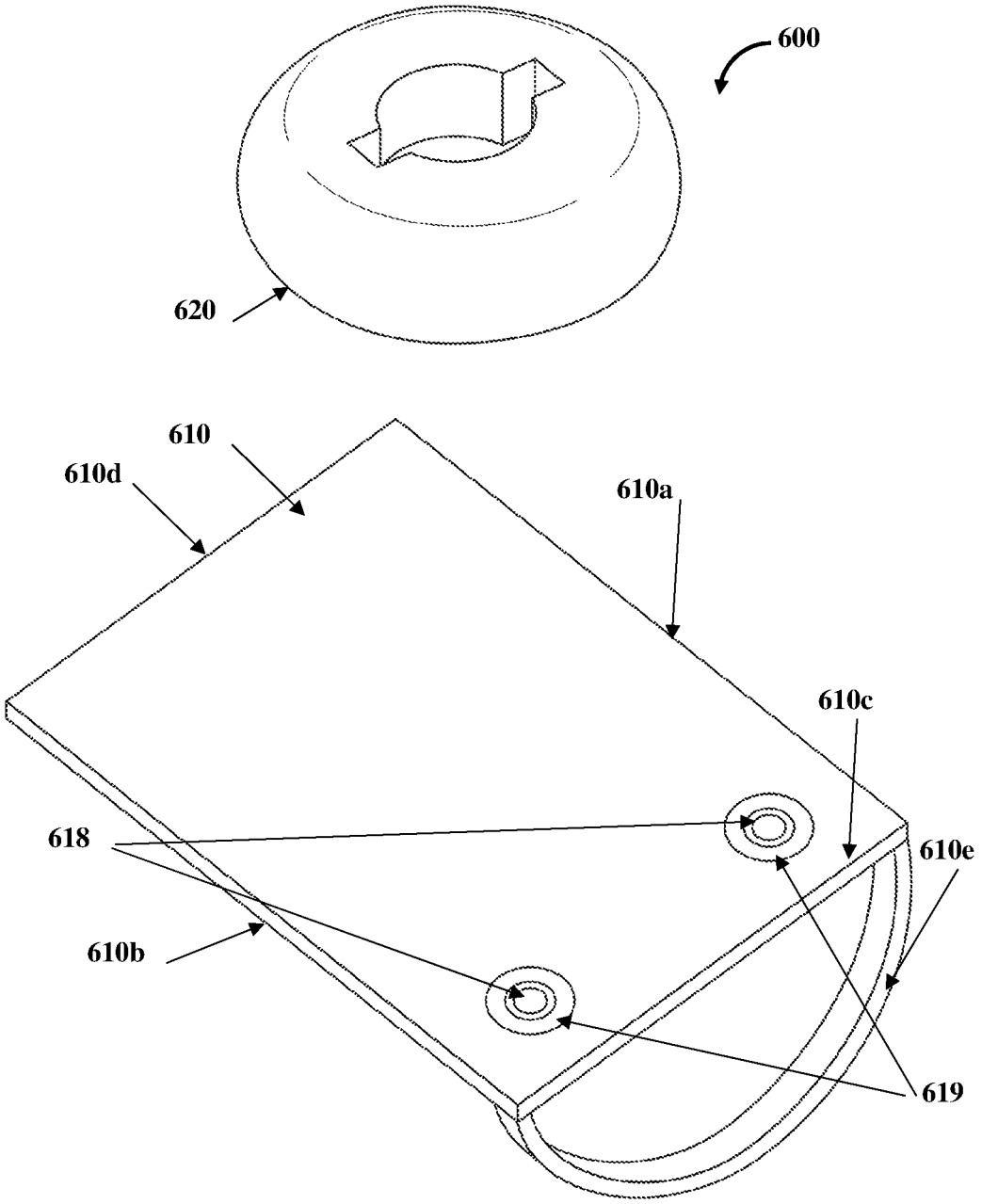
FIG. 6A exemplarily illustrates a front, left-side perspective view of a sixth embodiment of the apparatus for securing a tongue of a footwear in a fixed position.

FIG. 6A exemplarily illustrates a front, left-side perspective view of a sixth embodiment of the apparatus 600 for securing a tongue 122 of a footwear 120 in a fixed position. As illustrated n FIGS. 6A, the apparatus comprises a first component 610 and a second component 620. The first component 610 is a panel comprising a first side edge 610*a*, a second side edge 610*b*, a distal end 610*c*, a proximal end 610*d*, and an elastic band 610*e* secured to the first side edge 610*a* and the second side edge 610*b* proximal to the distal end 610*c* of the panel 610. In an embodiment, the apparatus 600 comprises holes 618 in the panel 610 that are each secured by a grommet 619. In an embodiment, the holes 618 are configured to secure an accessory (not shown).

Figure 6B:
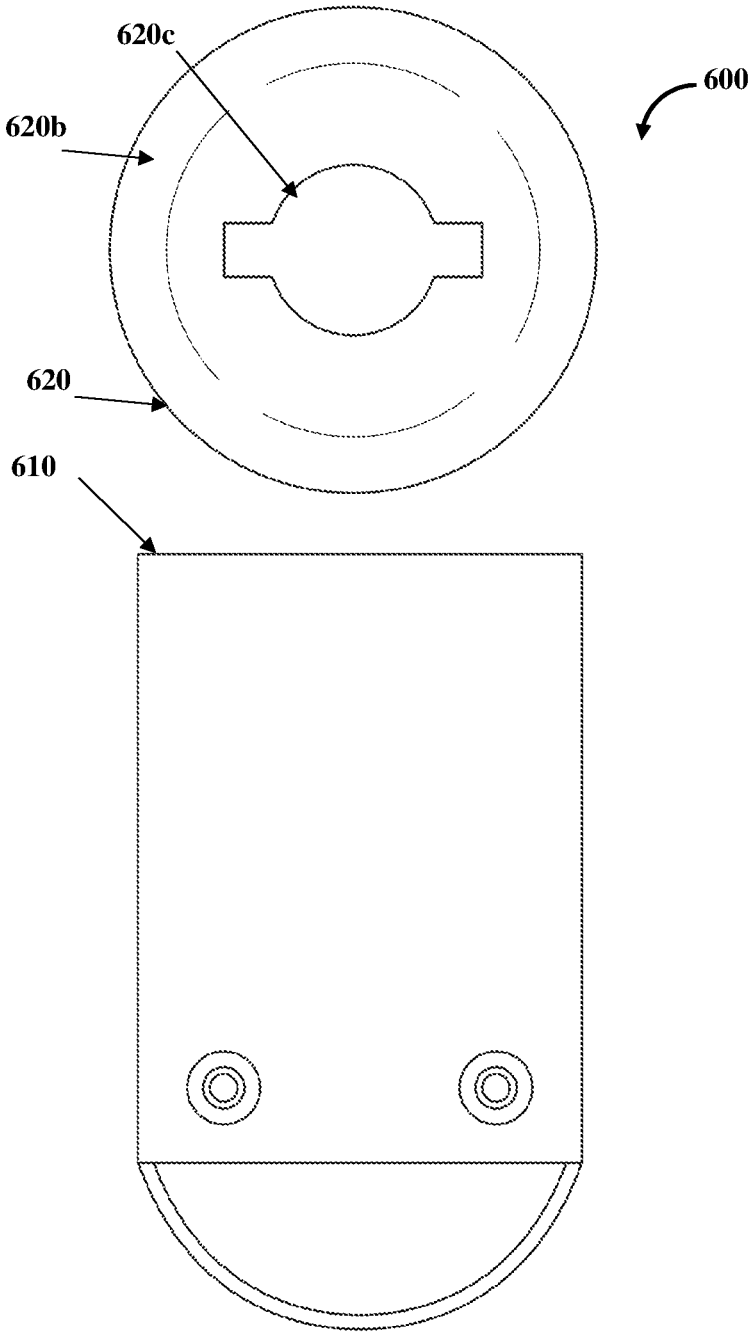
FIG. 6B exemplarily illustrates a top view of the sixth embodiment of the apparatus.
Figure 6C:
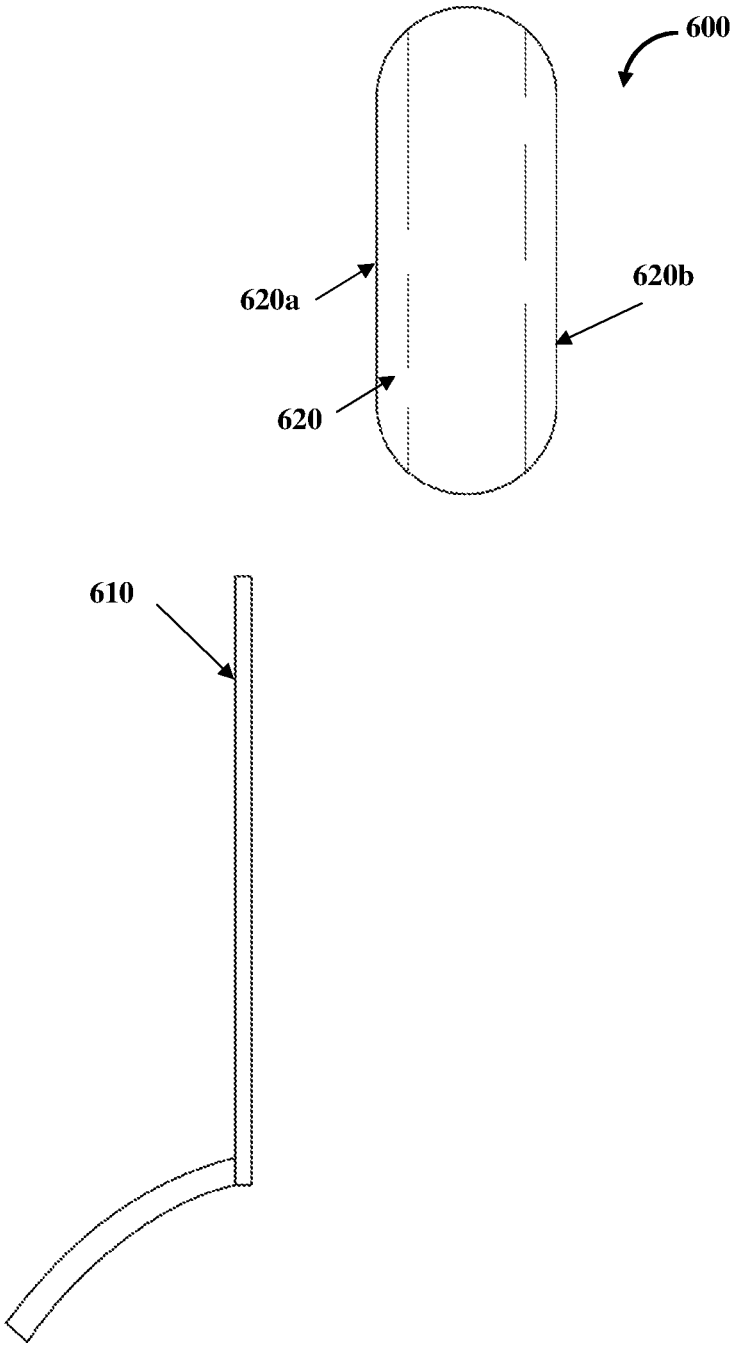
FIG. 6C exemplarily illustrates a left-side view of the sixth embodiment of the apparatus.
Figure 6D:
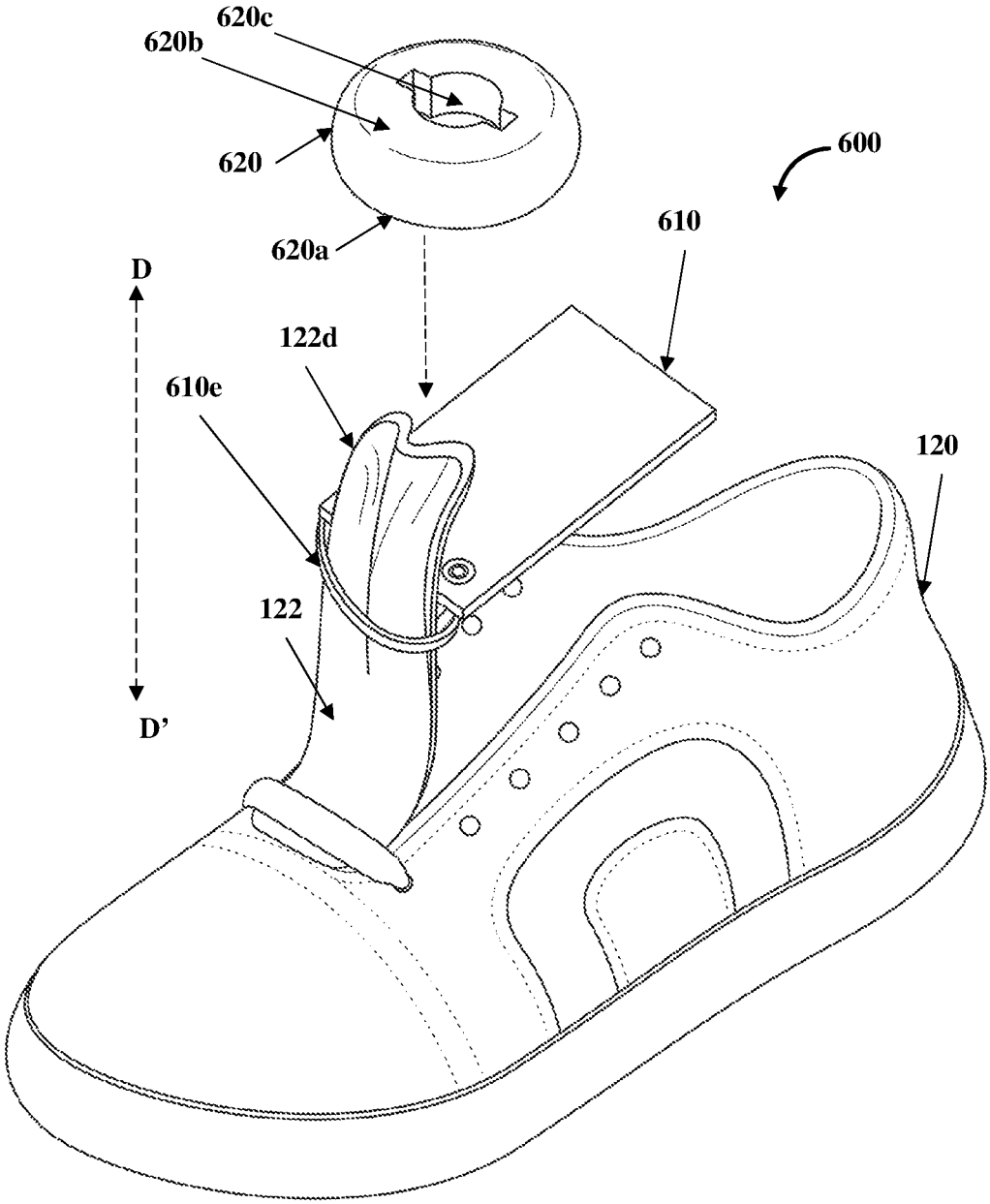
FIG. 6D exemplarily illustrates a front, right-side perspective view of the sixth embodiment of the apparatus, wherein a panel of the apparatus is affixed to a tongue of the footwear.

FIG. 6B exemplarily illustrates a top view of the sixth embodiment of the apparatus 600. FIG. 6C exemplarily illustrates a left-side view of the sixth embodiment of the apparatus 600. As shown in FIG. 6C, the second component comprises a lower surface 620*a*, an upper surface 620*b*, and a through hole 620*c* between the lower and upper surfaces 620*a* and 620*b*. FIG. 6D exemplarily illustrates a front, right-side perspective view of the sixth embodiment of the apparatus 600, wherein the panel 610 of the apparatus 600 is affixed to the tongue 122 of the footwear 120. The elastic band 610*e* of the sixth embodiment of the apparatus 600 encircles one end 122*d* of the tongue 122 of the footwear 120. The elastic band 610*e* of the panel 610 is adapted to encircle the tongue 122 folded in an upward direction. The panel 610 is adapted to move along the longitudinal axis D-D' of the tongue 122 shown in FIG. 6D. The elastic band 610*e* of the panel 610 is adapted to squeeze and bundle the tongue 122 to secure the tongue 122 in the fixed position.

Figure 6E:
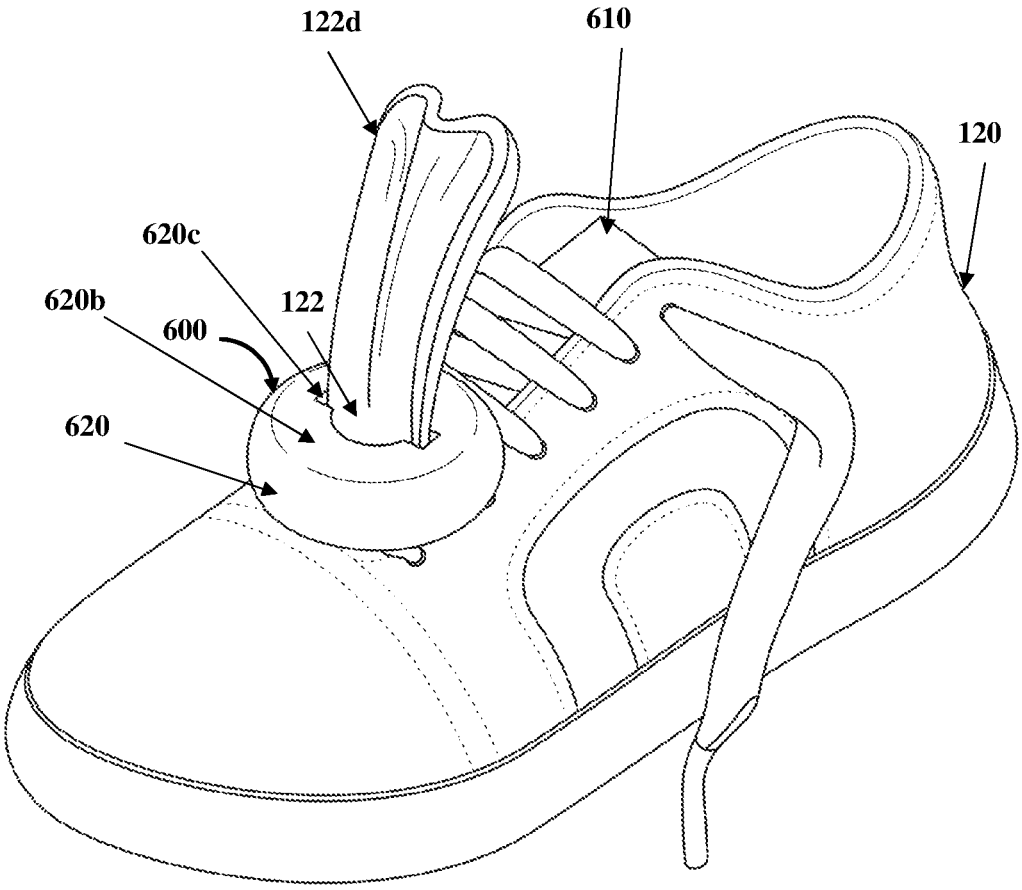
FIG. 6E exemplarily illustrates a front, right-side perspective view of the sixth embodiment of the apparatus, wherein a first component of the apparatus is secured to the tongue of the footwear underneath a laced eyestay and a lace of the footwear, and a second component is secured to the tongue of the footwear above the first component.

FIG. 6E exemplarily illustrates a front, right-side perspective view of the sixth embodiment of the apparatus 600, wherein the first component 610 of the apparatus 600 is secured to the tongue 122 of the footwear 120 underneath the laced eyestay 124 and the lace 126 of the footwear 120, and the second component 620 is secured to the tongue 122 of the footwear 120 above the first component 610. As illustrated in FIGS. 6A-6E, the second component 620 is shaped like a donut and the through hole 620*c* is adapted to receive the one end 122*d* of the tongue 122 of the footwear 120 through the lower surface 620*a*. The second component 620 may be designed to in several shapes and sizes, for example, in the shape of an animal's head, cupcake, etc. However, to receive the one end 122*d* of the tongue 122 of the footwear 120 through the lower surface 620*a*, each instance of the second component comprises a through hole 620*c*.

Figure 7A:
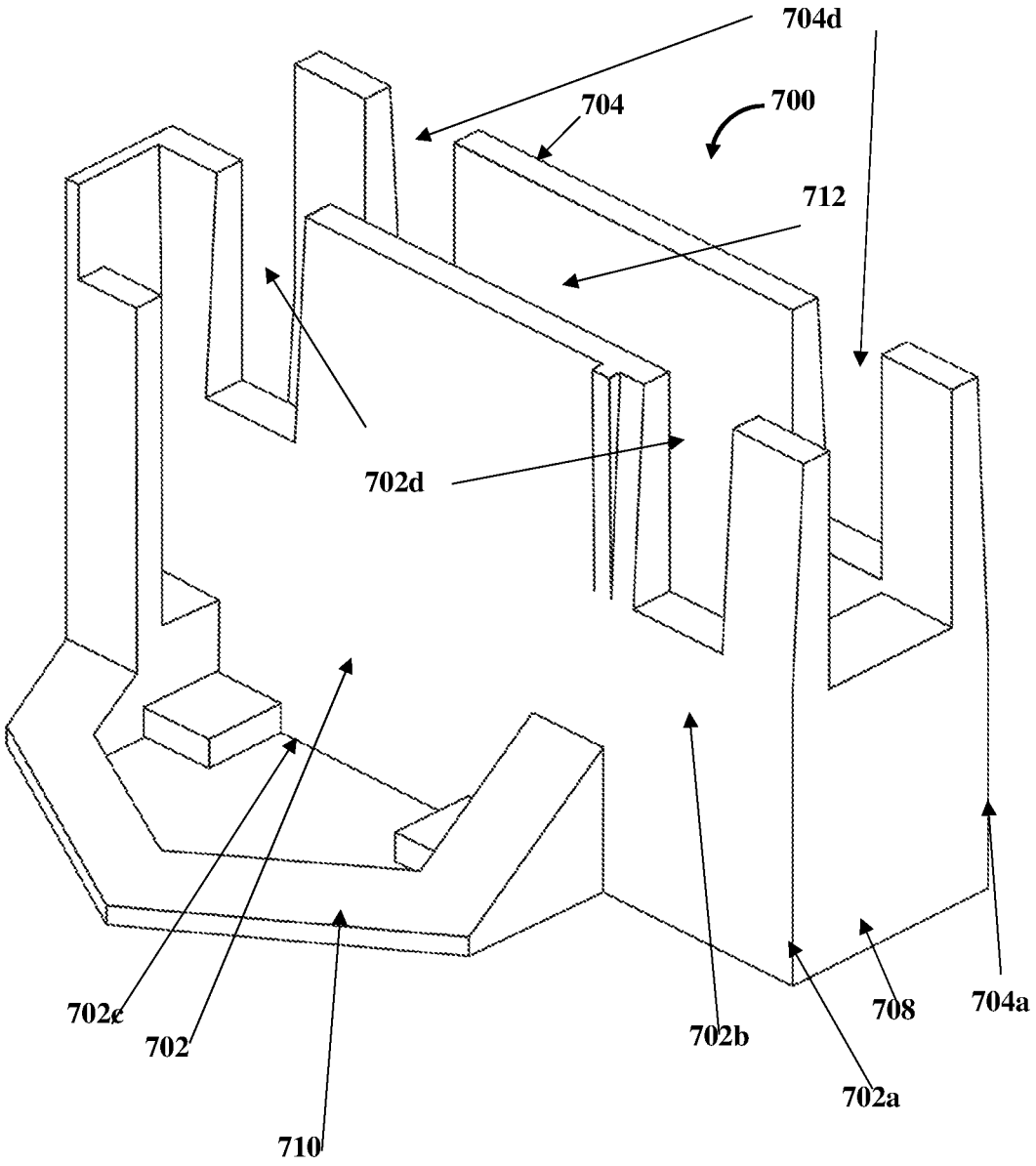
FIG. 7A exemplarily illustrates a front, right-side perspective view of a seventh embodiment of the apparatus for securing a tongue of a footwear in a fixed position.
Figure 7B:
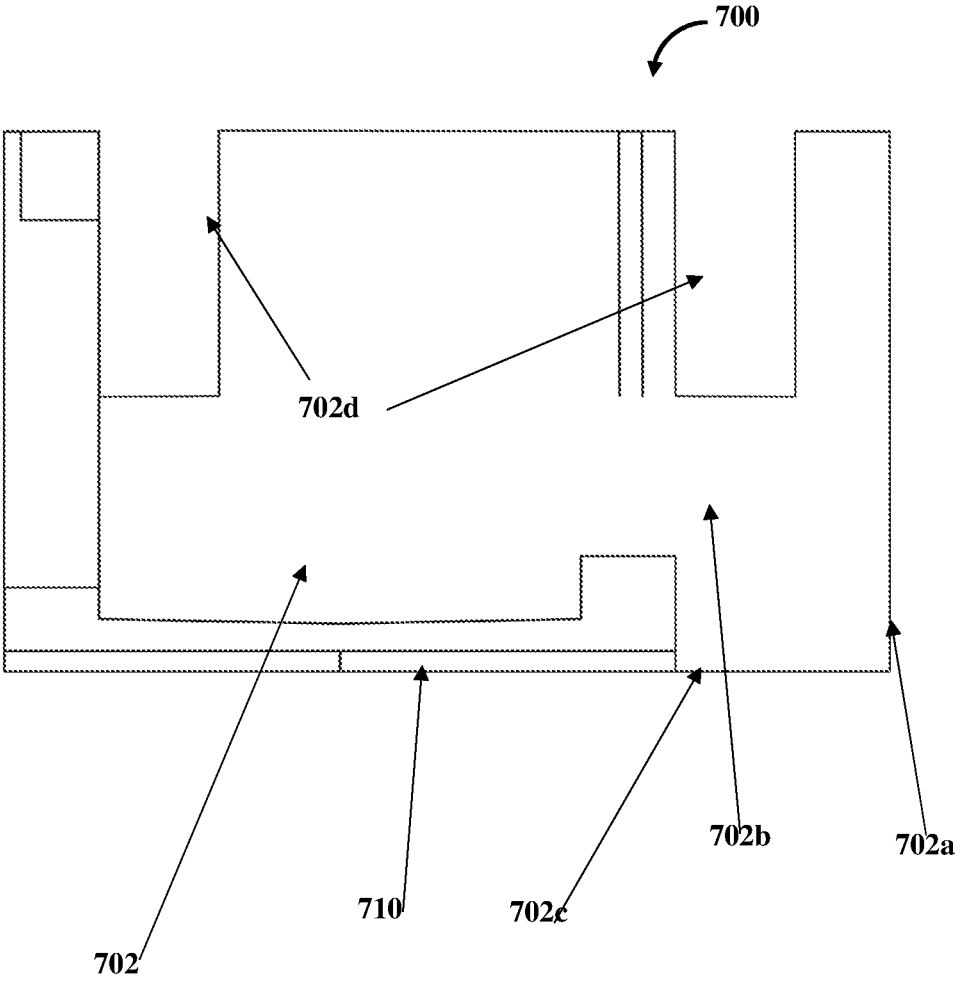
FIG. 7B exemplarily illustrates a front view of the seventh embodiment of the apparatus.
Figure 7C:
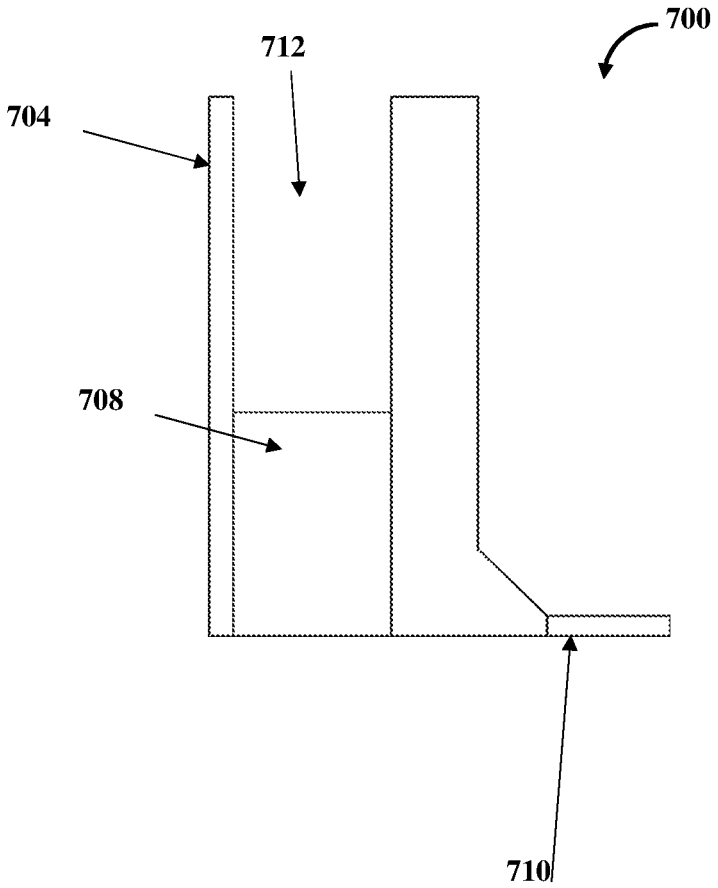
FIG. 7C exemplarily illustrates a left-side view of the seventh embodiment of the apparatus.

FIG. 7A exemplarily illustrates a front, right-side perspective view of a seventh embodiment of the apparatus 700 for securing a tongue 122 of a footwear 120 in a fixed position. FIG. 7B exemplarily illustrates a front view of the seventh embodiment of the apparatus 700. FIG. 7C exemplarily illustrates a left-side view of the seventh embodiment of the apparatus 700. In the seventh embodiment, the apparatus 700 comprises a first panel 702 and a second panel 704. The second panel 704 is aligned substantially parallel to the first panel 702. The apparatus 700 further comprises a connecting member 708 connecting the first panel 702 to the second panel 704. In an embodiment, the first panel 702 is spaced apart from the second panel 704. The first panel 702 and the second panel 704 define a space 712 therebetween for securing the tongue 122 folded in an upward direction. The apparatus 700 is adapted to secure the tongue 122 in the space 712 between the first panel 702 and the second panel 704.

Figure 7D:
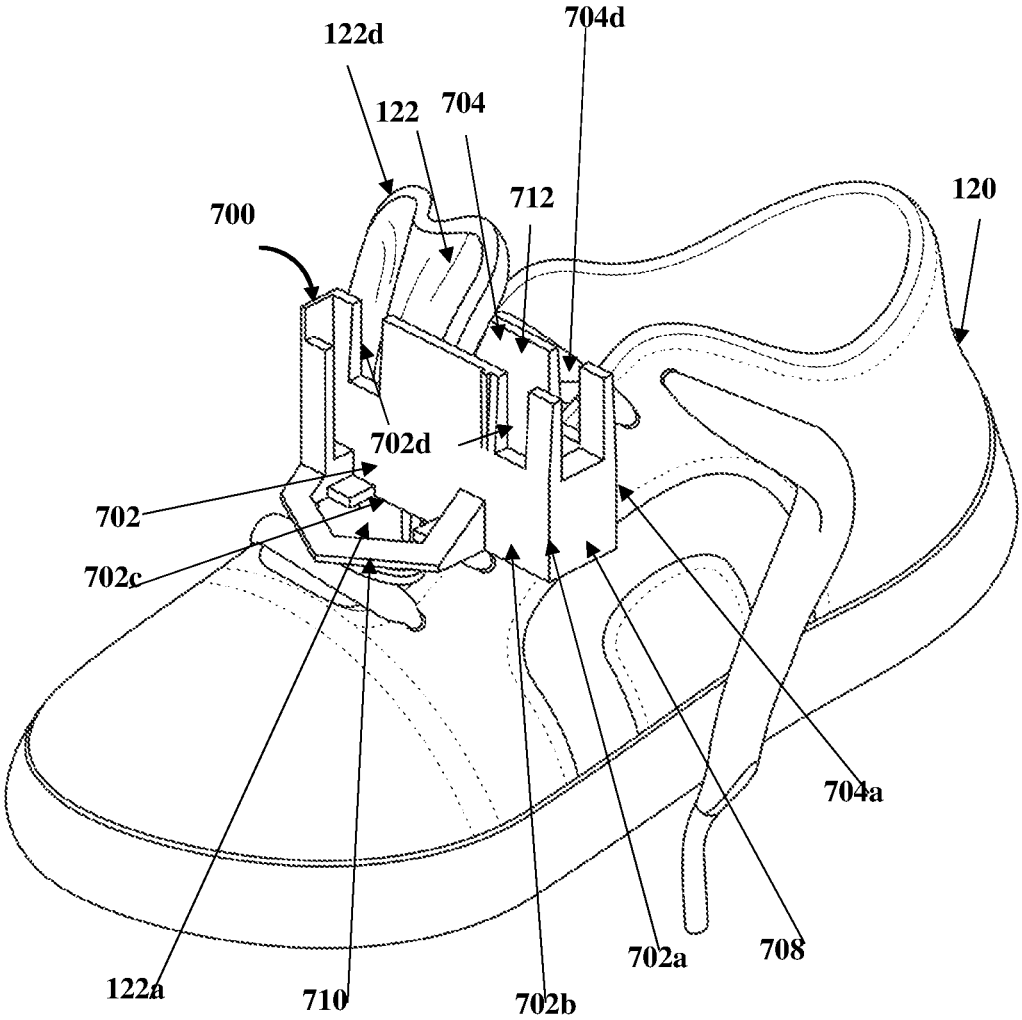
FIG. 7D exemplarily illustrates a front, right-side perspective view of the seventh embodiment of the apparatus affixed to a tongue of the footwear.

FIG. 7D exemplarily illustrates a front, right-side perspective view of the seventh embodiment of the apparatus 700 affixed to a tongue of the footwear 122. the seventh embodiment of the apparatus 700 attached to a base 122*a* of the tongue 122 of the footwear 120 to secure the tongue 122 in a fixed position. The apparatus 700 is adapted to secure the tongue 122 of the footwear 120 in the fixed position when the apparatus 700 is attached to the base 122*a* of the tongue 122. The connecting member 708 connects a side edge 702*a* of the first panel 702 to a side edge 704*a* of the second panel 704.

As shown in FIGS. 7A-7F, the first panel 702 comprises a flange 710 extending from a base 702*c* of the first panel 702 from an outer surface 702*b* of the apparatus 700. The flange 710 is adapted to rest on the laced eyestay 124 of the footwear and prevent the tongue 122 from bending towards the toe tip 130 of the footwear 120. In an embodiment, the tongue 122 is partially rolled or bundled to form a crimp before sliding the tongue 122 into the space 712 between the first panel 702 and the second panel 704.

As shown in FIG. 7A, the apparatus 700 comprises troughs 702*d* and 704*d* in the first and second panels 702 and 704. The troughs 702*d* and 704*d* in the first and second panels 702 and 704 are used to secure the apparatus 700 to the laced eyestay 124 using the lace 126 of the footwear 120.

FIGS. 8A-8E exemplarily illustrate an eighth embodiment of the apparatus 800 comprising two components 802 and 804. The eighth embodiment of the apparatus 800 is similar to the sixth embodiment of the apparatus 600 since both of these embodiments comprise two components 802 and 804, and 610 and 620. The first component 802 is a panel 802 having a shape that resembles an insole of a footwear 120 without the heel portion. The panel 802 comprises a plurality of holes 818 in the panel 802 that are each secured by a grommet 819. In an embodiment, the holes 818 are configured to secure an accessory (not shown). The second component 804 is a tongue collar 804 adapted to encircle a base 122*a* of the tongue 122. The tongue collar 804 comprises a first wall component 804*a* and a second wall component 804*b* located opposite to the first wall component 804*a*. The first wall component 804*a* and the second wall component 804*b* are spaced apart from each other and define a space 804*c* between the first wall component 804*a* and the second wall component 804*b*. The first wall component 804*a* and the second wall component 804*b* extend across a width of the tongue collar 804. The tongue collar 804 comprises a collar wall 804*d*. The collar wall 804*d* defines a shape of the tongue collar 804 that generally resembles the shape of a cup. A base portion 804*e* of tongue collar 804 has a broad v shape, a middle portion 804*f* of the tongue collar 804 extends upwards from ends of the v shaped base portion 804*e*, and a top portion 804*g* of the tongue collar 804 extends upwards and outwards from ends of the middle portion 804*f*. The first wall component 804*a* and the second wall component 804*b* are located within the base portion 804*e* and the middle portion 804*f* of the tongue collar 804. In an embodiment, one or both of the first wall component 804*a* and the second wall component 804*b* comprise one or more troughs 804*h* defined along a height of the first wall component 804*a* and the second wall component 804*b* for securing the apparatus 800 to the footwear 120. One end 122*d* of the tongue 122 of the footwear 120 is inserted from underneath the apparatus 800 into the space 804*c* between the first wall component 804*a* and the second wall component 804*b*. The tongue 122 is pulled up till the apparatus 800 contacts the base 122*a* of the tongue 122.

Figure 8A:
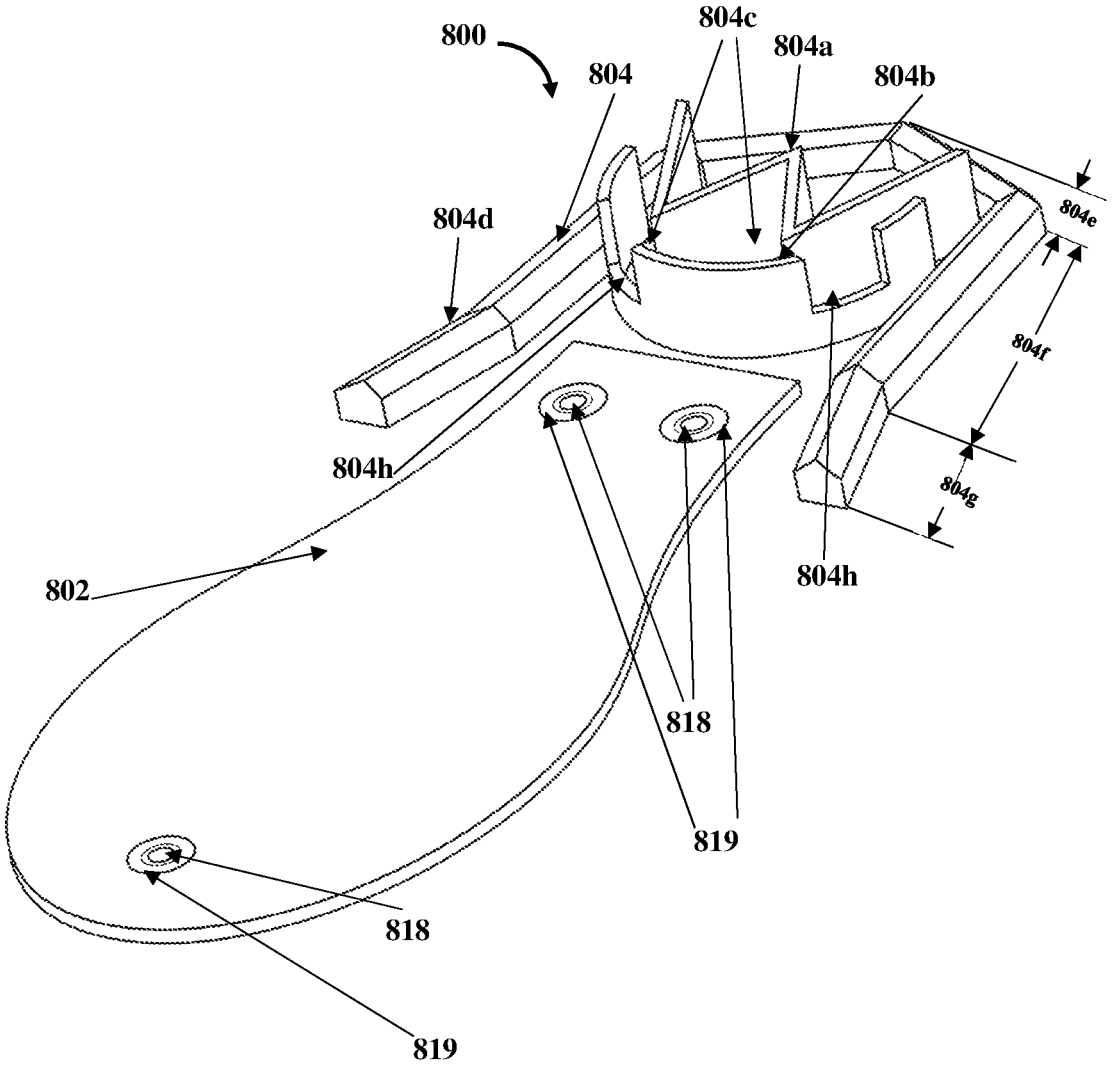
FIGS. 8A-8E exemplarily illustrate an eighth embodiment of the apparatus comprising two components.

As illustrated in FIG. 8A, the second wall component 804*b* defines a U-shape when viewed from the top of the apparatus 800 as the second wall component 804*b* extends across the width of the tongue collar 804. Likewise, the first wall component 804*a* defines a W-shape when viewed from the top of the apparatus 800 as the first wall component 804*a* extends across the width of the tongue collar 804.

Figure 8B:
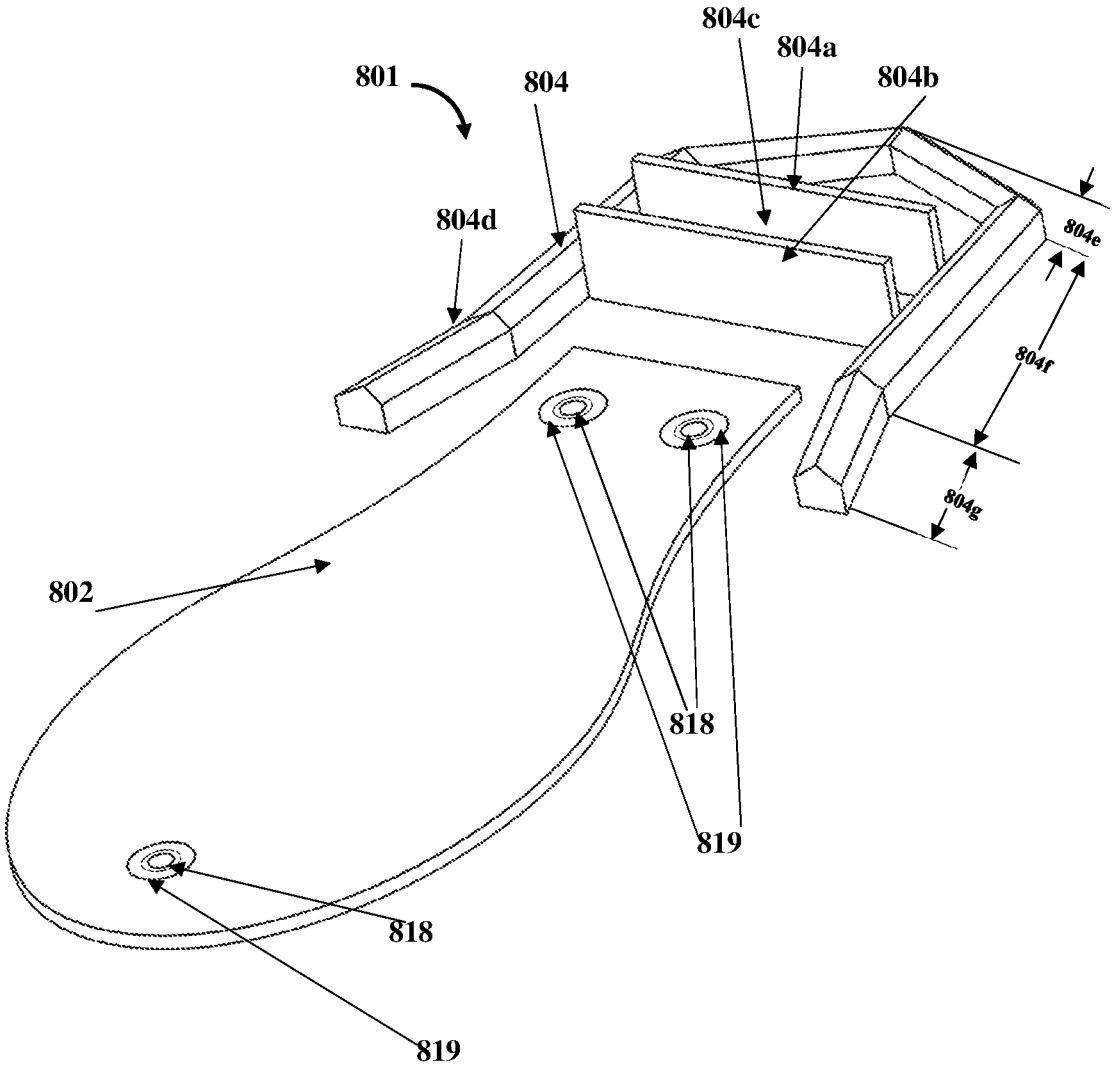

FIG. 8B illustrates an alternative implementation of the eighth embodiment of the apparatus 801. As illustrated in FIG. 8B, the first wall component 804*a* defines a straight line when viewed from the top of the apparatus 801 as the first wall component 804*a* extends across the width of the tongue collar 804. Likewise, the second wall component 804*b* also defines a straight line when viewed from the top of the apparatus 801 as the second wall component 804*b* extends across the width of the tongue collar 804.

Figure 8C:
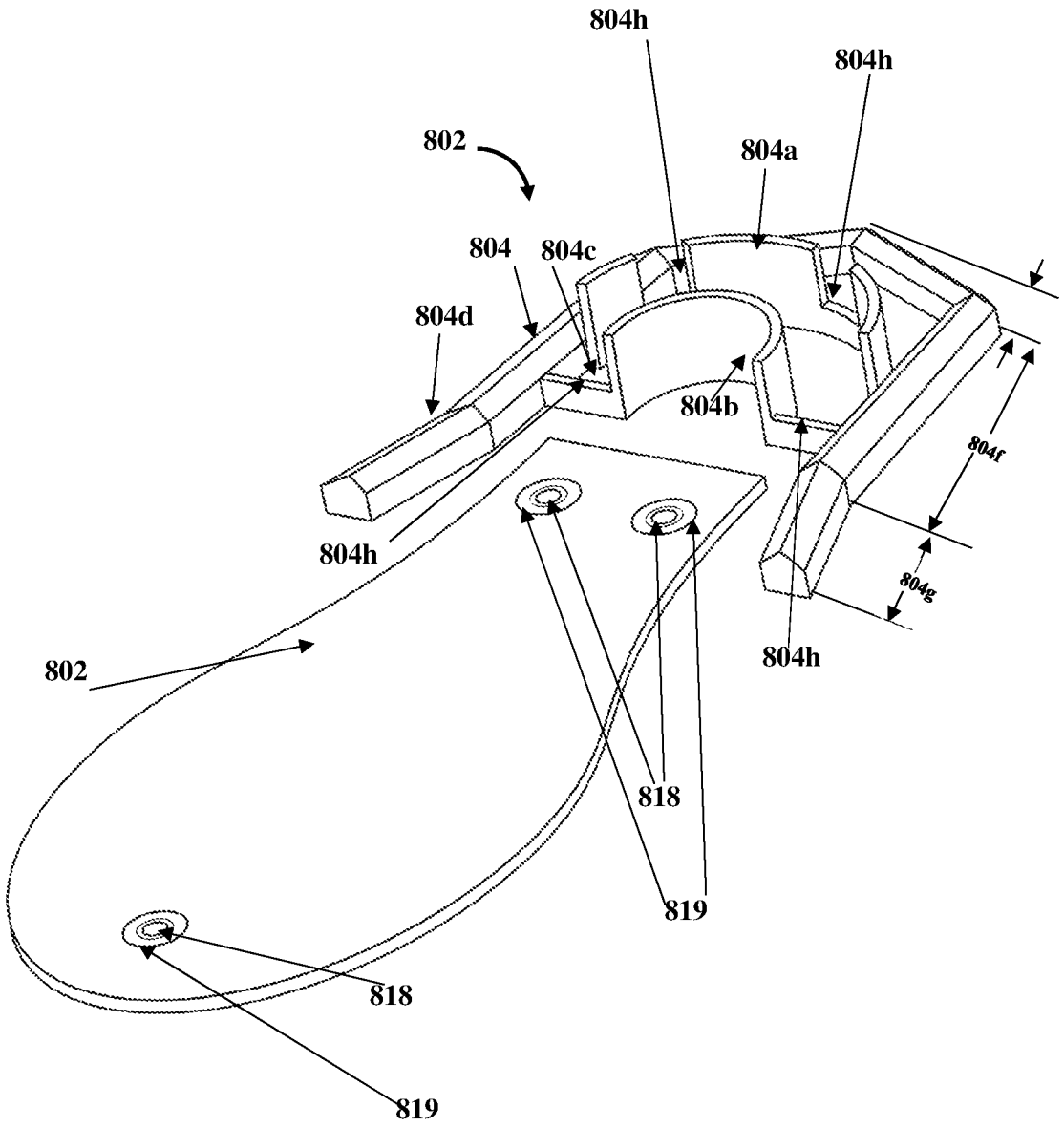

FIG. 8C illustrates an alternative implementation of the eighth embodiment of the apparatus 802. As illustrated in FIG. 8C, the first wall component 804*a* defines an inverted U-shape when viewed from the top of the apparatus 802 as the first wall component 804*a* extends across the width of the tongue collar 804. Likewise, the second wall component 804*b* also defines an inverted U-shape when viewed from the top of the apparatus 801 as the second wall component 804*b* extends across the width of the tongue collar 804. The second wall component 804*b* comprises extensions on either sides of the inverted U-shape. The extensions on either sides of the inverted U-shape comprise troughs 804*h* defined along a height of the extensions of the second wall component 804*b*.

Figure 8D:
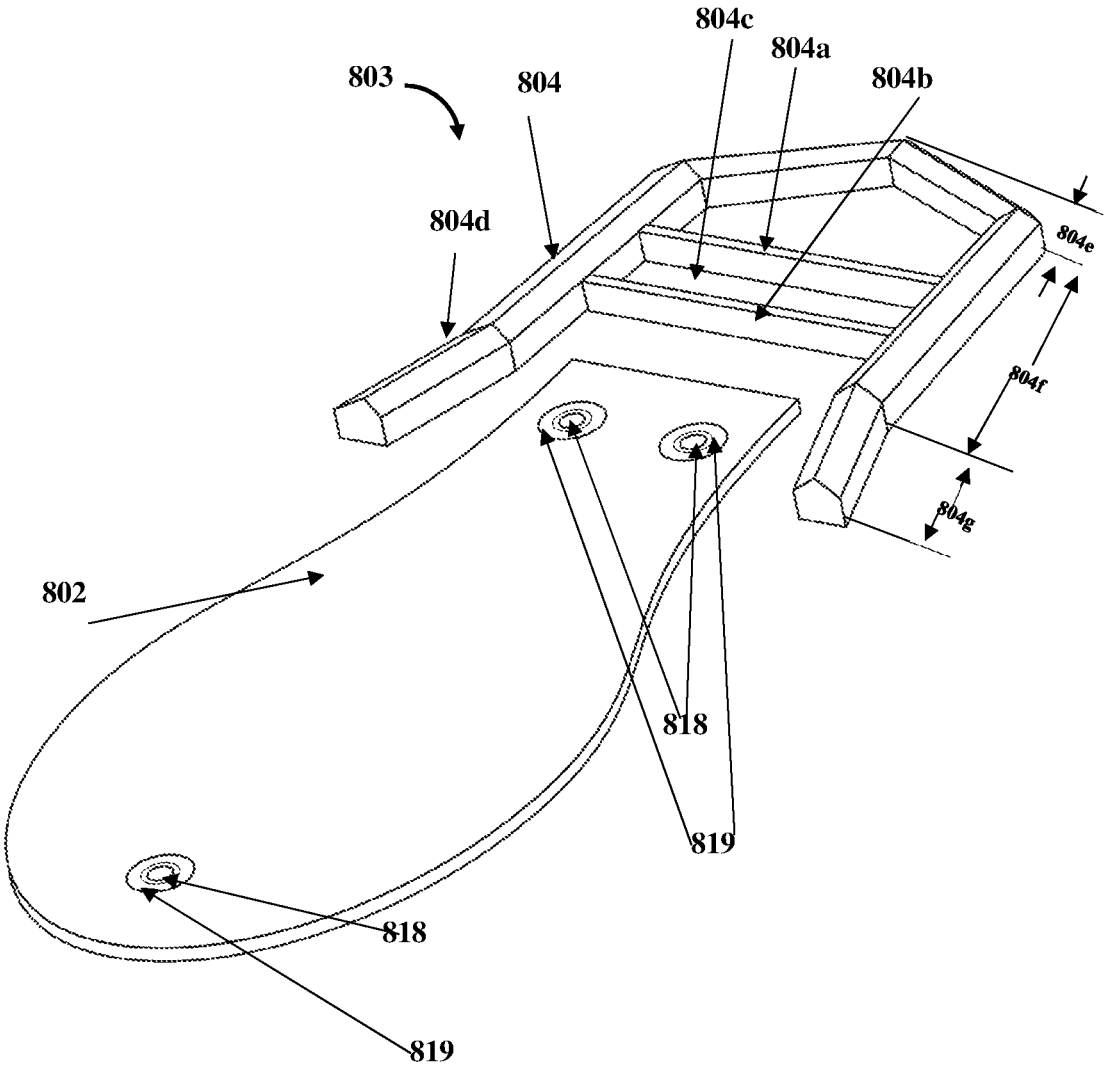

FIG. 8D illustrates an alternative implementation of the eighth embodiment of the apparatus 803. As illustrated in FIG. 8D, the first wall component 804*a* defines a straight line when viewed from the top of the apparatus 803 as the first wall component 804*a* extends across the width of the tongue collar 804. Likewise, the second wall component 804*b* also defines a straight line when viewed from the top of the apparatus 801 as the second wall component 804*b* extends across the width of the tongue collar 804. The alternative implementations of the eighth embodiment of the apparatuses 801 and 803 are similar, except that the heights of the first wall component 804*a* and the second wall component 804*b* of the alternative implementation of the apparatus 803 shown in FIG. 8D is lesser than the heights of the first wall component 804*a* and the second wall component 804*b* of the alternative implementation of the apparatus 801 shown in FIG. 8B.

Figure 8E:
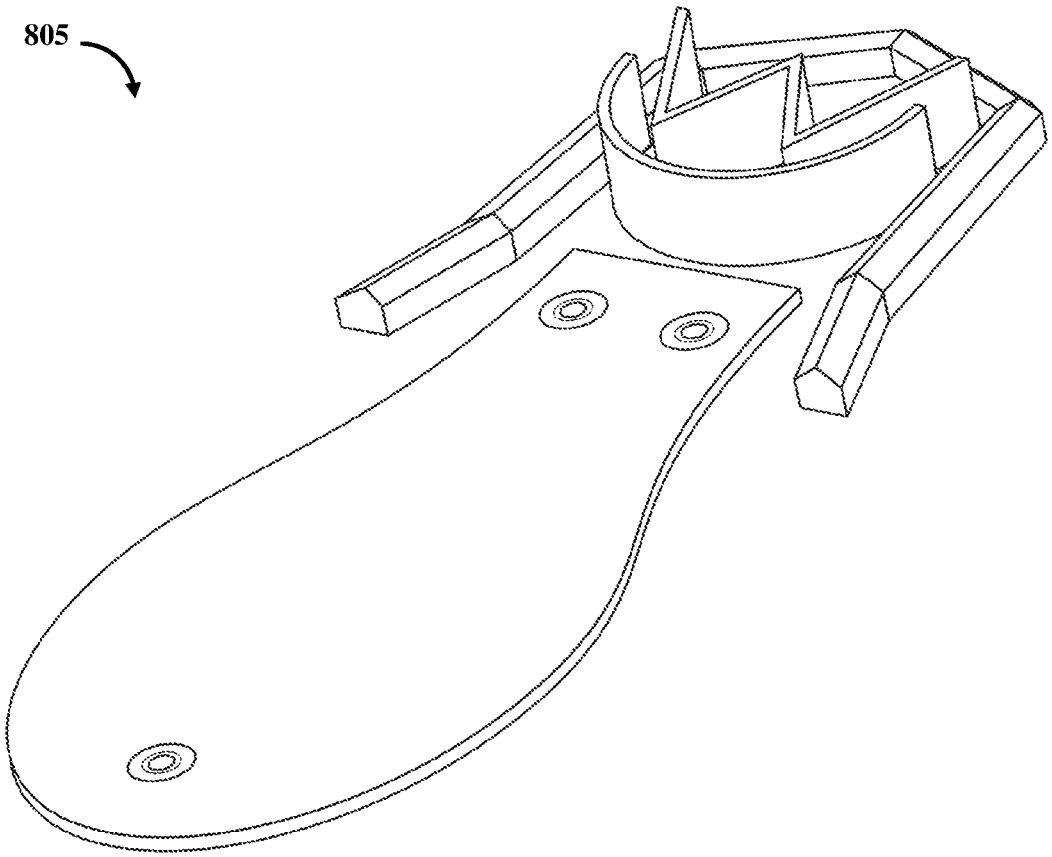

FIG. 8E illustrates an alternative implementation of the eighth embodiment of the apparatus 805. The alternative implementation of the eighth embodiment of the apparatus 805 shown in FIG. 8E is similar to the alternative implementation of the eighth embodiment of the apparatus 800 shown in FIG. 8A, except that the apparatus 805 shown in FIG. 8E does not comprise troughs 804*h* defined along a height of the second wall component 804*b*.

The foregoing examples and illustrative implementations of various embodiments have been provided merely for explanation and are in no way to be construed as limiting of the embodiments disclosed herein. Dimensions of various parts of the apparatus for securing a tongue of footwear in a fixed position disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

We claim:

1. An apparatus for securing a tongue of footwear in a fixed position, the apparatus comprising:

a first panel comprising a slot adapted to slidably encircle the tongue folded in an upward direction, wherein the slot is adapted to squeeze and bundle the tongue to secure the tongue in the fixed position, and wherein the first panel is adapted to move along a longitudinal axis of the tongue; and a second panel extending from a proximal end of the first panel.

2. The apparatus of claim 1, wherein the second panel comprises a plurality of holes disposed proximal to a proximal end of the second panel, and wherein each of the holes is secured by a grommet.

3. The apparatus of claim 1, wherein the first panel extends along the longitudinal axis of the tongue.

4. The apparatus of claim 1, wherein length of the first panel is about 1 inch to about 7 inches.

5. The apparatus of claim 1, wherein width of the first panel is greater than width of the second panel, and wherein the first panel is adapted to encapsulate the tongue when the first panel slidably encircles a base of the tongue.

6. The apparatus of claim 1, wherein the slot is disposed proximal to the proximal end of the first panel.

7. The apparatus of claim 1, wherein the slot is one of a circular-shaped slot, a rectangular-shaped slot, a square-shaped slot, a triangular-shaped slot, a polygonal-shaped slot, and a star-shaped slot.

8. The apparatus of claim 1, wherein length of the second panel is one of greater than length of the first panel and equal to the length of the first panel, and wherein the second panel is adapted to be disposed below a laced eyestay of the footwear.

9. The apparatus of claim 1 adapted to:

tilt the tongue towards a collar of the footwear when: one of the second panel is pushed towards a base of the tongue, and the first panel is pushed towards the tongue; and tilt the tongue towards a toe tip of the footwear when the second panel is pulled towards the collar of the footwear.

10. The apparatus of claim 1, wherein the first panel and the second panel comprise one or more receptacles and fasteners to receive and fasten one or more accessories, respectively.

11. The apparatus of claim 1 made of one or more of a fabric material, a leather material, a plastic material, a composite material, a metal, and an alloy.

12. The apparatus of claim 1, wherein the apparatus is made of one or more of a plastic material, a composite material, a metal, and an alloy.

* * * * *